US012398503B2

(12) United States Patent
Lee et al.

(10) Patent No.: US 12,398,503 B2
(45) Date of Patent: Aug. 26, 2025

(54) LAUNDRY TREATING APPARATUS

(71) Applicant: LG ELECTRONICS INC., Seoul (KR)

(72) Inventors: Yunhi Lee, Seoul (KR); Jaehyun Kim, Seoul (KR); Hyunsun Yoo, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 369 days.

(21) Appl. No.: 17/827,082

(22) Filed: May 27, 2022

(65) Prior Publication Data

US 2022/0380963 A1 Dec. 1, 2022

(30) Foreign Application Priority Data

May 28, 2021 (KR) ..... 10-2021-0069528
Jun. 1, 2021 (KR) ..... 10-2021-0071149
(Continued)

(51) Int. Cl.
*D06F 58/10* (2006.01)
*D06F 29/00* (2006.01)
(Continued)

(52) U.S. Cl.
CPC ..... *D06F 58/10* (2013.01); *D06F 29/005* (2013.01); *D06F 33/32* (2020.02); *D06F 58/04* (2013.01);
(Continued)

(58) Field of Classification Search
CPC ..... D06F 29/005; D06F 33/32; D06F 39/04; D06F 58/10; D06F 58/206; D06F 58/26;
(Continued)

(56) References Cited

U.S. PATENT DOCUMENTS 7,320,234 B2 1/2008 Hershey et al.
9,359,714 B2 * 6/2016 Contarini ..... D06F 58/203
(Continued)

FOREIGN PATENT DOCUMENTS

CN 103348053 A 10/2013
CN 104018328 A 9/2014
(Continued)

OTHER PUBLICATIONS

Machine translation of CN 109554880 A to Wang et al. (Year: 2019).*

*Primary Examiner* — Joseph L. Perrin

(74) *Attorney, Agent, or Firm* — Birch, Stewart, Kolasch & Birch, LLP

(57) ABSTRACT

A laundry treating apparatus according to an aspect of the present disclosure includes a dryer including a first cabinet, and a drum rotatably mounted in the first cabinet; a refresher including a second cabinet disposed on one side of the first cabinet and having an inner space for receiving laundry; a first supply air duct for supplying air into the drum; a second supply air duct for supplying air into the inner space of the second cabinet; and a heating device for heating air flowing into the first supply air duct and the second supply air duct, and disposed in the first cabinet and disposed under the drum, thereby supplying hot air to the dryer and the refresher by using a single heating device.

13 Claims, 20 Drawing Sheets

(30) Foreign Application Priority Data

| | | |
|---|---|---|
| Aug. 23, 2021 | (KR) | 10-2021-0110914 |
| Aug. 23, 2021 | (KR) | 10-2021-0110915 |
| Sep. 29, 2021 | (KR) | 10-2021-0128828 |
| Sep. 29, 2021 | (KR) | 10-2021-0128829 |

(51) Int. Cl.

| | |
|---|---|
| ***D06F 33/32*** | (2020.01) |
| ***D06F 58/04*** | (2006.01) |
| ***D06F 58/20*** | (2006.01) |
| ***D06F 58/26*** | (2006.01) |
| ***D06F 58/38*** | (2020.01) |
| ***D06F 73/02*** | (2006.01) |
| *D06F 103/32* | (2020.01) |
| *D06F 103/50* | (2020.01) |
| *D06F 105/20* | (2020.01) |
| *D06F 105/26* | (2020.01) |

(52) U.S. Cl.
CPC ..... *D06F 58/20* (2013.01); *D06F 58/206* (2013.01); *D06F 58/26* (2013.01); *D06F 58/38* (2020.02); *D06F 73/02* (2013.01); *D06F 2103/32* (2020.02); *D06F 2103/50* (2020.02); *D06F 2105/20* (2020.02); *D06F 2105/26* (2020.02)

(58) Field of Classification Search
CPC ..... D06F 58/38; D06F 73/02; D06F 2103/32; D06F 2103/50; D06F 2105/20; D06F 2105/26
See application file for complete search history.

(56) References Cited

U.S. PATENT DOCUMENTS

| | | | | |
|---|---|---|---|---|
| 9,372,031 | B2 * | 6/2016 | Contarini | F26B 21/086 |
| 9,435,069 | B2 * | 9/2016 | Contarini | D06F 58/206 |
| 2002/0017117 | A1 | 2/2002 | Sunshine et al. | |
| 2004/0194339 | A1 | 10/2004 | Johnson et al. | |
| 2005/0155393 | A1 | 7/2005 | Wright et al. | |
| 2006/0112585 | A1 | 6/2006 | Choi et al. | |
| 2006/0137210 | A1 | 6/2006 | Lee et al. | |
| 2006/0156765 | A1 * | 7/2006 | Sunshine | D06F 39/12 68/19 |
| 2007/0151300 | A1 | 7/2007 | Sunshine | |
| 2007/0151301 | A1 | 7/2007 | Kendall et al. | |
| 2007/0169519 | A1 | 7/2007 | Hershey et al. | |
| 2007/0256457 | A1 * | 11/2007 | Kendall | D06F 29/00 68/3 R |
| 2008/0229515 | A1 | 9/2008 | Hong et al. | |
| 2009/0126421 | A1 | 5/2009 | Kim et al. | |
| 2010/0299976 | A1 | 12/2010 | Roselle et al. | |
| 2011/0132043 | A1 | 6/2011 | Kim | |
| 2011/0185511 | A1 | 8/2011 | Ryoo et al. | |
| 2012/0260520 | A1 * | 10/2012 | Hong | D06F 58/20 34/604 |
| 2014/0026433 | A1 * | 1/2014 | Bison | D06F 39/12 34/73 |
| 2016/0186374 | A1 | 6/2016 | Ryoo et al. | |
| 2018/0230640 | A1 * | 8/2018 | Bilionis | D06F 58/48 |
| 2018/0340285 | A1 * | 11/2018 | Choi | D06F 31/00 |
| 2018/0340288 | A1 | 11/2018 | Kim et al. | |
| 2020/0240065 | A1 | 7/2020 | Underly et al. | |
| 2021/0148029 | A1 | 5/2021 | Lv et al. | |

FOREIGN PATENT DOCUMENTS

| | | | | | |
|---|---|---|---|---|---|
| CN | 105316890 | A | | 2/2016 | |
| CN | 106032612 | A | | 10/2016 | |
| CN | 106283485 | A | | 1/2017 | |
| CN | 108301165 | A | | 7/2018 | |
| CN | 109554880 | A | * | 4/2019 | D06F 29/005 |
| CN | 109582306 | A | | 4/2019 | |
| CN | 209652609 | U | | 11/2019 | |
| CN | 209686107 | U | | 11/2019 | |
| CN | 111996767 | A | | 11/2020 | |
| DE | 10 2006 015 840 | A1 | | 10/2007 | |
| DE | 10 2008 006 111 | A1 | | 7/2009 | |
| DE | 10 2008 064 737 | B3 | | 8/2016 | |
| EP | 1 029 961 | A2 | | 8/2000 | |
| EP | 3 940 134 | A1 | | 1/2022 | |
| JP | 2004-159859 | A | | 6/2004 | |
| JP | 2008-307151 | A | | 12/2008 | |
| KR | 10-2005-0066534 | A | | 6/2005 | |
| KR | 10-2006-0042568 | A | | 5/2006 | |
| KR | 10-2006-0046802 | A | | 5/2006 | |
| KR | 10-2006-0060211 | A | | 6/2006 | |
| KR | 10-0587360 | B1 | | 6/2006 | |
| KR | 10-2006-0111128 | A | | 10/2006 | |
| KR | 10-0658842 | B1 | | 12/2006 | |
| KR | 10-0674718 | B1 | | 1/2007 | |
| KR | 10-0839519 | B1 | | 6/2008 | |
| KR | 10-2008-0100964 | A | | 11/2008 | |
| KR | 10-2010-0025981 | A | | 3/2010 | |
| KR | 10-2019-0131259 | A | | 11/2019 | |
| KR | 10-2120993 | B1 | | 6/2020 | |
| KR | 10-2020-0109194 | A | | 9/2020 | |
| KR | 10-2200698 | B1 | | 1/2021 | |
| KR | 10-2254903 | B1 | | 5/2021 | |
| WO | WO 2007/148894 | A2 | | 12/2007 | |
| WO | WO2008/066539 | A1 | | 6/2008 | |
| WO | WO 2011/149320 | A2 | | 12/2011 | |
| WO | WO 2014/017004 | A1 | | 1/2014 | |
| WO | WO 2017/119673 | A1 | | 7/2017 | |
| WO | WO 2019/141063 | A1 | | 7/2019 | |
| WO | WO 2019/154266 | A1 | | 8/2019 | |
| WO | WO 2021/083006 | A1 | | 5/2021 | |

* cited by examiner

【FIG. 1】
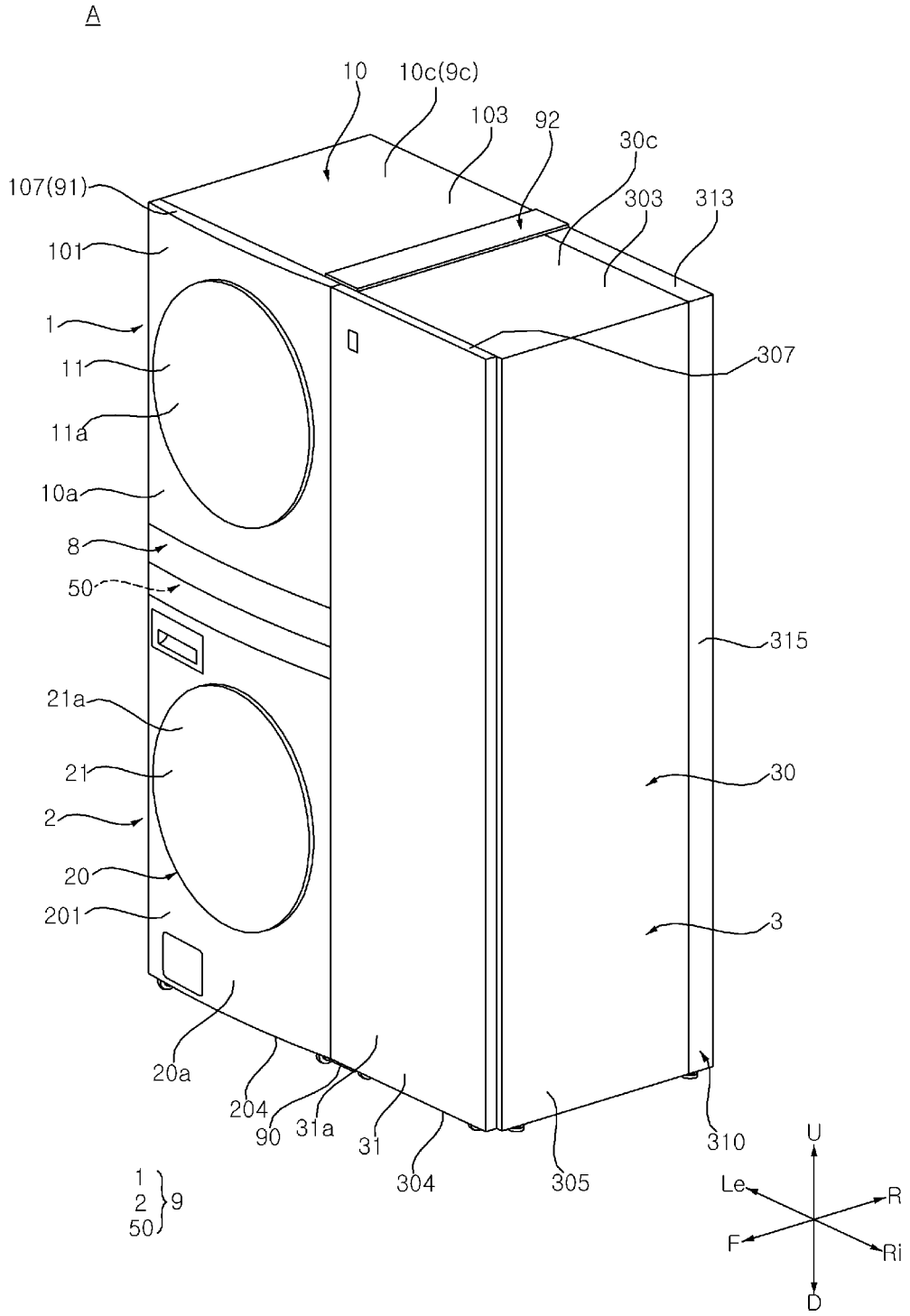

【FIG. 2】
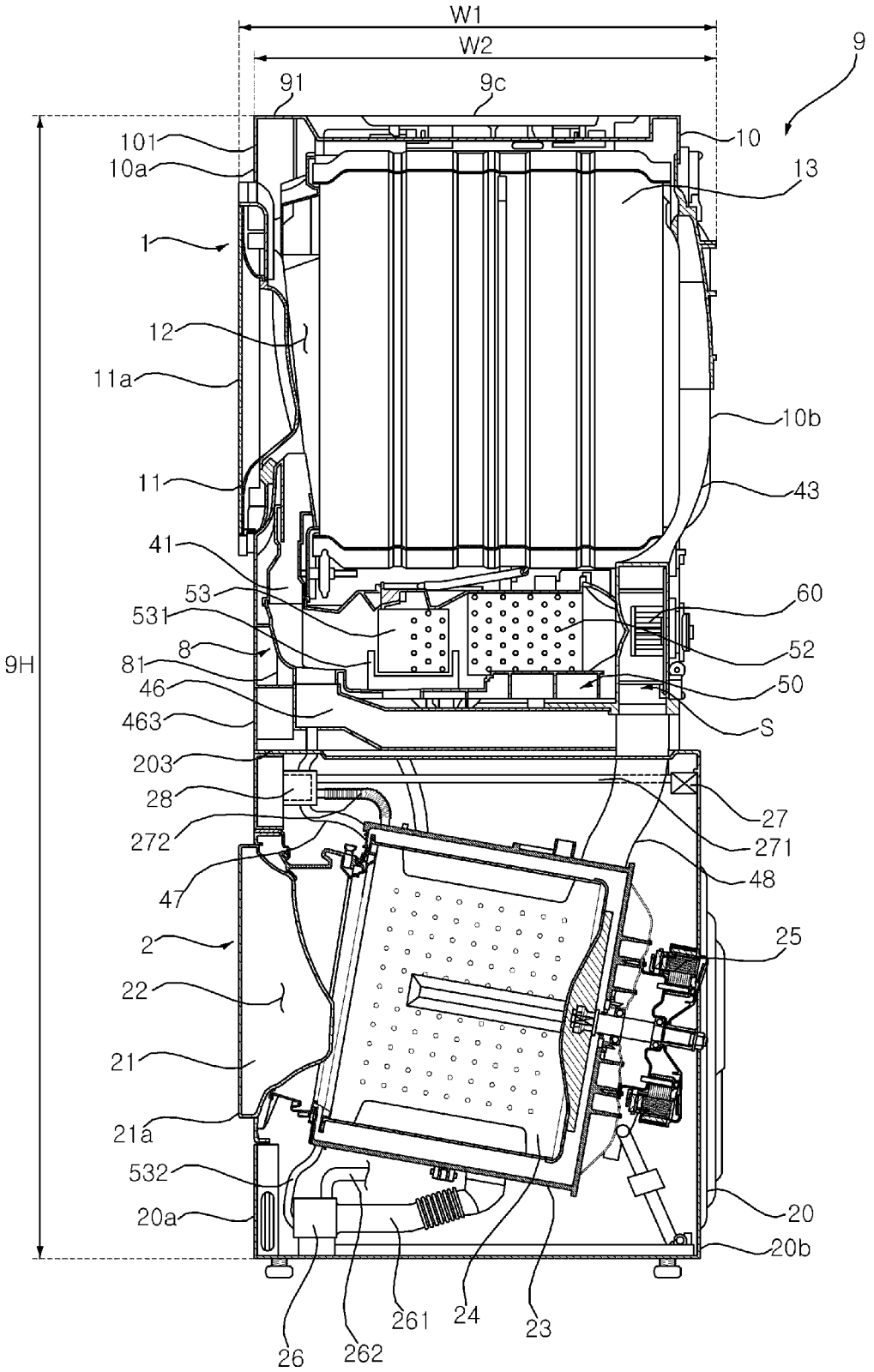

【FIG. 3】
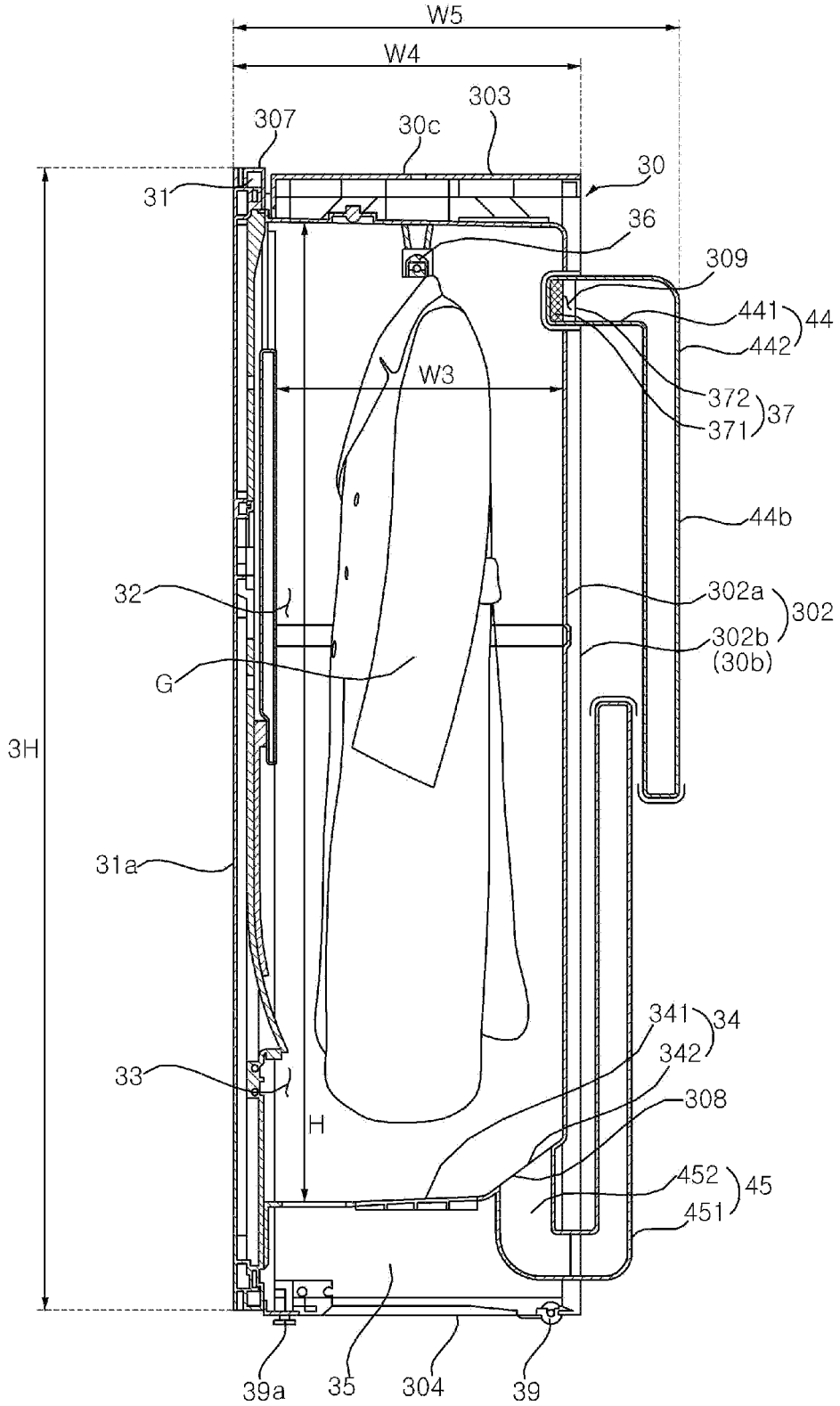

【FIG. 4】
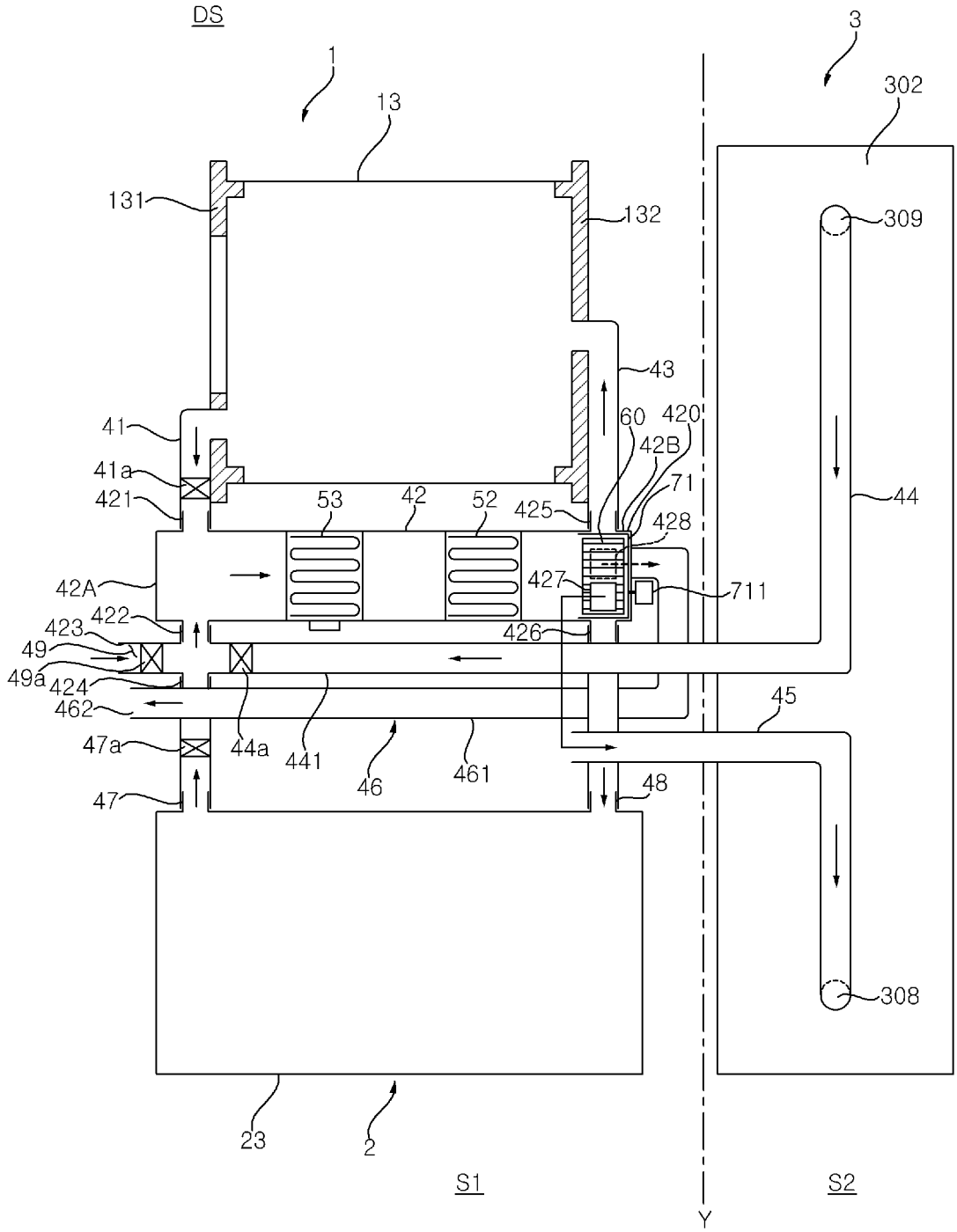

【FIG. 5】
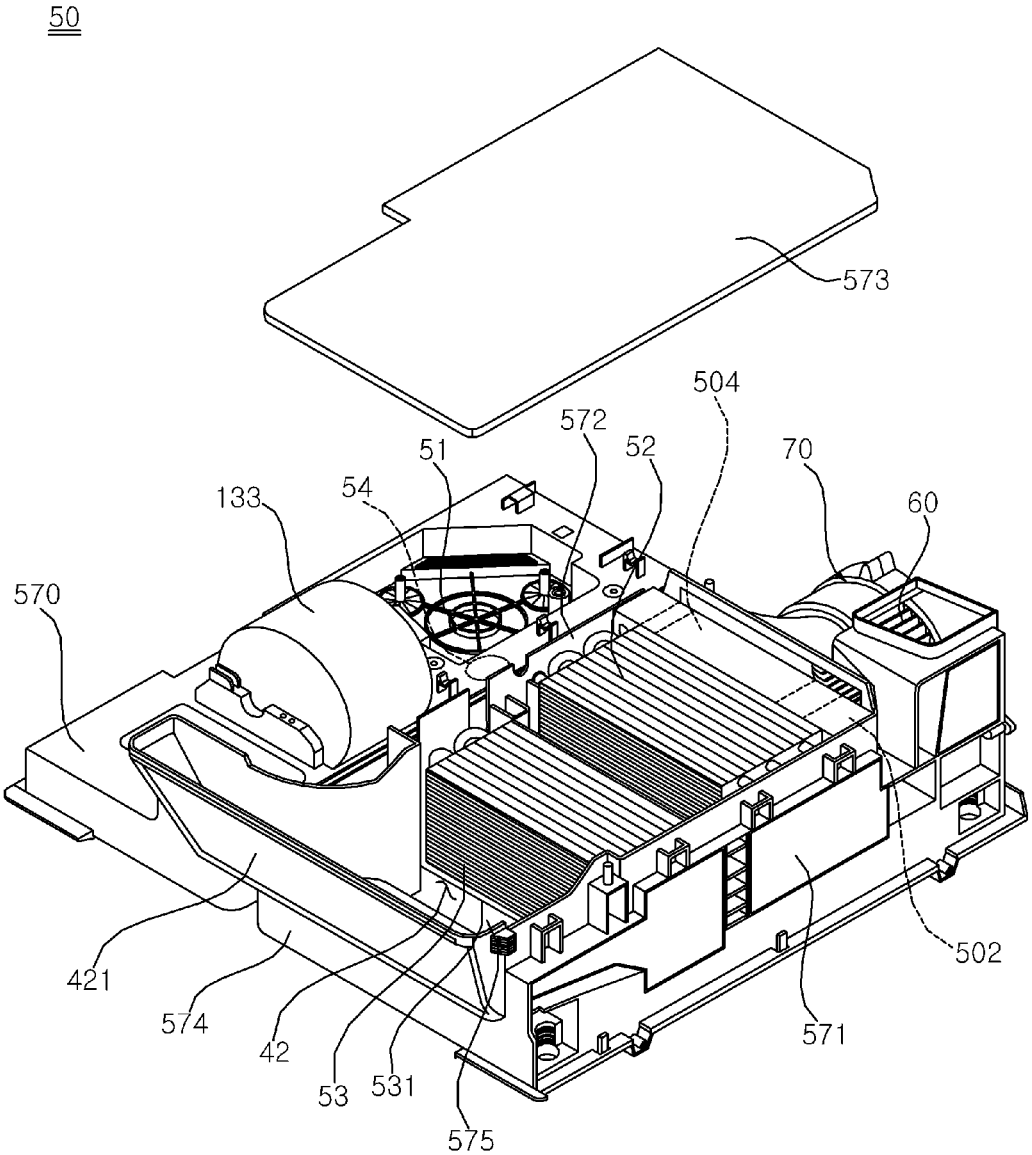

【FIG. 6】
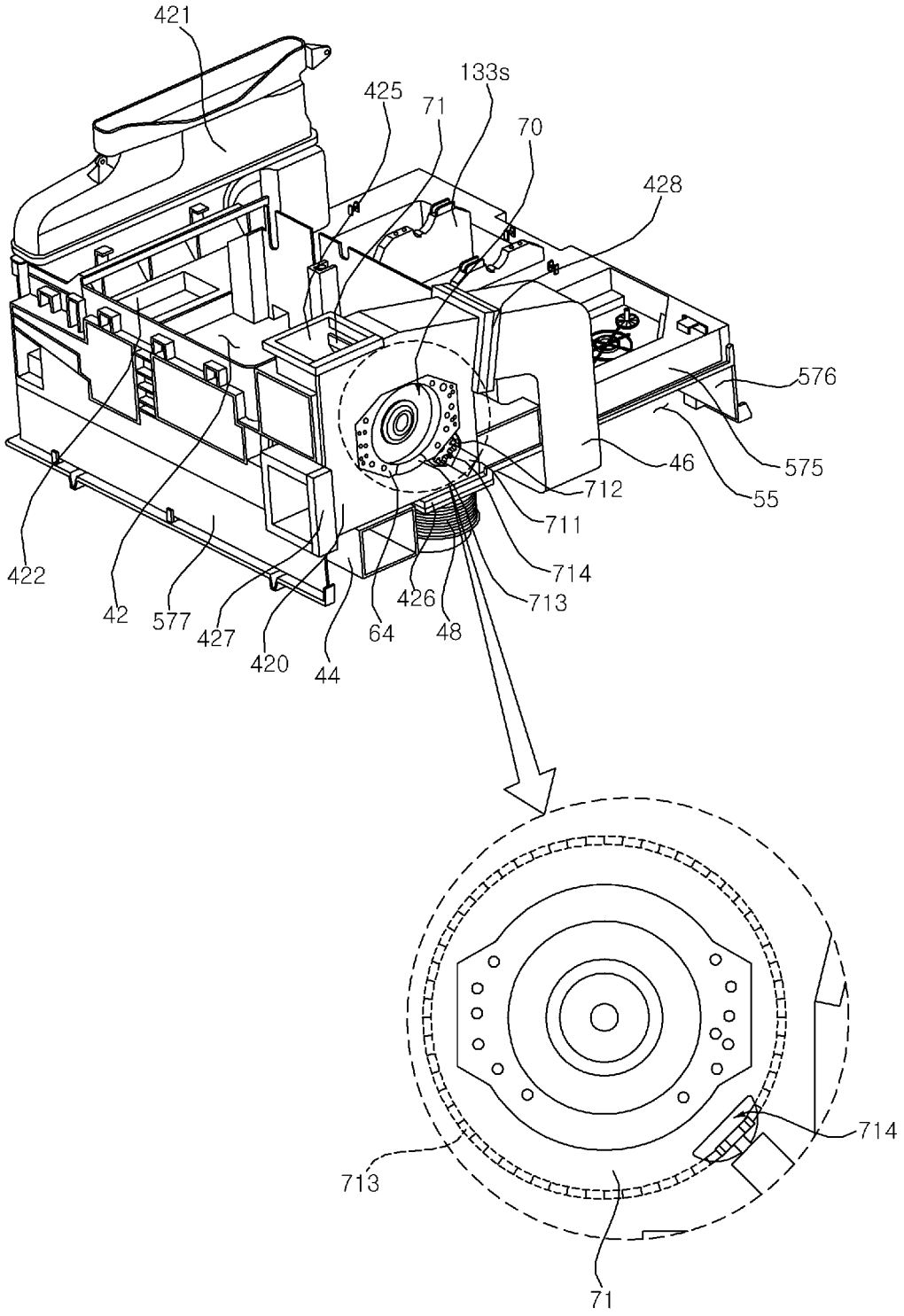

【FIG. 7】
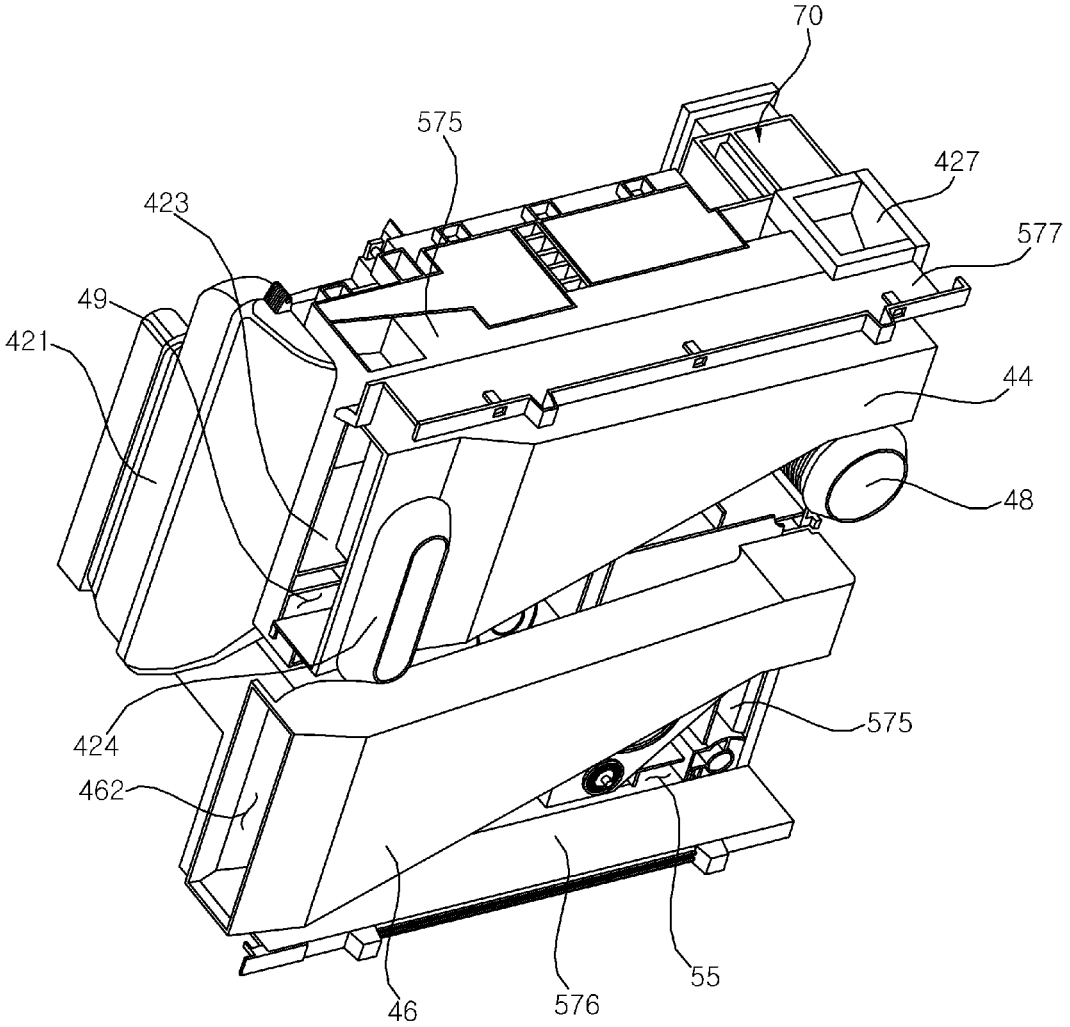

【FIG. 8】
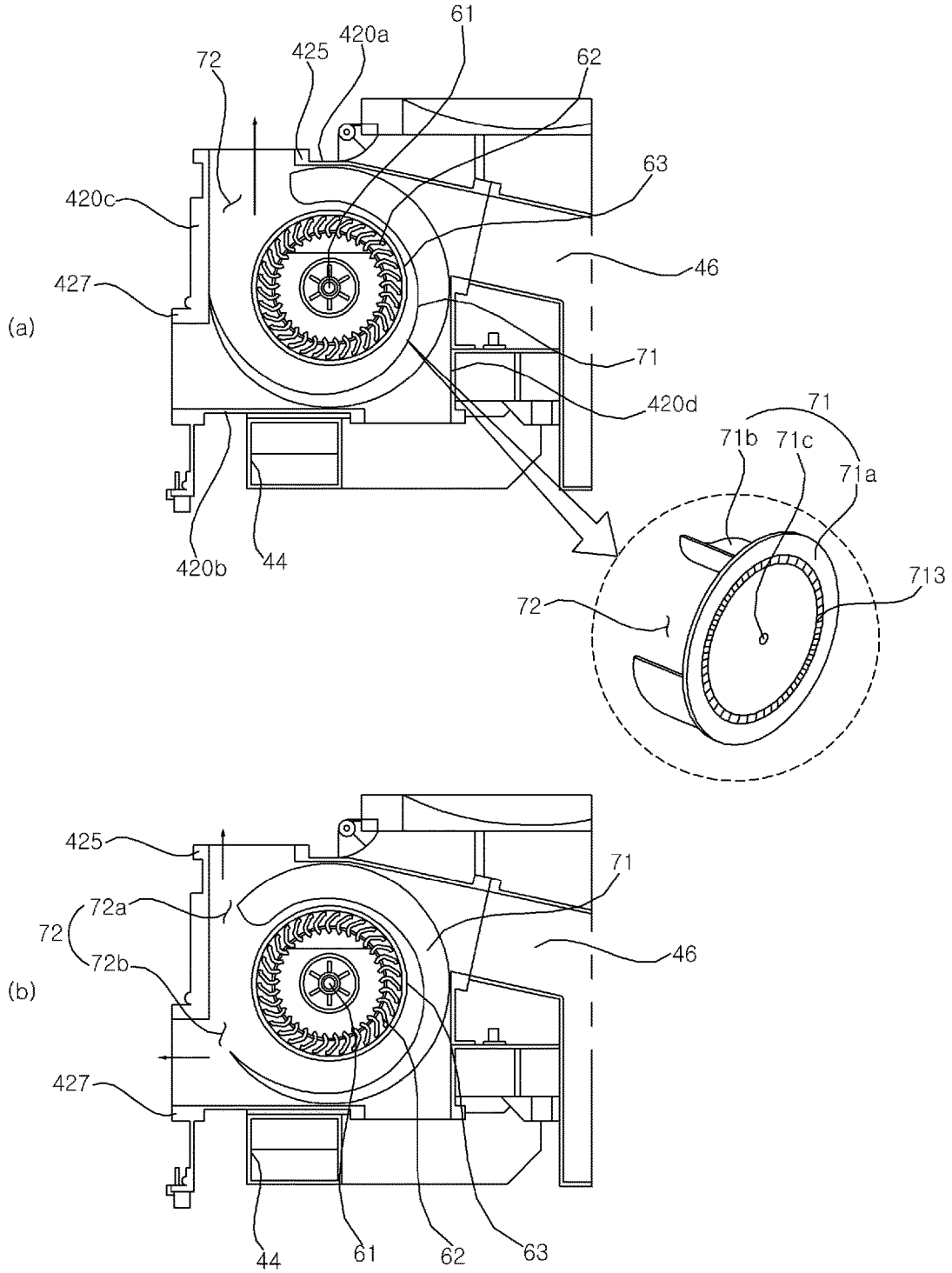

【FIG. 9】
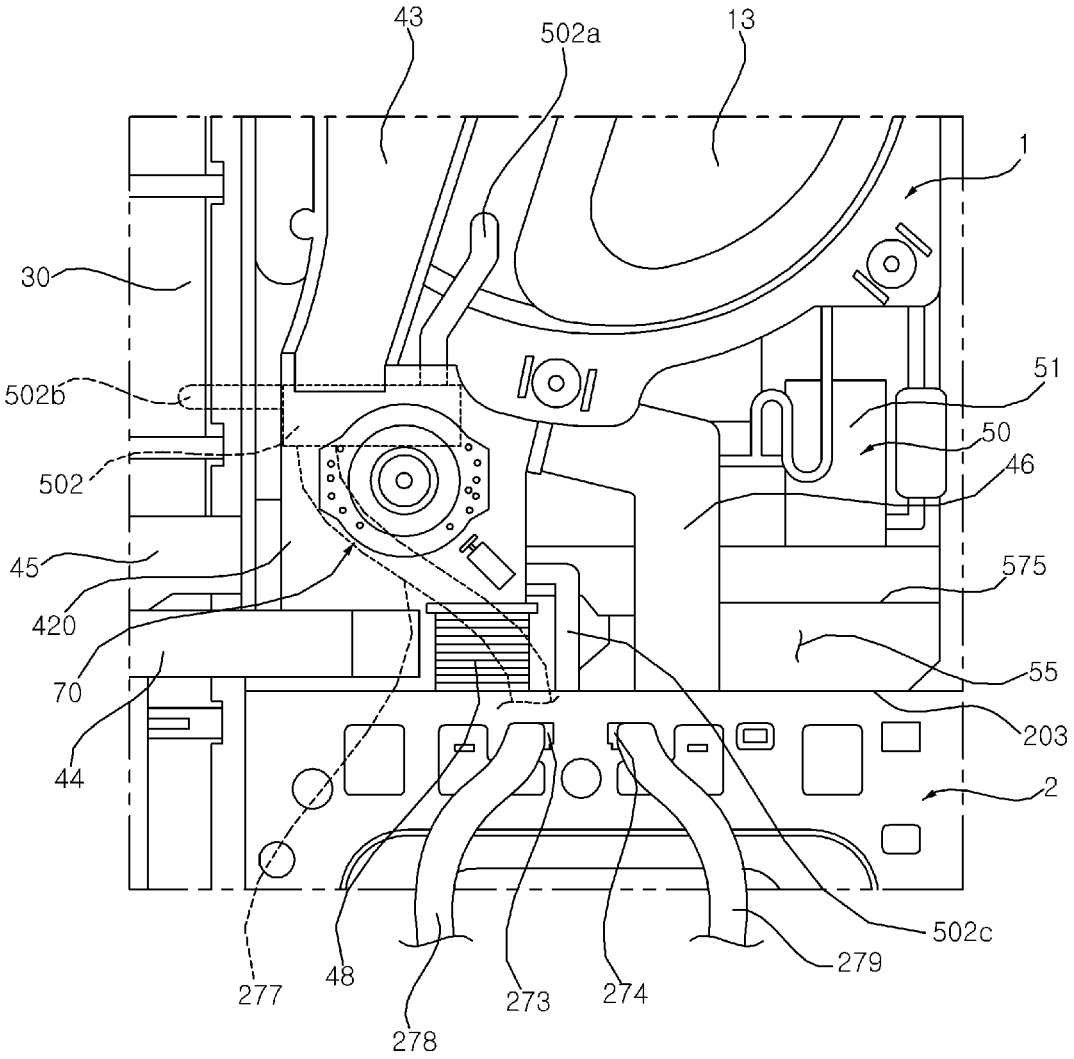

【FIG. 10】
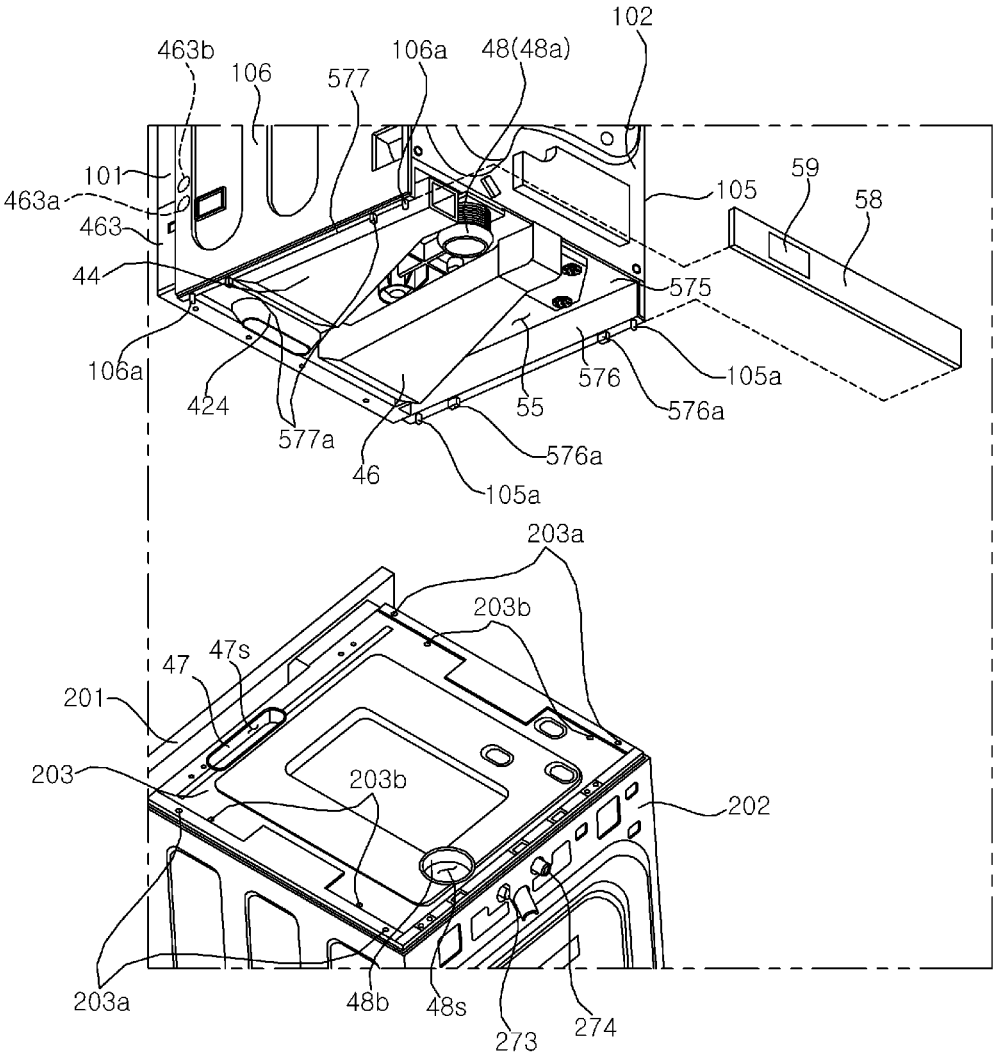

【FIG. 11】
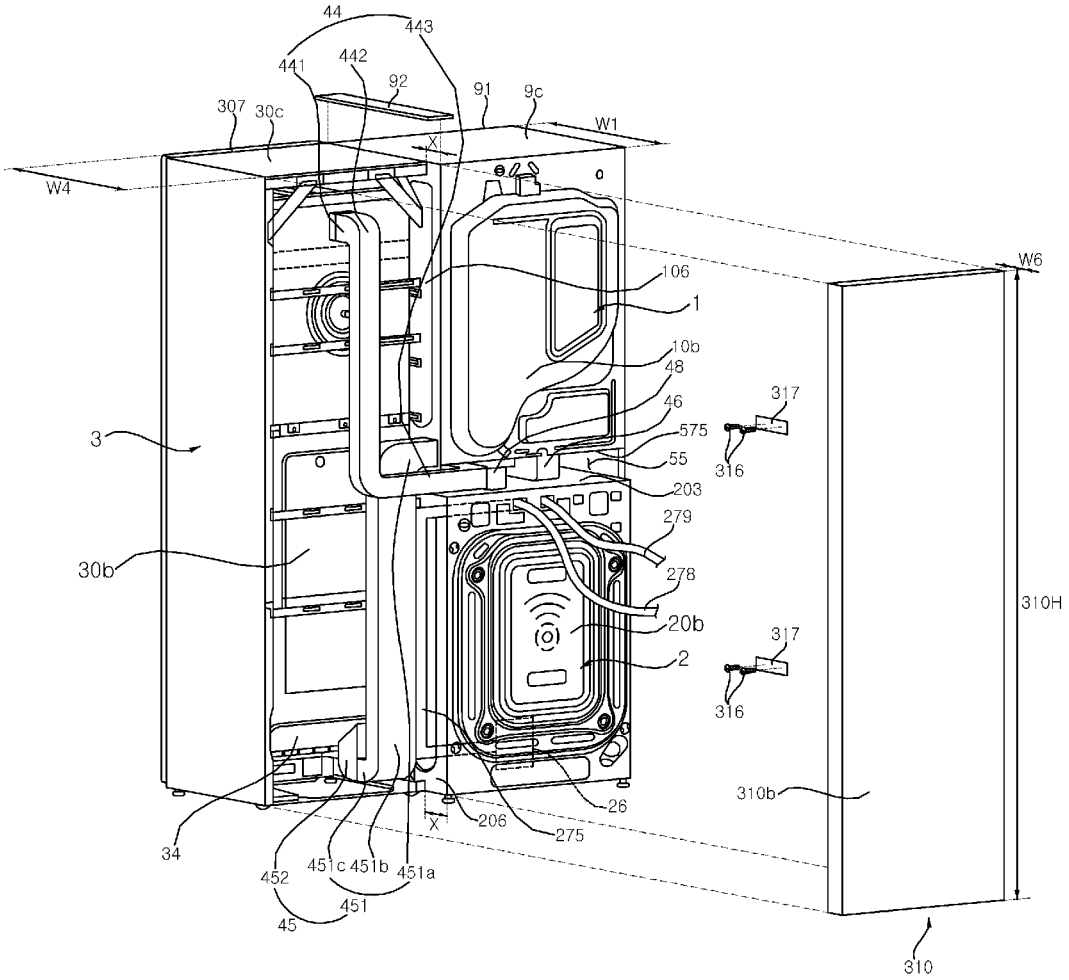

【FIG. 12】
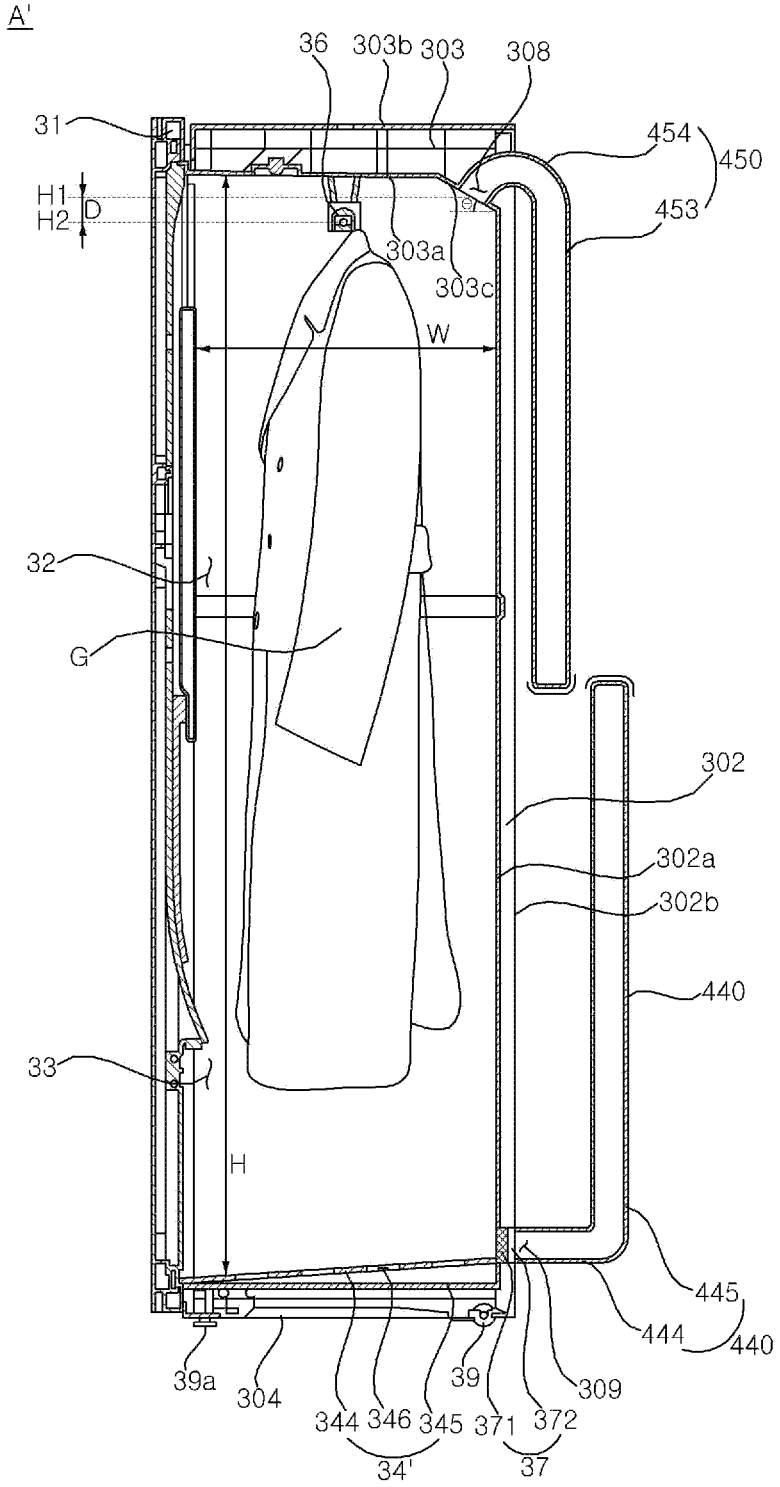

【FIG. 13】
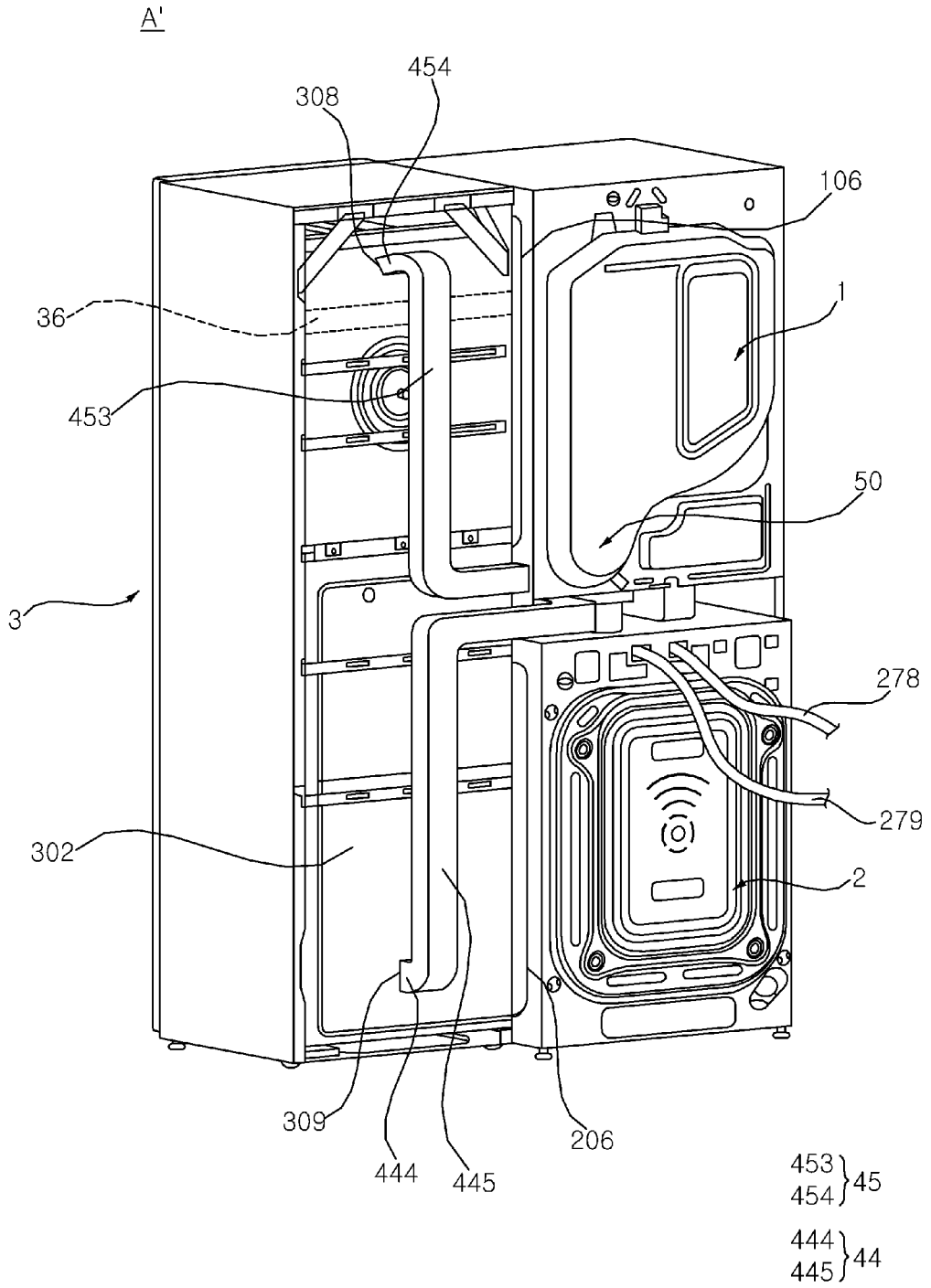

【FIG. 14】
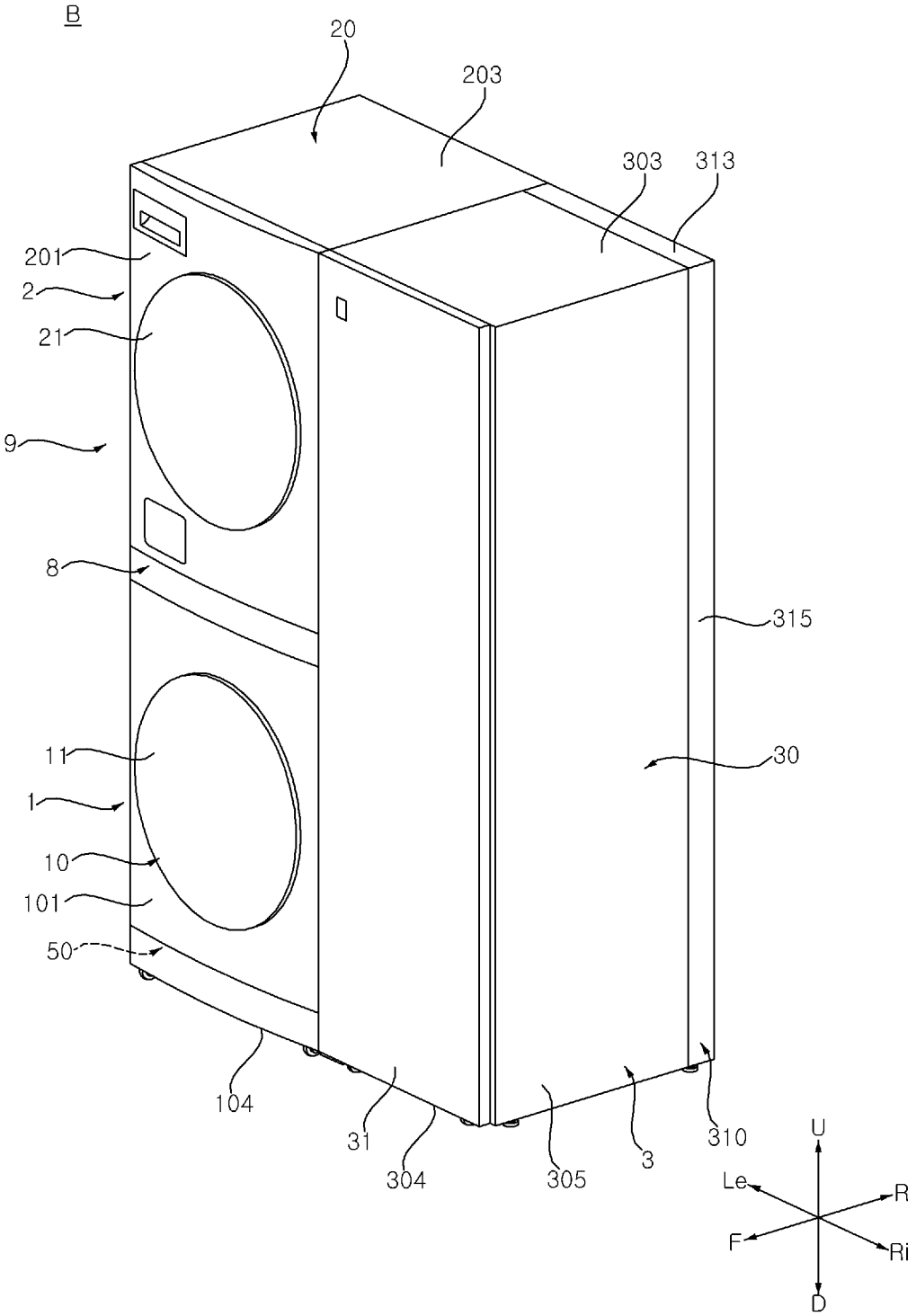

【FIG. 15】
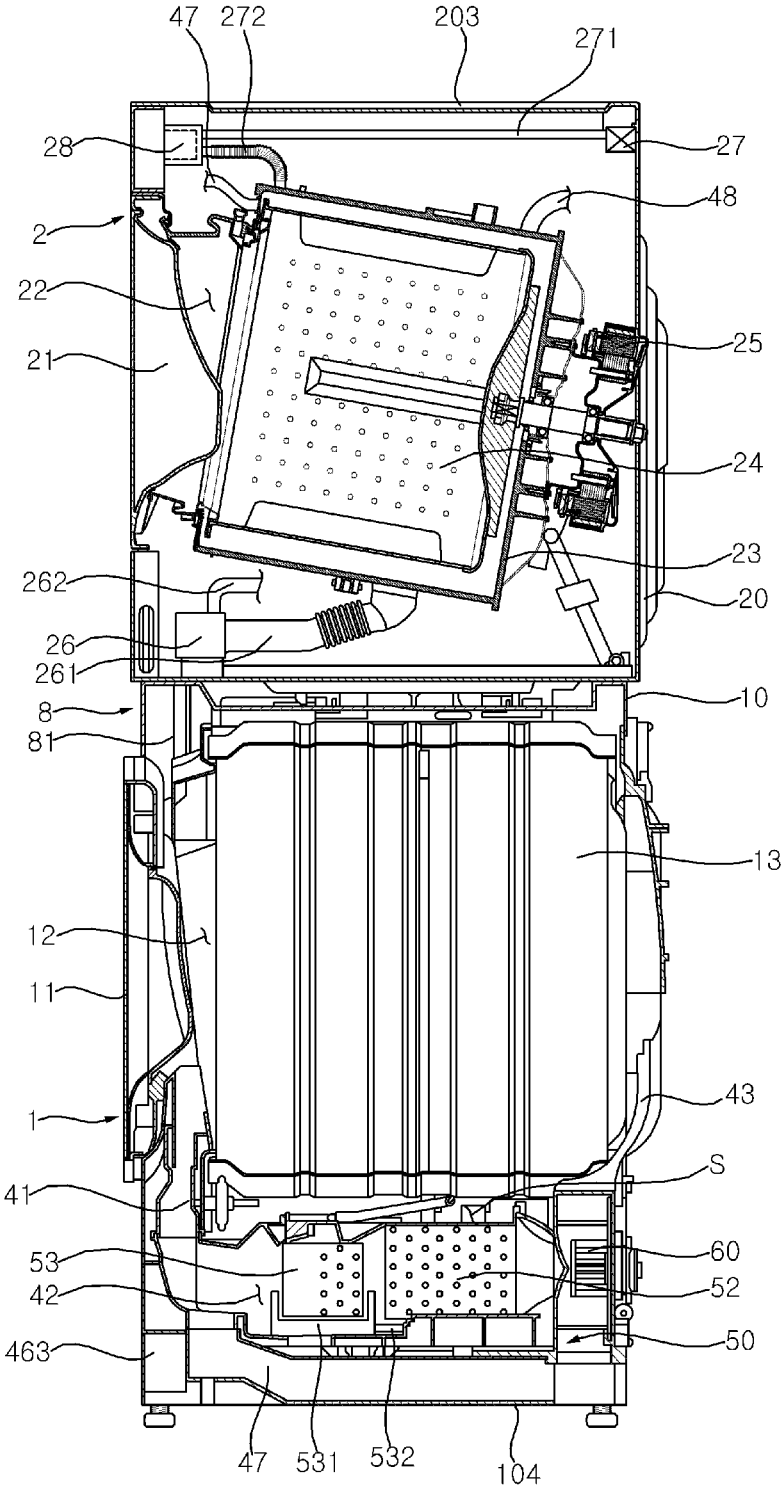

【FIG. 16】
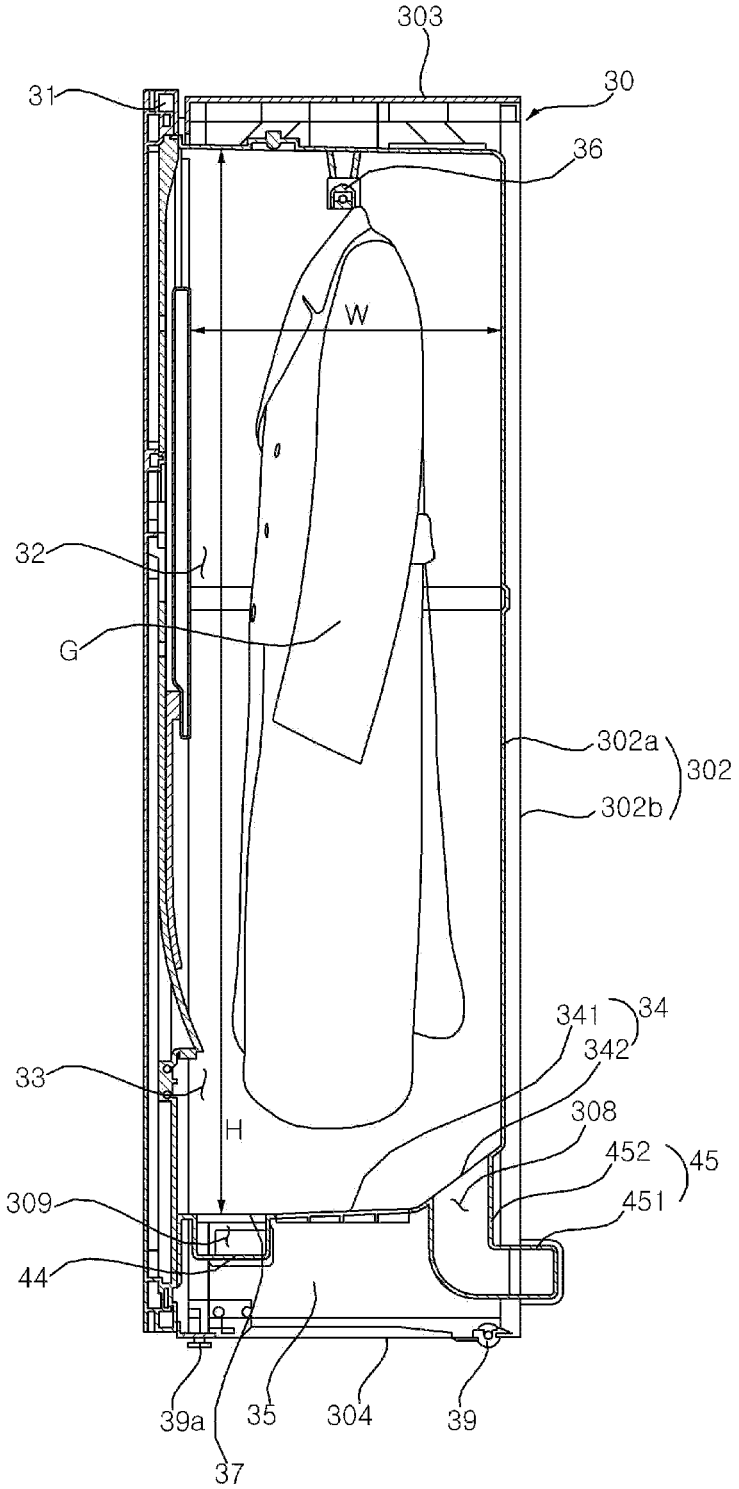

【FIG. 17】
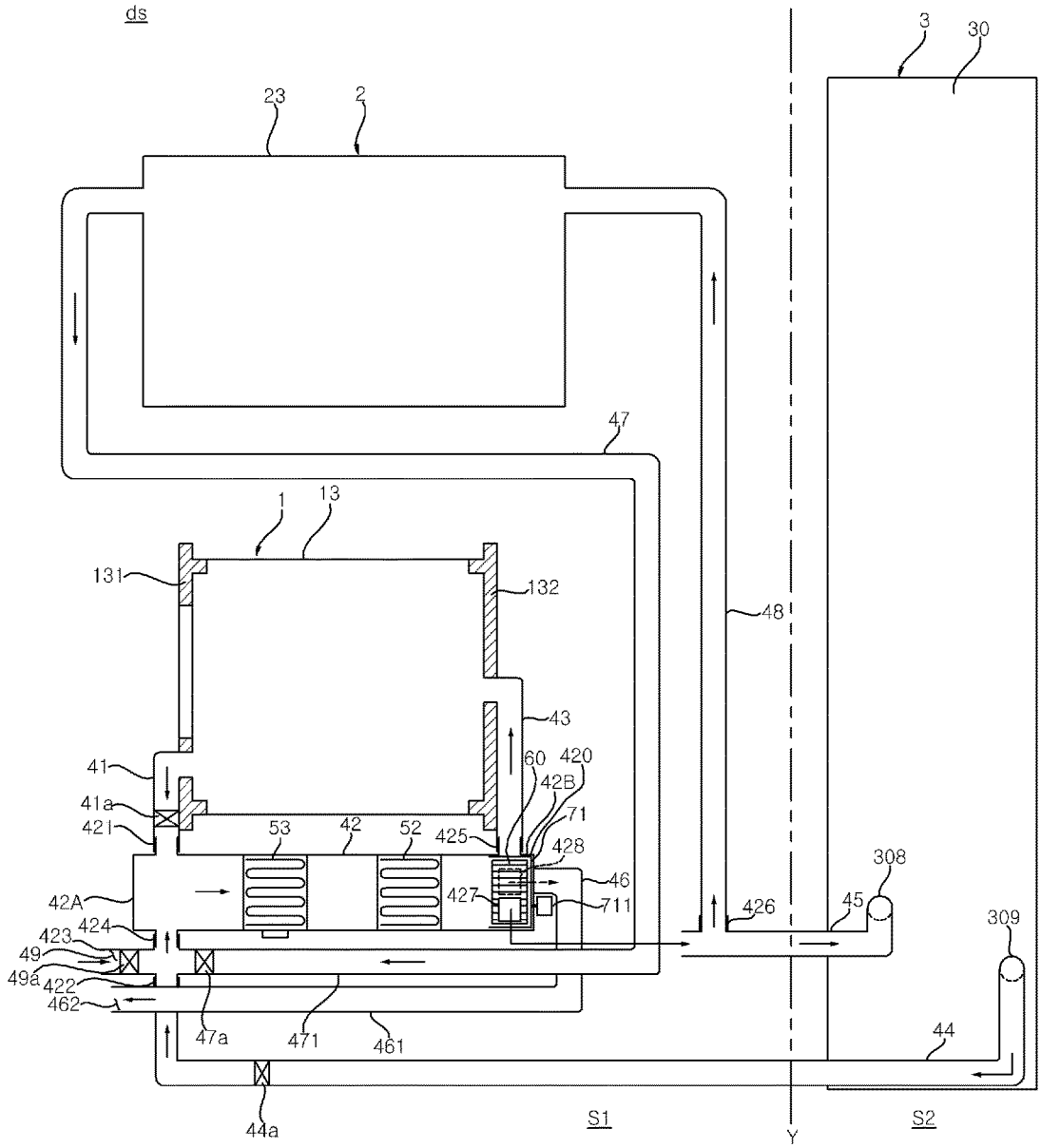

【FIG. 18】
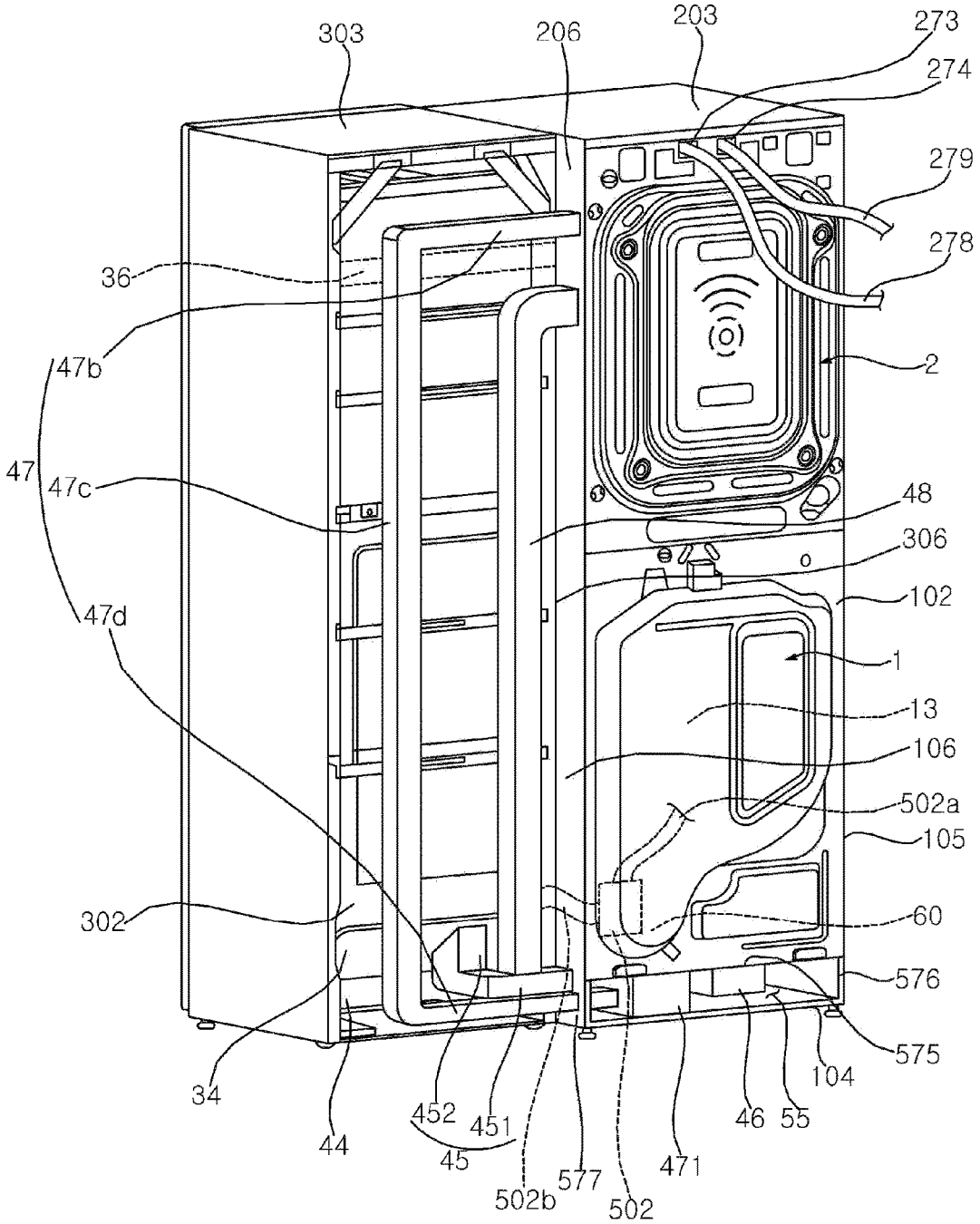

【FIG. 19】
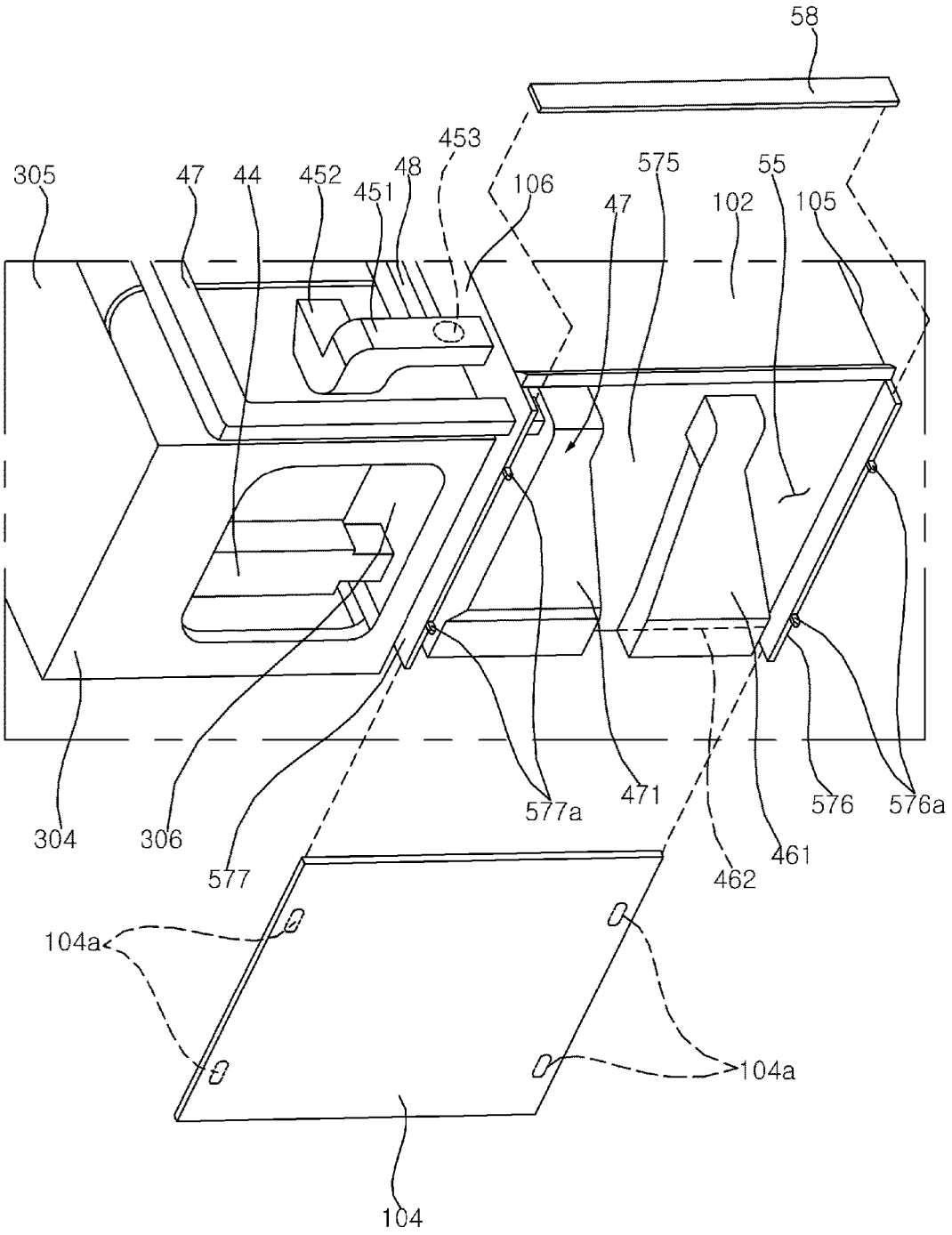

【FIG. 20】
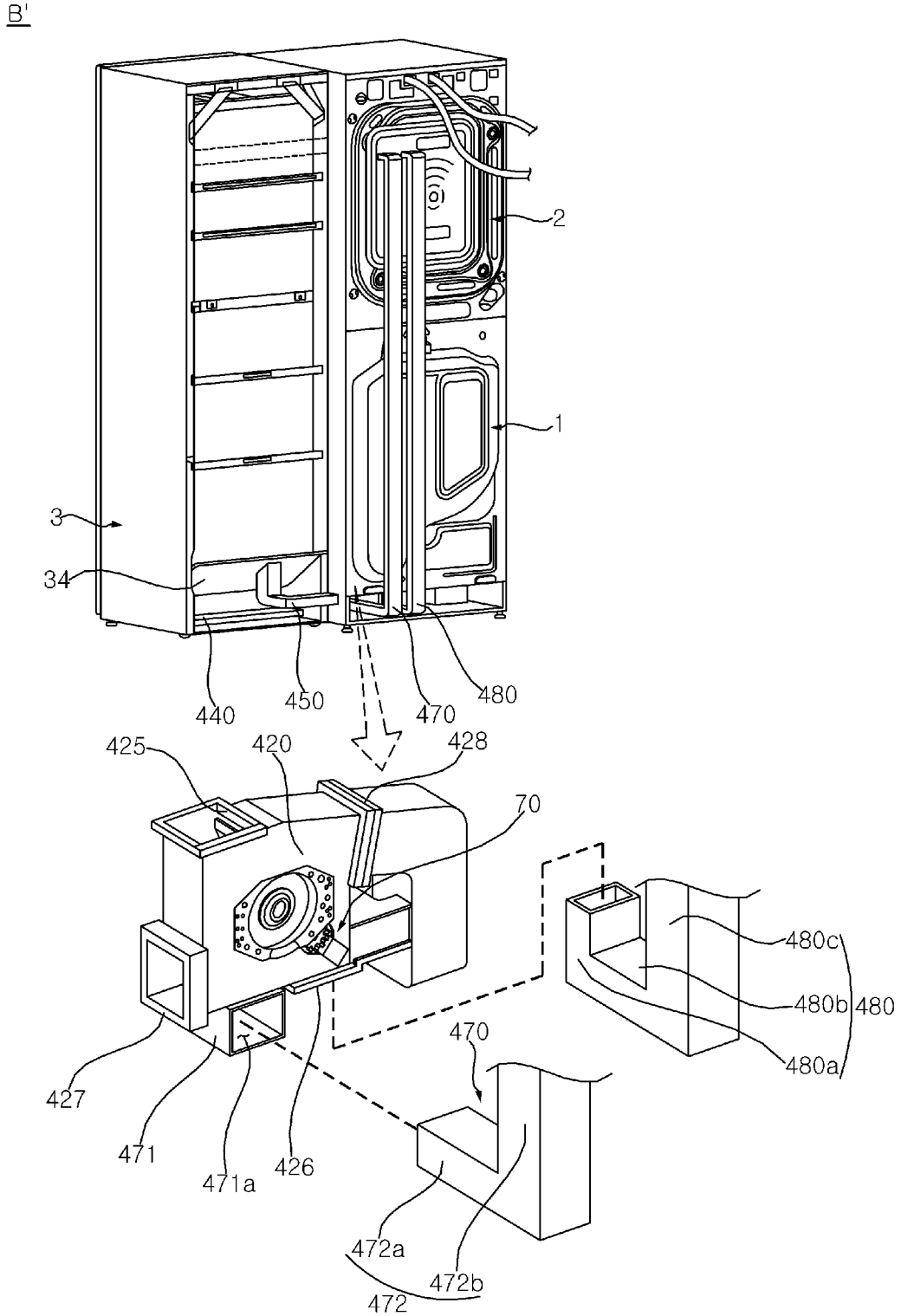

LAUNDRY TREATING APPARATUS

CROSS REFERENCE TO RELATED APPLICATIONS

This application claims the priority benefit of Korean Patent Application No. 10-2021-0069528, filed on May 28, 2021 in the Republic of Korea, Korean Patent Application No. 10-2021-0071149, filed on Jun. 1, 2021 in the Republic of Korea, Korean Patent Application No. 10-2021-0110914, filed on Aug. 23, 2021 in the Republic of Korea, Korean Patent Application No. 10-2021-0110915, filed on Aug. 23, 2021 in the Republic of Korea, Korean Patent Application No. 10-2021-0128828, filed on Sep. 29, 2021 in the Republic of Korea, and Korean Patent Application No. 10-2021-0128829, filed on Sep. 29, 2021 in the Republic of Korea, which are hereby incorporated by reference in their entirety for all purposes as if fully set forth herein.

BACKGROUND OF THE INVENTION

1. Field of the Invention

The present disclosure relates to a laundry treating apparatus, and more particularly to a laundry treating apparatus including a plurality of laundry treating machines.

2. Description of the Background Art

A washing machine, a dryer, and refreshers, which are provided for treating clothes, are installed in different spaces, such as a kitchen, a utility room, and an outdoor space, according to usage in a residential space.

Korean Laid-Open Patent Publication No. 10-2020-0109194 discloses a washing machine. The washing machine washes laundry by supplying water and detergent into a tub and a drum and by rotating the drum in which the laundry is placed. In the washing machine, water from an external water source is supplied into the tub or the drum, and a pump is used to circulate the water in the tub to the drum or to discharge the water in the tub to the outside. The washing machine is generally installed in the kitchen or the utility room for the supply and discharge of water.

The washing machine separately includes a heater for heating air, a blower fan, and a steam generator, to dry or sterilize the laundry.

Korean Patent No. 10-2120993 discloses a dryer. The dryer may dry the laundry, placed in the drum, by heating air using a heating means and a blower fan and by supplying the heated air into the drum. The dryer is generally disposed adjacent to the washing machine, so as to dry the washed laundry and to allow a user to easily load the laundry containing moisture into the dryer.

By using the steam generator for generating steam and spraying the steam into the drum, the dryer may sterilize the laundry or may remove wrinkles of the laundry. Water may be supplied into the dryer for generating the steam, and water not changed into steam may be reused or may be discharged to the outside. Further, in order to deodorize the dried laundry, the dryer may further have a deodorization function for filtering the circulated air.

Korean Patent No. 10-2254903 discloses a refresher. The refresher may perform functions, such as drying, deodorizing, de-wrinkling, de-static and/or sterilization (hereinafter referred to as "refreshing").

The refresher is used for treating clothes, such as suits and coats, which are frequently used by a user after washing.

Generally, the user hangs the clothes, such as suits and coats, in a wardrobe. Accordingly, the refresher may be installed adjacent to the wardrobe, or may be installed instead of the wardrobe, in a dressing room, a living room, or a bedroom. Further, not only for the clothes or garments, the refresher may be used for all washable items, such as shoes, socks, gloves, hats, scarves, etc., which are frequently worn by users, as well as dolls, towels, blankets, etc., which are frequently used by users.

However, the existing laundry treating machines, which are installed in different spaces, have a problem in that a user needs to move the laundry items, which are sorted by a user, to the respective laundry treating machines performing corresponding laundry treating processes, thereby requiring a longer workflow, and making the clothes treating processes uncomfortable.

In addition, as the refresher is installed in a different place from the washing machine and the dryer, it is cumbersome for the user to move the washed wet clothes or the dried clothes to the place where the refresher is installed.

Furthermore, each of the existing laundry treating machines for treating laundry using hot air and steam separately requires water supply equipment, drainage equipment, an air heater, a steam generator, a pump, a blower fan, an air passage, a steam passage, etc., thereby causing a problem in that a space for receiving clothes is reduced. In addition, as each of the machines includes the heater, the steam generator, etc., there is a problem in that costs and energy consumption of the entire system may increase.

Further, the existing refresher has a problem in that a machine room that generates hot air is disposed at a lower portion of the inner space of the refresher, such that the inner space of the refresher decreases in height. Thus, clothes having a great height, such as a long coat, may not be received in the existing refresher.

SUMMARY OF THE INVENTION

It is an object of the present disclosure to solve the above and other problems.

It is another object of the present disclosure to provide a laundry treating apparatus including a plurality of laundry treating machines.

It is yet another object of the present disclosure to provide a laundry treating apparatus including a washing machine, a dryer, and a refresher.

It is still another object of the present disclosure to provide a laundry treating apparatus capable of performing washing, drying, and refreshing of the laundry in the same space.

It is still another object of the present disclosure to provide a laundry treating apparatus capable of minimizing a user's workflow required for laundry treatment.

It is still another object of the present disclosure to provide a laundry treating apparatus capable of treating laundry which may not be subjected to high temperature drying in a space where washing and drying are performed.

It is still another object of the present disclosure to provide a laundry treating apparatus with improved workability in washing, drying, and refreshing processes of the laundry.

It is still another object of the present disclosure to provide a laundry treating apparatus with reduced vibrations generated in the entire system.

It is still another object of the present disclosure to provide a laundry treating apparatus capable of improving user convenience in manipulation by lowering the height of components, such as a door, a control panel, etc., which require manipulation by a user.

It is still another object of the present disclosure to provide a laundry treating apparatus having a hot air passage for supplying air to the washing machine, the dryer, and the refresher.

It is still another object of the present disclosure to provide a laundry treating apparatus capable of minimizing a length of a hot air passage for supplying air to the washing machine, the dryer, and the refresher.

It is still another object of the present disclosure to provide a refresher having an extended longitudinal width.

It is still another object of the present disclosure to provide a laundry treating apparatus having a refresher with an extended longitudinal width.

It is still another object of the present disclosure to provide a laundry treating apparatus having an extended vertical height of a laundry receiving space.

It is still another object of the present disclosure to provide a laundry treating apparatus having an extended vertical height of a laundry receiving space.

It is still another object of the present disclosure to provide a laundry treating apparatus having an extended vertical height of a laundry receiving space in the refresher.

It is still another object of the present disclosure to provide a laundry treating apparatus using a difference between a longitudinal width of the refresher and a longitudinal width of the washing machine/dryer.

It is still another object of the present disclosure to provide a laundry treating apparatus having a steam passage for supplying steam to the washing machine, the dryer, and the refresher.

It is still another object of the present disclosure to provide a laundry treating apparatus capable of minimizing a steam passage for supplying steam to the washing machine, the dryer, and the refresher.

It is still another object of the present disclosure to provide a laundry treating apparatus capable of supplying hot air to the plurality of laundry treating machines using a single heating device.

It is still another object of the present disclosure to provide a laundry treating apparatus capable of supplying steam to the plurality of laundry treating machines using a single heating device.

It is still another object of the present disclosure to provide a laundry treating apparatus capable of facilitating discharge of condensate generated by the heating device.

It is still another object of the present disclosure to provide a laundry treating apparatus capable of facilitating the supply of water for steam generation and discharge of the water.

It is still another object of the present disclosure to provide a laundry treating apparatus capable of minimizing a length of a hot air passage for supplying air to the dryer and the refresher.

It is still another object of the present disclosure to provide a laundry treating apparatus capable of optimizing the placement of a fan for supplying hot air to the dryer and the refresher.

It is still another object of the present disclosure to provide a laundry treating apparatus capable of minimizing heat loss of hot air supplied to the refresher.

It is still another object of the present disclosure to provide a laundry treating apparatus capable of minimizing a length of a supply air duct and an exhaust air duct which are connected to the refresher.

It is still another object of the present disclosure to provide a laundry treating apparatus capable of discharging condensate generated by the heating device, without using separate pump equipment.

It is still another object of the present disclosure to provide a laundry treating apparatus capable of managing condensate by using a drain pump of the washing machine.

It is still another object of the present disclosure to provide a laundry treating apparatus in which temperature of hot air supplied to the refresher is lower than that of the dryer.

It is still another object of the present disclosure to provide a laundry treating apparatus capable of using the condensate generated by the heating device.

It is still another object of the present disclosure to provide a laundry treating apparatus capable of minimizing vibrations generated in the washing machine.

It is still another object of the present disclosure to provide a laundry treating apparatus capable of reducing rocking of cabinets of the washing machine.

It is still another object of the present disclosure to provide a laundry treating apparatus in which the plurality of laundry treating machines are coupled to each other.

It is still another object of the present disclosure to provide a laundry treating apparatus capable of supplying hot air to an upper side of the refresher.

It is still another object of the present disclosure to provide a laundry treating apparatus capable of recovering hot air from the upper side of the refresher.

It is still another object of the present disclosure to provide a laundry treating apparatus capable of lowering the height of doors of the washing machine and the dryer.

It is still another object of the present disclosure to provide a laundry treating apparatus capable of lowering the height of a laundry loading opening, through which the laundry is loaded, and the height of a control panel.

It is still another object of the present disclosure to provide a laundry treating apparatus capable of allowing users to easily carry the washed laundry.

It is still another object of the present disclosure to provide a laundry treating apparatus capable of preventing air, heated and dehumidified by the heating device, from being directly discharged to users.

It is still another object of the present disclosure to provide a laundry treating apparatus having a passage formed at a high position for indoor dehumidification.

It is still another object of the present disclosure to provide a laundry treating apparatus having an aligned upper end.

It is still another object of the present disclosure to provide a laundry treating apparatus having an aligned front surface.

It is still another object of the present disclosure to provide a laundry treating apparatus having a height which is constant in the horizontal direction.

It is still another object of the present disclosure to provide a laundry treating apparatus having a constant longitudinal width.

It is still another object of the present disclosure to provide a laundry treating apparatus capable of preventing collision of the laundry treating apparatus with surrounding structures when the laundry treating apparatus is installed.

The objects of the present disclosure are not limited to the aforementioned objects and other objects not described herein will be clearly understood by those skilled in the art from the following description.

In accordance with an aspect of the present disclosure, the above and other objects can be accomplished by providing a laundry treating apparatus including a dryer including a first cabinet having a first laundry loading opening.

The dryer may have a first door for opening and closing the first laundry loading opening.

The dryer may include a first drum rotatably disposed in the first cabinet.

The laundry treating apparatus may include a washing machine including a second cabinet vertically disposed with respect to the first cabinet.

The second cabinet may include a second laundry loading opening.

The washing machine may include a second door for opening and closing the second laundry loading opening.

The washing machine may include a tub disposed in the second cabinet.

The washing machine may include a second drum rotatably disposed in the tub.

The laundry treating apparatus may include a refresher disposed on one side of the dryer.

The refresher may be disposed on one side of the washing machine.

The refresher may include a third cabinet having an opening.

The refresher may include a third door for opening and closing the opening.

A space for receiving laundry may be formed in the refresher.

The laundry treating apparatus may include a duct system connected to the dryer and the refresher.

The duct system may include a first supply air duct for supplying air into the first drum.

The duct system may include a second supply air duct for supplying air into an inner space of the refresher.

The duct system may include a heat exchange channel connected to the first supply air duct and the second supply air duct.

The laundry treating apparatus may include a heating device for heating air passing through the heat exchange channel.

The laundry treating apparatus may include a first laundry treating machine including a cabinet having a laundry loading opening, and a door for opening and closing the laundry treating opening.

The first laundry treating machine may include a drum rotatably disposed in the cabinet.

The laundry treating apparatus may include a second laundry treating machine including a cabinet having a laundry loading opening, and a door for opening and closing the laundry treating opening.

A space for receiving laundry may be formed in the second laundry treating machine.

The duct system may include a first supply air duct for supplying air into the drum of the first laundry treating machine.

The duct system may include a second supply air duct for supplying air into the inner space of the second laundry treating machine.

The duct system may include a heat exchange channel connected to the first supply air duct and the second supply air duct.

The heat exchange channel may include an inlet end through which air is introduced, and a discharge end through which the air is discharged.

The laundry treating apparatus may include an integrated frame, having a first laundry loading opening and a second laundry loading opening which are vertically spaced apart from each other, and having a horizontal partition wall disposed at a middle portion thereof.

A drying room may be formed between an upper panel and the horizontal partition wall of the integrated frame.

The first drum may be disposed in the drying room.

A washing room may be formed between a lower panel and the horizontal partition wall of the integrated frame.

The tub and the second drum may be disposed in the washing room.

The laundry treating apparatus may include a side frame disposed on one side of the integrated frame.

The second supply air duct may supply air into the side frame.

The laundry treating apparatus may include a single frame in which a vertical partition wall is disposed.

The horizontal partition wall may be disposed between the vertical partition wall and the one side panel of the single frame.

The washing room and the drying room may be vertically separated by the horizontal partition wall between the one side panel and the vertical partition wall.

A refreshing room for treating clothes may be formed between the vertical partition wall and the other panel of the single frame.

The dryer may be disposed on one side of the washing machine in a direction horizontal to the washing machine.

The refresher may be disposed over the dryer and the washing machine.

The laundry treating apparatus may include a supply air duct connecting the heating device and the refresher.

The supply air duct may supply the air, heated by the heating device, into the inner space of the refresher.

The heating device may be disposed under the first drum.

The washing machine may be disposed over the dryer.

The heating device may be disposed between the first drum and the tub.

The heating device may include a heat exchange unit for heating air supplied to the refresher.

The supply air duct may extend downwardly from the heating device.

The supply airduct may be connected to a supply air hole formed at a lower portion of the refresher.

The laundry treating apparatus may include an exhaust air duct extending upwardly form the heating device.

The exhaust air duct may be connected to an exhaust air hole formed at an upper portion of the refresher.

The supply air duct may extend upwardly from the heating device.

The supply air duct may be connected to a supply air hole formed at an upper portion of the refresher.

The laundry treating apparatus may include an exhaust air duct extending downwardly from the heating device.

The exhaust air duct may be connected to an exhaust air hole formed at a lower portion of the refresher.

The dryer may be disposed over the washing machine.

The washing may include a drain pump for discharging water in the tub.

The heating device may be disposed under the tub.

The laundry treating apparatus may include a drain pan disposed under the heat exchange unit.

The washing machine may include an upper panel coupled to a lower portion of the dryer.

The washing machine may include a suspension connecting the cabinet and the tub of the washing machine.

The cabinet of the washing machine may include a side panel disposed between the tub and the cabinet of the refresher.

The side panel may face the cabinet of the refresher.

The side panel may be coupled to the cabinet of the refresher.

The second drum may be open toward the second laundry loading opening, so that laundry placed therein may be unloaded through the second laundry loading opening.

The first drum may be disposed under the second drum.

The first drum may be open toward the first laundry loading opening, so that the laundry unloaded from the second drum, may be loaded through the first laundry loading opening.

The laundry treating apparatus may include a dehumidification duct for discharging the air, heated by the heating device, outside of the laundry treating apparatus.

An upper end of a front surface of the laundry treating apparatus may be aligned horizontally.

An upper end of a front surface of any one, which is located uppermost, among the dryer, the washing machine, and the heating device, may be aligned with an upper end of a front surface of the refresher.

Other detailed matters of the exemplary embodiments are included in the detailed description and the drawings.

Effects of the Invention

According to at least one of the embodiments of the present disclosure, there is provided a laundry treating apparatus including a plurality of laundry treating machines.

According to at least one of the embodiments of the present disclosure, there is provided a laundry treating apparatus including a washing machine, a dryer, and a refresher.

According to at least one of the embodiments of the present disclosure, there is provided a laundry treating apparatus, in which the washing machine, the dryer, and the refresher are disposed in the same space, thereby performing washing, drying, and refreshing in the same space.

According to at least one of the embodiments of the present disclosure, there is provided a laundry treating apparatus, in which laundry may be treated in the same space regardless of the type of laundry.

According to at least one of the embodiments of the present disclosure, there is provided a laundry treating apparatus, in which when washing, drying, and refreshing are performed, a user's load (e.g., amount of work, workflow, etc.) for moving the laundry may be reduced.

According to at least one of the embodiments of the present disclosure, there is provided a laundry treating apparatus capable of treating laundry, which may not be subjected to high temperature drying, in the same space where washing and drying are performed.

According to at least one of the embodiments of the present disclosure, there is provided a laundry treating apparatus, in which the washing machine and the refresher share one surface, thereby reducing vibrations generated in the washing machine.

According to at least one of the embodiments of the present disclosure, there is provided a laundry treating apparatus, in which the heating device of the refresher is disposed between the washing machine and the dryer, thereby extending the height of a laundry receiving space in the refresher.

According to at least one of the embodiments of the present disclosure, a hot air passage is provided in a rear space of the refresher, such that the entire system may have a uniform longitudinal width.

According to at least one of the embodiments of the present disclosure, the heating device is disposed at a middle height of the refresher, thereby minimizing the length of a hot air supply passage for supplying hot air to each of the washing machine, the dryer, and the refresher.

According to at least one of the embodiments of the present disclosure, a steam generator is disposed at a middle height of the refresher, thereby minimizing the length of a steam supply passage for supplying steam to each of the washing machine, the dryer, and the refresher.

According to at least one of the embodiments of the present disclosure, hot air may be supplied to each of the washing machine, the dryer, and the refresher by using a single heating device.

According to at least one of the embodiments of the present disclosure, steam may be supplied to each of the washing machine, the dryer, and the refresher by using a single steam generator.

According to at least one of the embodiments of the present disclosure, condensate may be managed easily by discharging condensate, generated in an evaporator, through a drain pump of the washing machine.

According to at least one of the embodiments of the present disclosure, steam may be generated easily by supplying water, required for generating steam, through a water supply pipe of the washing machine.

According to at least one of the embodiments of the present disclosure, the heating device for supplying hot air to the refresher may be disposed on a lateral side, thereby increasing the height of an inner space of the refresher.

According to at least one of the embodiments of the present disclosure, hot air may be supplied to the refresher by using the heating device of the dryer, thereby increasing a volume of the inner space of the refresher.

According to at least one of the embodiments of the present disclosure, the heating device is disposed at a lower side of the laundry treating apparatus, thereby minimizing the length of the hot air passage connected to the dryer and the refresher.

According to at least one of the embodiments of the present disclosure, a supply air duct, connecting the heating device and the refresher, is reduced in length, thereby minimizing heat loss of the hot air supplied to the refresher.

According to at least one of the embodiments of the present disclosure, condensate generated in the evaporator may be discharged through the drain pump of the washing machine, thereby allowing easy management of the condensate.

According to at least one of the embodiments of the present disclosure, water in a tub and the condensate generated in the heating device are discharged through a single drain pump, thereby reducing the number of components required for drainage.

According to at least one of the embodiments of the present disclosure, a cabinet of the washing machine is coupled to a cabinet of the refresher, thereby reducing vibrations generated in the washing machine.

According to at least one of the embodiments of the present disclosure, as the washing machine is disposed over the dryer, heavy laundry after washing may be dropped to a laundry loading opening of the dryer, thereby allowing a user to easily move the laundry.

According to at least one of the embodiments of the present disclosure, an upper end of the laundry treating apparatus is aligned, such that the plurality of laundry treating machines may be easily coupled to each other.

Further scope of applicability of the invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention.

FIG. 1 is a perspective view of a laundry treating apparatus according to at least one embodiment of the present disclosure.

FIG. 2 is a longitudinal cross-sectional view of a laundry treating apparatus according to at least one embodiment of the present disclosure.

FIG. 3 is a longitudinal cross-sectional view of a laundry treating apparatus according to at least one embodiment of the present disclosure.

FIG. 4 is a conceptual diagram illustrating a duct system of a laundry treating apparatus according to at least one embodiment of the present disclosure.

FIG. 5 is a perspective view of a heating device according to at least one embodiment of the present disclosure.

FIG. 6 is another perspective view of a heating device according to at least one embodiment of the present disclosure.

FIG. 7 is yet another perspective view of a heating device according to at least one embodiment of the present disclosure.

FIG. 8 is a diagram explaining an operation of a heating device according to at least one embodiment of the present disclosure.

FIG. 9 is a diagram illustrating a portion of a rear surface of a laundry treating apparatus according to at least one embodiment of the present disclosure.

FIG. 10 is a diagram illustrating assembly of a laundry treating apparatus according to at least one embodiment of the present disclosure.

FIG. 11 is a rear perspective view of a laundry treating apparatus according to at least one embodiment of the present disclosure.

FIG. 12 is a longitudinal cross-sectional view of a laundry treating apparatus according to at least one embodiment of the present disclosure.

FIG. 13 is a rear perspective view of a laundry treating apparatus according to at least one embodiment of the present disclosure.

FIG. 14 is a perspective view of a laundry treating apparatus according to at least one embodiment of the present disclosure.

FIG. 15 is a longitudinal cross-sectional view of a laundry treating apparatus according to at least one embodiment of the present disclosure.

FIG. 16 is a longitudinal cross-sectional view of a laundry treating apparatus according to at least one embodiment of the present disclosure.

FIG. 17 is conceptual diagram illustrating a duct system of a laundry treating apparatus according to at least one embodiment of the present disclosure.

FIG. 18 is a rear perspective view of a laundry treating apparatus according to at least one embodiment of the present disclosure.

FIG. 19 is a view illustrating a lower structure of a laundry treating apparatus according to at least one embodiment of the present disclosure.

FIG. 20 is a rear perspective view of a laundry treating apparatus according to at least one embodiment of the present disclosure.

DETAILED DESCRIPTION OF THE PREFERRED EMBODIMENTS

Hereinafter, the present disclosure will be described in detail with reference to the accompanying drawings, in which the same reference numerals are used throughout the drawings to designate the same or similar components, and a redundant description thereof will be omitted.

Terms "module" and "unit" for elements used in the following description are given simply in view of the ease of the description, and do not have a distinguishing meaning or role.

It will be noted that a detailed description of known arts will be omitted if it is determined that the detailed description of the known arts can obscure the embodiments of the invention. Further, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that, although the terms first, second, etc., may be used herein to describe various elements, these elements should not be limited by these terms. These terms are only used to distinguish one element from another.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

As used herein, the singular forms are intended to include the plural forms as well, unless the context clearly indicates otherwise.

The laundry treating apparatus according to the embodiments of the present disclosure may include one or more laundry treating machines. The laundry treating machines refer to devices for washing, drying, and/or refreshing objects (e.g., clothes, towels, blankets, etc.).

The laundry treating apparatus may include a plurality of laundry treating machines of the same type. For example, the laundry treating apparatus may include two or more dryers 1. For example, the laundry treating apparatus may include two or more washing machines 2. For example, the laundry treating apparatus may include two or more refreshers 3.

The laundry treating apparatus may include different types of laundry treating machines. For example, the laundry treating apparatus may include the dryer 1, the washing machine 2, and the refresher 3.

The laundry treating apparatus may include laundry treating machines of the same type and laundry treating machines of types different from the type. For example, the laundry treating apparatus may include two or more washing machines, one dryer, and one refresher. For example, the laundry treating apparatus may include one washing machine, one dryer, and two or more refreshers.

The laundry treating apparatus of the present disclosure is not limited to the type and number of the laundry treating machines, and may include various combinations thereof. Hereinafter, the laundry treating apparatus including one dryer 1, one washing machine 2, and one refresher 3 will be described as an example, but the present disclosure is not limited thereto.

The dryer 1, the washing machine 2, and the refresher 3 may be referred to as any one of first to third laundry treating machines, respectively. For example, the dryer 1 may be referred to as the "first laundry treating machine," the washing machine 2 may be referred to as the "second laundry treating machine," and the refresher 3 may be referred to as the "third laundry treating machine."

Hereinafter, it will be understood that, although the terms first, second, third, etc., may be used herein to describe various elements, these elements should not be limited by these terms. These terms are only used to distinguish one element from another. These elements are not limited to the terms and may include other ordinal numbers. The elements may be used independently without including the ordinal numbers. For example, the elements of the dryer 1 may include the ordinal number "first," the elements of the washing machine 2 may include the ordinal number "second," and the elements of the refresher 3 may include the ordinal number "third." However, the elements of the dryer 1, the washing machine 2, and the refresher 3 are not limited to these terms, and may include other ordinal numbers or may be used independently without including the ordinal numbers.

A laundry treating apparatus may include a controller 81 for controlling operation of a dryer 1, a washing machine 2, a refresher 3, and a heating device 50. The controller 81 may be mounted in a Printed Circuit Board (PCB). The controller 81 may control the dryer 1, the washing machine 2, the refresher 3, and the heating device 50 based on an electric signal received from the control panel 8. The controller 81 may communicate with the control panel 8.

The dryer 1 and the washing machine 2 may be vertically disposed. The control panel 8 may be disposed between the dryer 1 and the washing machine 2. The control panel 8 and the refresher 3 may be vertically disposed.

A user may input a command to the laundry treating apparatus through the control panel 8. By manipulating the control panel 8, the user may control the operation of the dryer 1, the washing machine 2, and the refresher 3. By manipulating the control panel 8, the user may control the operation of the heating device 50. The control panel 8 may transmit an electrical signal, input by the user's manipulation, to the controller 81.

A space for providing the PCB may be formed in the control panel 8. A controller may be mounted in the PCB. The controller may be the controller 81.

Alternatively, the controller may be disposed on a rear surface of the control panel 8. The space for providing the PCB may be formed on the rear surface of the control panel 8. The controller 81 may be mounted in the PCB.

Alternatively, at least some of the dryer 1, the washing machine 2, the refresher 3, and a machine room S may include respective controllers for controlling each operation thereof. Even in this case, the respective controllers may be mounted in the PCB. The respective controllers may communicate with each other. In some cases, at least one controller may be an upper level controller that may control other controllers and devices.

The control panel 8 may display an operating state of the laundry treating apparatus. The user may check information on the operating state of the laundry treating apparatus through the control panel 8.

The laundry treating apparatus may include a heating device 50. The heating device 50 may supply hot air to the dryer 1. The heating device 50 may supply hot air to the refresher 3. The heating device 50 may supply hot air to the washing machine 2. The hot air, supplied to the respective laundry treating machines, may be drawn into the heating device 50 again for circulation.

However, without circulating the hot air supplied to each of the dryer 1, the washing machine 2, and the refresher 3, the laundry treating apparatus may discharge the hot air to the outside. That is, the laundry treating apparatus may discharge the hot air supplied to a tub 23 of the washing machine 2 to the outside of the washing machine 2, may discharge the hot air supplied to a first drum 13 of the dryer 1 to the outside of the dryer 1, and may discharge the hot air supplied to an inner space 33 of the refresher 3 to the outside of the refresher 3.

The laundry treating apparatus may include the machine room S (see FIG. 2). The machine room S may provide a space in which the heating device 50 is disposed. The machine room S may be a concept that refers to a space in which the heating device 50 and components other than the heating device 50 are disposed. In addition to the heating device 50, a pump, a blower fan, an air passage, a steam device, a stream passage, a dehumidification device, a controller, a motor, a fan housing, and the like may be disposed in the machine room S. The machine room S may provide the space in which the aforementioned movable elements (a pump, a blower fan, an air passage, a steam device, a stream passage, a dehumidification device, a controller, a motor, and a fan housing) are disposed.

In the present disclosure, the machine room S may refer to the space in which the heating device 50 is disposed, or may be an upper concept that encompasses the heating device 50.

The machine room S may include a separate case. When the machine room S includes the separate case, the machine room S may be separated from a first cabinet 10 and a second cabinet 20. Unlike the example, the machine room S may be disposed in any one of first to third cabinets 10, 20, and 30. In the case where the machine room S is disposed in any one of the first to third cabinets 10, 20, and 30, the machine room S may be a concept that refers to a space in which various components including the heating device 50 are disposed. That is, in the case where the machine room S is disposed in any one of the first to third cabinets 10, 20, and 30, the machine room S may refer to a portion of the inner space of the first to third cabinets 10, 20, and 30.

The machine room S, the dryer 1, and the washing machine 2 may be vertically disposed. The machine room S may be disposed on an upper side of the dryer 1 and the washing machine 2. The machine room S may be disposed between the dryer 1 and the washing machine 2. The machine room S may be disposed on a lower side of the dryer 1 and the washing machine 2. Unlike the example, the machine room S and the refresher 3 may be vertically disposed. The machine room S may be disposed on the upper side or the lower side of the refresher 3.

The heating device 50 may supply hot air to the dryer 1. The heating device 50 may recover the hot air supplied to the dryer 1.

The heating device 50 may supply hot air to the washing machine 2. The heating device 50 may recover the hot air supplied to the washing machine 2.

The heating device 50 may supply hot air to the refresher 3. The heating device 50 may recover the hot air supplied to the refresher 3.

The heating device 50 may supply steam to the dryer 1. The heating device 50 may supply steam to the washing machine 2. The heating device 50 may supply steam to the refresher 3.

The heating device 50 may include a heat pump device. The heat pump device may include a compressor 51, a condenser 52, an evaporator 53, and an expansion device 54 (see FIG. 5). The heating device 50 may include a fan 60 (see FIG. 5). The heat pump device may be referred to as a "heat exchange unit."

The heating device 50 may include a heat exchange unit for heating air flowing through a heat exchange channel 42 (see FIG. 5). The heat exchange unit may be a heat pump device connected by a refrigerant passage. The heat exchange unit may be a heater using electricity as power. The heat exchange unit may be a heating device. The heat exchange unit may include the heater and a cooler. The cooler may be disposed on an upstream side of the heater. The cooler may be disposed in the heat exchange channel 42. The cooler may dehumidify and cool air passing through the heat exchange channel 42.

The heating device 50, the dryer 1, and the washing machine 2 may be vertically disposed. The heating device 50 may be disposed on the upper side of the dryer 1 and the washing machine 2, may be disposed between the dryer 1 and the washing machine 2, or may be disposed under the dryer 1 and the washing machine 2.

The heating device 50 and the refresher 3 may be vertically disposed. The heating device 50 may be disposed in a rear space of the refresher 3.

The heating device 50 may be disposed in the first cabinet 10. The heating device 50 may also be disposed in the second cabinet 20. The heating device 50 may also be disposed in the third cabinet 30.

The dryer 1, the washing machine 2, and the heating device 50 (or the machine room S) may be vertically arranged, and the refresher 3 may be disposed on a lateral side of the washing machine 2. The heating device 50 may be disposed on a lateral side of the refresher 3.

Hereinafter, a laundry treating apparatus A according to an aspect of the present disclosure will be described below with reference to FIG. 1.

The laundry treating apparatus A illustrated in FIG. 1 may be an example in which the dryer 1 is disposed over the washing machine 2 and the heating device 50 is disposed between the washing machine 2 and the dryer 1. However, a vertical arrangement of the dryer 1, the washing machine 2, and the heating device 50 is not limited thereto.

The refresher 3 may be disposed on a lateral side of the dryer 1 and the washing machine 2. For example, the refresher 3 may be disposed on the right side of the dryer 1 and the washing machine 2. However, an arrangement position of the refresher 3 is not limited to the above example, and the refresher 3 may be disposed on the right side of the dryer 1 and the washing machine 2.

A longitudinal width of the refresher 3 may be smaller than a front-rear width of the dryer 1 and the washing machine 2.

A rear case 310, in which the hot air passage or the steam passage which will be described later is disposed, may be disposed behind the refresher 3.

The dryer 1 may include the first cabinet 10 having a first laundry loading opening 12 (see FIG. 2) formed on a front surface thereof, and a first door 11 rotatably coupled to the first cabinet 10.

By rotating the first door 1, a user may open the first laundry inlet 12, and may put the laundry into the first drum 13 through the first laundry inlet 12.

The washing machine 2 may include a second cabinet 20 having a second laundry loading opening 22 (see FIG. 2) formed on a front surface, and a second door 21 rotatably coupled to the second cabinet 20.

By rotating the second door 21, the user may open the second laundry loading opening 22, and may load the laundry into the second drum 24 through the second laundry loading opening 22.

The refresher 3 forms a space in which the laundry is received, and includes a third cabinet 30 having a third laundry loading opening 32 (see FIG. 3) and a third door 31 rotatably coupled to the cabinet 30. The third laundry loading opening 32 may be referred to as an "opening."

By rotating the third door 31, the user may open the third laundry loading opening 32 and may load the laundry into the third cabinet 30 through the third laundry loading opening 32.

Each of the first cabinet 10, the second cabinet 20, and the third cabinet 30 may include an upper panel, a lower panel, a front panel, a rear panel, and a side panel. The upper panel may be referred to as an "upper wall." The lower panel may be referred to as a "lower wall." The front panel may be referred to as a "front wall." The rear panel may be referred to as a "rear wall." The side panel may be referred to as a "side wall."

Each of the first cabinet 10, the second cabinet 20, and the third cabinet 30 may include a pair of side panels. The pair of side panels may be horizontally spaced apart from each other. The side panels may be referred to as "side walls." The first cabinet 10 may include a first inner wall 106 facing the refresher 3, and a first outer wall 105 spaced apart from the first inner wall 106. The second cabinet 20 may include a second inner wall 206 facing the refresher 3, and a second outer wall 205 spaced apart from the second inner wall 206. The third cabinet 30 may include a third inner wall 306 facing the dryer 1 and the washing machine 2, and a third outer wall 305 spaced apart from the third inner wall 306.

The first cabinet 10 may include a first upper panel 103, a first lower panel 104, a first front panel 101, a first rear panel 102, and first side panels 105 and 106.

The second cabinet 20 may include a second upper panel 203, a second lower panel 204, a second front panel 201, a second rear panel 202, and second side panels 205 and 206.

The third cabinet 30 may include a third upper panel 303, a third lower panel 304, a third front panel 301, a third rear panel 302, and third side panels 305 and 306. The third cabinet 30 may include the third door 31 instead of the third front panel 301.

The above description of the first to third cabinets 10, 20, and 30 may also be applied to the laundry treating apparatus described with reference to FIGS. 1 to 20.

A plate may be disposed in a space between the dryer 1 and the refresher 3 and in a space between the washing machine 2 and the refresher 3. The plate may be a damping material. The dryer 1, the washing machine 2, and the refresher 3 may be coupled to each other by the plate.

The first upper panel 103 of the dryer 1 and the third upper panel 303 of the refresher 3 may be disposed on the same horizontal plane. The third upper panel 303 of the refresher 3 and the upper wall 313 of the rear case 310 may be disposed on the same horizontal plane.

The first dryer 1 may have a first upper surface 10*c*. The first upper surface 10*c* may be an upper surface of the first cabinet 10. The first upper surface 10*c* may be an upper surface of the first upper panel 103.

The refresher 3 may have a third upper surface 30*c*. The third upper surface 30*c* may be an upper surface of the third cabinet 30.

The first upper surface 10*c* and the third upper surface 30*c* may be aligned horizontally. The first upper surface 10*c* and the third upper surface 30*c* may be disposed on the same horizontal plane.

In the description of the laundry treating apparatus of the present disclosure, the term "aligned" will be defined as follows. The term "aligned" may indicate that components are aligned on a substantially same plane. That is, although components A and B are not disposed on the same plane in a strict sense, it can be said that the components A and B are "aligned" on the same plane even when they are disposed on two planes with a predetermined distance between them. Further, in the description of the laundry treating apparatus of the present disclosure, the phrase "positioned on the same plane" includes a case where components are positioned on a substantially same plane. For example, if a first plane, on which component A is positioned, and a second plane, on which component B is positioned, are spaced apart side by side, it can be said that "components A and B are aligned" and "components A and B are positioned on the same plane."

The dryer 1 may have a first front surface 10*a* or 11*a*. The front surface 10*a* of the dryer 1 may refer to the front surface of the first cabinet 10. The first front surface 10*a* may be the front surface of the first front panel 101.

The first door 11 may have a first front surface 11*a*. The front surface 11*a* of the dryer 1 may refer to the front surface of the first door 11.

The washing machine 2 may have a second front surface 20*a* or 21*a*. The front surface 20*a* of the washing machine 2 may refer to the front surface of the second cabinet 20. The second front surface 20*a* may be the front surface of the second front panel 201.

The second door 21 may have the second front surface 21*a*. The front surface 21*a* of the washing machine 2 may refer to the front surface of the second door 21.

The refresher 3 may have a third front surface 31*a*. The front surface 31*a* of the refresher 3 may refer to the front surface of the third door 31.

The front surface 10*a* or 11*a* of the dryer 1 may be aligned with the front surface 31*a* of the refresher 3. The front surface 20*a* or 21*a* of the washing machine 2 may be aligned with the front surface 31*a* of the refresher 3. The front surface 10*a* or 11*a* of the dryer 1 may be aligned with the front surface 20*a* or 21*a* of the washing machine 2.

The front surface 31*a* of the refresher 3 may be aligned with the front surfaces 11*a* and 21*a* of the doors 11 and 21 of the dryer 1 and the washing machine 2, respectively, and may also be aligned with the front surfaces 10*a* and 20*a* of the cabinets 10 and 20 of the dryer 1 and the washing machine 2, respectively. In the case where the respective front surfaces 11*a* and 21*a* of the doors 11 and 21 of the dryer 1 and the washing machine 2 are disposed on the same plane as the front surfaces 10*a* and 20*a* of the cabinets 10 and 20, the front surface 31*a* of the refresher 3 may be aligned with the respective doors 11 and 21 of the dryer 1 and the washing machine 2, and the front surfaces 10*a*, 11*a*, 20*a*, and 21*a* of the cabinets 10 and 20.

The dryer 1 may have a first upper end 107. The first upper end 107 may refer to an upper end of the front surface 10*a* of the first cabinet 10. The first upper end 107 may refer to an upper end of the first front panel 101.

The refresher 3 may have a second upper end 307. The second upper end 307 may refer to an upper end of the third door 31.

The first upper end 107 and the second upper end 307 may be aligned horizontally. The first upper end 107 and the second upper end 307 may be disposed on the same horizontal plane.

The laundry treating apparatus A may include a connector 92 having a width in a horizontal direction and coupled to each of the first upper end 107 and the second upper end 307. The connector 92 may be referred to as an "upper connector."

The laundry treating apparatus may include the upper connector 92 connecting the first cabinet 10 and the third cabinet 30, and a lower connector 90 connecting the second cabinet 20 and the third cabinet 30. The upper connector 92 may connect any one of the first cabinet 10 and the second cabinet 20, which is disposed on an upper side, to the third cabinet 30. The lower connector 90 may connect any one of the first cabinet 10 and the second cabinet 20, which is disposed on a lower side, to the third cabinet 30.

The connector 92 may extend rearwardly from the upper ends 107 and 307. The connector 92 may connect the first upper end 107 and the second upper end 307. The connector 92 may connect the first upper surface 10*c* and the third upper surface 30*c*.

The laundry treating apparatus A may include a tower 9 including the dryer 1 and the washing machine 2. The tower 9 may include the heating device 50.

The tower 9 may be an assembly in which the dryer 1 and the washing machine 2 are arranged vertically. In the case where the heating device 50 is disposed on one side of the refresher 3, the tower 9 may be an assembly in which the dryer 1, the washing machine 2, and the heating device 50 are arranged vertically.

The dryer 1, the washing machine 2, and the heating device 50 may be vertically arranged, so as to form the tower 9. An arrangement order of the dryer 1, the washing machine 2, and the heating device 50 in the tower 9 may not be limited to FIG. 1. For example, the washing machine 2 may be disposed over the dryer 1, and the heating device 50 may be disposed above the dryer 1 and the washing machine 2.

The tower 9 may be disposed on a lateral side of the refresher 3.

A front surface of the tower 9 may be aligned with the front surface 31*a* of the refresher 3. The front surface of the tower 9 may be disposed on the same plane as the front surface 31*a* of the refresher 3. The front surface of the tower 9 may refer to the front surface 11*a* of the first door 11 and the front surface 21*a* of the second door 21. The front surface of the tower 9 may refer to the front surface 10*a* of the first cabinet 10, the front surface 20*a* of the second cabinet 20, and the front surface of the control panel 8.

An upper end 91 of the front surface of the tower 9 may be aligned with the upper end 307 of the front surface 31*a* of the refresher 3. The upper end 91 of the front surface of the tower 9 may be on the same horizontal plane as the upper end 307 of the front surface 31*a* of the refresher 3.

The upper end 91 of the front surface of the tower 9 may refer to the first upper end 107. However, in the case where the washing machine 2 is disposed over the dryer 1, the upper end 91 of the front surface of the tower 9 may refer to the upper end of the front surface of the washing machine 2. Further, in the case where the heating device 50 is disposed on the upper side of the dryer 1 and the washing machine 2, the upper end 91 of the front surface of the tower 9 may refer to the upper end of the front surface of the heating device 50.

An upper surface 9*c* of the tower 9 and the upper surface 30*c* of the refresher 3 may be aligned horizontally. The upper surface 9*c* of the tower 9 and the upper surface 30*c* of the refresher 3 may be disposed on the same horizontal plane.

The connector 92 may connect the upper end 91 of the front surface of the tower 9 and the upper end 307 of the front surface of the refresher 3. The connector 92 may connect the upper surface 9*c* of the tower 9 and the upper surface 30*c* of the refresher 3.

A third side panel 305 of the refresher 3 and a side wall 315 of the rear case 310 may be disposed on the same plane.

The front panel 101 of the dryer 1, the front panel 201 of the washing machine 2, and the control panel 8 may be disposed on the same plane. The front surface 10*a* of the dryer 1, the front surface 20*a* of the washing machine 2, and the control panel 8 may be disposed on the same plane.

The third door 31 of the refresher 3 may be disposed on the same plane as the front panel 101 of the dryer 1, the front panel 201 of the washing machine 2, and the control panel 8. Alternatively, the third door 31 of the refresher 3 may also be disposed on the same plane as the first door 11 of the dryer 1 and the second door 21 of the washing machine 2.

The second lower panel 204 of the washing machine 2 may be disposed on the same horizontal plane as the third lower panel 304 of the refresher 3.

Hereinafter, an internal structure of the dryer 1, the washing machine 2, and the heating device 50 will be described with reference to FIG. 2. FIG. 2 is a diagram illustrating an internal structure of the dryer 1, the washing machine 2, and the heating device 50 which are cut in a longitudinal direction.

The washing machine 2 includes the second cabinet 20, the second door 21 rotatably coupled to the second cabinet 20, the tub 23 disposed in the second cabinet 20, a second drum 24, which is rotatably disposed in the tub 23 and in which laundry is received, a motor 25 for transmitting power to the second drum 24, a drain pump 26 for discharging water, generated in the laundry treating apparatus A to the outside, a water supply valve 27 connected to an external water source, and a drawer 28 in which detergent is stored. The drawer 28 may be referred to as a "detergent box."

The drain pump 26 may be connected to the tub 23 by a first pipe 261. The drain pump 26 may discharge water, introduced through the first pipe 261 and a drain pipe 532, to the outside of the laundry treating apparatus A through a second pipe 262. However, the drain pipe 532 may be directly connected to the second pipe 262, in which case condensate generated in the evaporator 53 may be discharged to the outside of the laundry treating apparatus A through the drain pipe 532 and the second pipe 262.

The water supply valve 27 may open and close water supply pipes 278 and 279 (see FIG. 9) connecting the external water source and the washing machine 2. The water supply valve 27 may control a flow rate of water flowing into the washing machine 2 from the external water source. The water supply valve 27 may be connected to a first water supply pipe 271. The first water supply pipe 271 may be connected to the drawer 28 in which the detergent is stored. The water flowing into the drawer 28 through the first water supply pipe 271 may flow into the tub 23 along with the detergent in the drawer 28 through a second water supply pipe 272.

The dryer 1 includes the first cabinet 10, the first door 11 rotatably coupled to the first cabinet 10, and the first drum 13 which is rotatably disposed in the first cabinet 10 and in which the laundry is received.

The dryer 1 may include a motor 133 (see FIG. 5) for rotating the first drum 13. A pulley may be fixed to a rotating shaft of the motor 133. A belt may connect the pully with a circumferential surface of the drum, such that torque of the motor 133 may be transferred to the drum 13 via the pulley and the belt.

The motor 133 may be disposed under the first drum 13. The motor 133 may be disposed in the heating device 50. The motor 133 may be disposed on a lateral side of the heat exchange channel 42. A case 570 (see FIG. 5) of the heating device 50 may be provided with a motor mounting portion 133*s* (see FIG. 6).

Unlike the example, the motor 133 may be directly coupled to the first drum 13 to rotate the first drum 13.

The heating device 50 may be disposed over the second upper panel 203. The heating device 50 may be disposed in the first cabinet 10.

The heating device 50 includes: a condenser 52 for performing heat exchange between high-temperature refrigerant and air to heat the air; a fan 60 for blowing air heated by passing through the condenser 52; and an evaporator 53 for performing heat exchange between the air flowing into the heating device 50 and low-temperature refrigerant to cool and dehumidify the air. The condenser 52 and the evaporator 53 may be referred to as a "heat exchange unit."

The air heated by passing through the condenser 52 (hereinafter referred to as "hot air") may be blown by the fan 60, and may be supplied to at least one of the dryer 1, the washing machine 2, or the refresher 3.

The heating device 40 may be connected to the first drum 13 by a first supply air duct 43. The hot air generated by the heating device 50 may be blown by the fan 60 to be supplied into the first drum 13 through the first supply air duct 43. The first supply air duct 43 may extend upwardly from the heating device 50.

The heating device 50 may be connected to the tub 23 through a third supply air duct 48. The hot air generated by the heating device 50 may be blown by the fan 60 to be supplied into the tub 23 through the third supply air duct 48. The third supply air duct 48 may extend downwardly from the heating device 50.

The hot air generated by the heating device 50 may be blown by the fan 60 to be supplied to the outside of the laundry treating apparatus A through a dehumidification duct 46. The dehumidification duct 46 may be disposed between a base plate 575 to be described below and the second upper panel 203. The air blown by the fan 60 may be supplied into an indoor space through the dehumidification duct 46. An opening member 463 may be disposed in front of the dehumidification duct 46. The opening member 463 may open and close the front side of the dehumidification duct 46. The opening member 463 may be rotatably coupled to the first cabinet 10 or the second cabinet 20.

The supply air ducts 43, 45, and 48 may be referred to as any one of first to third supply air ducts. For example, the supply air duct connected to the dryer 1 may be referred to as a first supply air duct 43; the supply air duct connected to the refresher 3 may be referred to as a second supply air duct 45, and the supply air duct connected to the washing machine 2 may be referred to as a third supply air duct 48.

The supply air ducts 43, 45, and 48 may be referred to as "supply pipes." The respective first, second, and third supply air ducts 43, 45, and 48 may be referred to as any one of the "first to third supply pipes." For example, the first supply air duct 43 may be referred to as a first supply pipe; the second supply air duct 45 may be referred to as a second supply pipe; and the third supply air duct 48 may be referred to as a third supply pipe.

The air supplied to the dryer 1, the washing machine 2, or the refresher 3 may be recovered to the heating device 50.

The heating device 50 may be connected to the first drum 13 by a first exhaust air duct 41. The hot air flowing into the first drum 13 through the first supply air duct 43 may dry the laundry placed in the first drum 13, and then may return to the heating device 50 through the first exhaust air duct 41. The first exhaust air duct 41 may extend downwardly from the first drum 13.

The heating device 50 may be connected to the tub 23 by a third exhaust air duct 47. The hot air flowing into the tub 23 through the third supply air duct 48 may dry the laundry placed in the second drum 24, and then may return to the heating device 50 through the third exhaust air duct 41. The third exhaust air duct 47 may extend upwardly from the tub 23.

The exhaust air ducts 41, 44, and 47 may be referred to as any one of first to third exhaust air ducts. For example, the exhaust air duct connected to the dryer 1 may be referred to as a first exhaust air duct 41; the exhaust air duct connected to the refresher 3 may be referred to as a second exhaust air duct 44; and the exhaust air duct connected to the washing machine 2 may be referred to as a third exhaust air duct 47. The respective first, second, and third exhaust air ducts 41, 44, and 47 may be referred to as any one of "first to third return lines." For example, the first exhaust air duct 41 may be referred to as a first return line, the second exhaust air duct 44 may be referred to as a second return line, and a third exhaust air duct 47 may be referred to as a third return line.

The hot air generated by the heating device 50 may be supplied to the dryer 1, the washing machine 2, and the refresher 3, to dry the laundry placed in the respective laundry treating machines 1, 2, and 3, and then may return to the heating device 50. That is, the hot air generated by the heating device 50 may circulate within the laundry treating apparatus A. The hot air, recovered to the heating device 50 after drying the laundry received in each of the plurality of laundry treating machines 1, 2, and 3, may contain a greater amount of moisture than the air drying the laundry placed in one laundry treating machine.

By performing heat exchange between the air returning to the heating device 50 and a refrigerant, the evaporator 53 may reduce the temperature of the returning air and removes moisture contained in the air. The air returning to the heating device 50 may be heat exchanged with the evaporator 53 to generate condensate.

The heating device 50 may include a drain pan 531 disposed on a lower side of the evaporator 53. The drain pan 531 may receive the condensate generated in the evaporator 53.

The drain pan 531 may be connected to the drain pump 26 by the drain pipe 532. The drain pipe 532 may extend downwardly from the drain pan 531 to be connected to the drain pump 26.

The water collected in the drain pan 531 may flow to the drain pump 26 through the drain pipe 532, and may be discharged to the outside of the laundry treating apparatus A by the drain pump 26.

The dryer 1 may have a first rear surface 10*b*. The first rear surface 10*b* may refer to a rear surface of the first cabinet 10.

The washing machine 2 may have a second rear surface 20*b*. The second rear surface 20*b* may refer to a rear surface of the second cabinet 20.

The tower 9 may have widths W1 and W2 in a front-rear direction. A width from the front surfaces 11*a* and 21*a* of the doors 11 and 21 to the rear surfaces 10*b* and 20*b* may be defined as a first width W1. A width from the front surfaces 10*a* and 20*a* of the cabinets 10 and 20 to the rear surfaces 10*b* and 20*b* may be defined as a second width W2.

Each of the dryer 1 and the washing machine 2 may have the first width W1 and the second width W2. The dryer 1 and the washing machine 2 may have the same width in the front-rear direction.

The tower 9 may have a height 9H in an up-down direction. The height 9H of the tower 9 may be defined as a sum of the height of the dryer 1 and the height of the washing machine 2. However, in the case where the heating device 50 is disposed outside of the dryer 1 and the washing machine 2, the height 9H of the tower 9 may be defined as a sum of the height of the dryer 1, the height of the washing machine 2, and the height of the heating device 50.

Hereinafter, an internal structure of the refresher 3 will be described with reference to FIG. 3. FIG. 3 is a diagram illustrating an internal structure of the refresher 3 of the laundry treating apparatus A which is cut in a longitudinal direction.

The refresher 3 may include the third cabinet 30 having an inner space 33 for receiving laundry.

The refresher 3 may include a hanger 36, on which clothes are hung, and an inner panel 34 defining a lower portion of a space 33 in which clothes are received. The inner panel 34 may be referred to as an "inner plate."

The inner plate 34 may be disposed below the tub 23. The inner plate 34 may be disposed below the second drum 24. However, in the case where the dryer 1 is disposed under the washing machine 2, the inner plate 34 may be disposed below the first drum 13. Accordingly, as the height of the position of the inner plate 34 is reduced, a volume of the inner space of the refresher 3 may increase.

The hanger 36 may be disposed between the third upper panel 303 and the third lower panel 304, and may be disposed closer to the third upper panel 303 than the third lower panel 304.

The hanger 36 may be disposed above the first drum 13. The hanger 36 may be disposed at a height corresponding to an upper portion of the first drum 13. However, in the case where the dryer 1 is disposed under the washing machine 2, the hanger 36 may be disposed above the tub 23 or may be disposed on an upper side of the second drum 24, and may be disposed at a height corresponding to the tub 23 or the upper portion of the second drum 24. Accordingly, as the height of the position of the hanger 36 increases, a volume of the inner space of the refresher 3 may increase.

The inner panel 34 may be disposed between the third upper panel 303 and the third lower panel 304, and may be disposed closer to the third lower panel 304 than the third upper panel 303.

Garments G received in the inner space 33 of the third cabinet 30 may be located between the hanger 36 and the inner panel 34.

The height H of the inner space 33 may refer to a height between the hanger 36 and the inner panel 34. The height H of the inner space 33 may refer to a vertical gap between the upper panel 303 and the inner panel 34. The height H of the inner space 33 may be extended compared to a case where the heating device 50 is disposed between the inner panel 34 and the third lower panel 304. Accordingly, unlike an existing refresher, the refresher 3 according to the present disclosure may receive garments G, such as a long coat or a suit, which occupy a great height in the vertical direction.

In addition, compared to the existing refresher, the refresher 3 according to the present disclosure may have a longitudinal width which may be extended according to the longitudinal width of the dryer 1 and the washing machine 2. Accordingly, the refresher 3 according to the present disclosure may receive a larger number of garments in the front-rear direction than the existing refresher. The longitudinal width W3 of the inner space 33 of the refresher 3 may refer to a width between the third door 31 and the third panel 302.

The refresher 3 may have a third rear surface 30*b*. The third rear surface 30*b* may refer to a rear surface of the third cabinet 30.

The refresher 3 may have longitudinal widths W3, W4, and W5. A width from an inner surface of the third door 31 to an inner surface of the third rear panel 302 may be defined as a third width W3. The third width W3 may be the longitudinal width of the inner space 33 of the refresher 3. A width from the front surface 31*a* of the third door 31 to the rear surface 30*b* of the third cabinet 30 may be defined as a fourth width W4. A width from the front surface 31*a* of the third door 31 to a rear surface 44*b* of the second exhaust air duct 44 may be defined as a fifth width W5. However, the first to fifth widths W1, W2, W3, W4, and W5 are randomly defined for convenience of explanation, and the respective widths W1, W2, W3, W4, and W5 defined above may be referred to as any one of the first to fifth widths.

The longitudinal width W3 of the inner space 33 of the refresher 3 may be smaller than the longitudinal widths W1 and W2 of the dryer 1 and the washing machine 2. The longitudinal width W4 of the third cabinet 30 may be smaller than the longitudinal widths W1 and W2 of the dryer 1 and the washing machine 2.

In the laundry treating apparatus A according to an aspect of the present disclosure, the supply air duct 45 and the exhaust air duct 44 are disposed behind the space 33 in which the laundry is placed, such that the front surface 31*a* of the refresher 3 and the front surface of the dryer 1 and the washing machine 2 may be aligned.

The refresher 3 may have a vertical height 3H. The height H3 of the refresher 3 may be defined as a length from the upper surface 30*c* of the refresher 3 to the lower surface thereof.

The vertical height 3H of the refresher 3 may be equal to the vertical height H9 of the tower 9. However, it is also possible that the vertical height 3H of the refresher 3 may be equal to or lower than the vertical height H9 of the tower 9.

A storage space 35 may be formed between the inner panel 34 and the third lower panel 304. Garments, such as socks, underwear, hats, scarves, gloves, etc., which take up a relatively small volume, may be placed in the storage space 35. However, the storage space 35 may refer to a space in which the supply air duct 45 and the exhaust air duct 44 are disposed.

The inner panel 34 may be connected to the second supply air duct 45. The third cabinet 30 may be connected to the second exhaust air duct 44.

The inner panel 34 may include a first inner panel 341 spaced apart from an upper side of the third lower panel 304, and a second inner panel 342 extending diagonally upward from the first inner panel 341. The second inner panel 342 may extend at an incline upwardly from the first inner panel 341 toward the third rear panel 302.

The second supply air duct 45 may be connected to the second inner panel 342. The second inner panel 342 may have a supply air hole 308 that is open toward the inner space 33. The second supply air duct 45 may be connected to the supply air hole 308. The hot air supplied from the heating device 50 may be discharged to the inner space 33 through the supply air hole 308.

The second supply air duct 45 may include a first hot air duct 451 disposed at a rear side of the third rear panel 302, and a second hot air duct 452 disposed in front of the third rear panel 302.

The first hot air duct 451 may be disposed in the rear case 310. A second hot air duct 452 may be disposed in the storage space 35. The first hot air duct 451 and the second hot air duct 452 may be coupled to the third rear panel 302. The first hot air duct 451 may extend upwardly in the rear case 310 to be connected to the heating device 50. The second hot air duct 452 may extend upwardly to be connected to the second inner panel 342.

The second exhaust air duct 44 may be connected to the third rear panel 302. The third rear panel 302 may have an exhaust air hole 309 that is open toward the inner space 33. The second exhaust air duct 44 may be coupled to the third rear panel 302 so as to correspond to the exhaust air hole 309. The hot air discharged to the inner space 33 of the refresher 3 may dry the garments G, and then may flow into the second exhaust air duct 44 through the exhaust air hole 309.

The exhaust air hole 309 which is open may be formed in the rear panel 302. The exhaust air hole 309 may be open from an inner surface 302*a* of the rear panel to an outer surface 302*b* of the rear panel 302. The exhaust air hole 309 may refer to an open portion of the upper side of the rear panel 302.

The exhaust air duct 44 may be connected to the exhaust air hole 309. The exhaust air duct 44 may be coupled to the rear panel 302. The exhaust air duct 44 may be connected to the outer surface 302*b* of the rear panel 302. The exhaust air duct 44 may pass through the rear panel 302.

The exhaust air duct 44 may include a first exhaust air portion 441 connected to the rear panel 302, and a second exhaust air portion 442 extending downwardly from the first exhaust air portion 441.

The first exhaust air portion 441 may extend rearwardly from the rear panel 302. The second exhaust air portion 442 may be integrally formed with the first exhaust air portion 441. The second exhaust air portion 442 may extend downwardly from the first exhaust air portion 441.

The exhaust air duct 44 may be disposed behind the rear panel 302. The second exhaust air portion 442 may extend downwardly from the rear side of the rear panel 302.

A filter 37 may be disposed in the exhaust air hole 309. The filter 37 may be disposed on the rear panel 302. The filter 37 may be disposed between the inner surface 302*a* of the rear panel 302 and the outer panel 302*b* of the rear panel 302. The filter 37 may be disposed at the upper portion of the cabinet 30.

The filter 37 may have a filter insertion hole 371 which is open toward the inner space 33 of the cabinet 30, and a filter net 372 disposed at a rear portion of the filter insertion hole 371.

The filter insertion hole 371 may be disposed behind the inner surface 302*a* of the rear panel 302. The filter net 372 may be disposed in front of the outer surface 302*b* of the rear panel 302.

The outer surface 302*b* of the rear panel 302 may be defined as the rear surface 30*b* of the refresher 3.

The exhaust air hole 309 may be disposed below the hanger 36.

The supply air hole 308 may be disposed at a lower portion of the refresher 3, and the exhaust air hole 309 may be disposed at an upper portion of the refresher 3. However, the positions of the supply air hole 308 and the exhaust air hole 309 are not limited to the above example. For example, the supply air hole 308 may be disposed at the upper portion of the refresher 3, and the exhaust air hole 309 may be disposed at the lower portion of the refresher 3. In this case, the supply air hole 308 may be disposed above the hanger 36. As the supply air hole 308 is disposed above the hanger 36, dust deposited on the garments G may be removed. Further, any one of the supply air hole 308 or the exhaust air hole 309 is disposed at the upper side, and the other one is disposed at the lower side, air supplied through the supply air hole 308 may be distributed evenly throughout the inner space 33, and then may return to the heating device 50 through the exhaust air hole 309.

The refresher 3 may include rollers 39 and legs 39*a* protruding downwardly from the third lower panel 304. A plurality of rollers 39 may be disposed which are spaced apart from each other in the front-rear direction. A roller structure of the refresher 3 may also be applied to the second lower panel 204 of the washing machine 2. The rollers of the washing machine 2 and the refresher 3 may serve to support the weight of the laundry treating apparatus A when the laundry treating apparatus A is moved.

Hereinafter, a duct system of the laundry treating apparatus A according to the present disclosure will be described with reference to FIG. 4. In FIG. 4, a left side of a reference line Y shows a duct system of the dryer 1 and the washing machine 2, and a right side of the reference line Y shows a duct system of the refresher 3. The left side of the reference line Y in FIG. 4 is view conceptually illustrating a duct system of the dryer 1 and the washing machine 2 which are cut by a plane perpendicular to a left and right direction; and the right side of the reference line Y in FIG. 4 is a view conceptually illustrating a rear surface of the refresher 3 to show a duct system. The directions used in the description of FIG. 4 may be the same as those illustrated in FIG. 1.

The left side of the reference line Y in FIG. 4 may be referred to as a first conceptual diagram S1. The right side of the reference line Y in FIG. 4 may be referred to as a second conceptual diagram S2.

The "duct system DS" may be a concept that collectively refers to passages of hot air circulating in the laundry treating apparatus A. The "duct system DS" may be a concept that collectively refers to passages connecting the heating device 50, the dryer 1, the washing machine 2, and the refresher 3. The "duct system DS" may be a concept that collectively refers to passages of hot air heated by the heating device 50.

The heating device 50 heats air and supplies the heated air to each of the dryer 1, the washing machine 2, and the refresher 3.

The duct system DS may include the heat exchange channel 42 in which the air is heated. The duct system may include the first supply air duct 43 connecting the heating device 50 and the dryer 1. The duct system DS may include the second supply air duct 45 connecting the heating device 50 and the refresher 3. The duct system DS may include the third supply air duct 48 connecting the heating device 50 and the washing machine 2. The duct system DS may include the dehumidification duct 46 connected to the heating device 50. The air heated by passing through the heat exchange channel 42 is blown by the fan 60 to be supplied to at least any one of the first supply air duct 43, the second supply air duct 45, the third supply air duct 48, and the dehumidification duct 46.

The duct system DS may include the first exhaust air duct 41 connecting the heating device 50 and the dryer 1. The duct system DS may include the second exhaust air duct 44 connecting the heating device 50 and the refresher 3. The duct system DS may include the third exhaust air duct 47 connecting the heating device 50 and the washing machine 2. The heated air supplied to the dryer 1 may flow into the heat exchange channel 42 through the first exhaust air duct 41. The heated air supplied to the refresher 3 may flow into the heat exchange channel 42 through the second exhaust air duct 44. The heated air supplied to the washing machine 2 may flow into the heat exchange channel 42 through the third exhaust air duct 47.

The heat exchange channel 42, through the air flows, may be provided in the heating device 50. The heating device 50 may include a heat exchange unit disposed in the heat exchange channel 42. The heat exchange unit may heat the air flowing in the heat exchange channel 42. The heat exchange unit may include the condenser 52 and the evaporator 53.

The laundry treating apparatus A may include the fan 60. The fan 60 may blow the air in the heat exchange channel 42. The fan 60 may be disposed on a downstream side of the condenser 52. The air heated by heat exchange with the evaporator 53 and the condenser 52 may be blown by the fan 60. The fan 60 may be disposed in the heat exchange channel 42.

The air blown by the fan 60 may be supplied to at least any one of the dryer 1, the washing machine 2, the refresher 3, and the dehumidification duct 46.

The laundry treating apparatus A may include a blowing duct 420 surrounding the fan 60. The duct system DS may include the blowing duct 420. The fan 60 may be disposed in the blowing duct 420.

An inner space of the blowing duct 420 may be a portion of the heat exchange channel 42.

The fan 60 and the blowing duct 420 may be disposed at a discharge end 42B of the heat exchange channel 42. The discharge end 42B may be disposed at a downstream side of the condenser 52 and the evaporator 53.

The blowing duct 420 may include a first discharge port 425 connected to the first supply air duct 43. The blowing duct 420 may include a second discharge port 427 connected to the second supply air duct 45. The blowing duct 420 may include a third discharge port 426 connected to the third supply air duct 48. The blowing duct 420 may include a fourth discharge port 428 connected to the dehumidification duct 46.

The first discharge port 425 may protrude upwardly from the blowing duct 420. The first supply air duct 43 may connect the first drum 13 and the first discharge port 425.

The second discharge port 427 may protrude from the blowing duct 420 to a lateral side. The second supply air duct 45 may connect the third cabinet 30 and the second discharge port 427.

The third discharge port 426 may protrude downwardly from the blowing duct 420. The third supply air duct 48 may connect the tub 23 and the third discharge port 426.

The fourth discharge port 428 may protrude from the blowing duct 420 to the lateral side. The fourth discharge port 428 may protrude in a direction opposite to the second discharge port 427. The dehumidification duct 46 may be connected to the fourth discharge port 428.

A rotating body 71 of a switching device 70 (see FIG. 6) which will be described later may be disposed in the blowing duct 420. The rotating body 71 may be connected to a driving motor 711 to be rotated in the blowing duct 420. The air blown by the fan 60 may flow into at least any one of the first supply air duct 43, the second supply air duct 45, the third supply air duct 48, and the dehumidification duct 46 by the operation of the switching device 70.

The laundry treating apparatus A according to the present disclosure may also include a separate distribution device in addition to the switching device 70 which will be described later. The distribution device may distribute the air blown by the fan 60 to each of the dryer 1, the washing machine 2, the refresher 3, and the dehumidification duct 46. That is, the air blown by the fan 60 may be supplied at the same time to each of the dryer 1, the washing machine 2, the refresher 3, and the dehumidification duct 46. The distribution device may be disposed in the blowing duct 420 or may be disposed on a distribution passage connected to the blowing duct 420. The distribution device may be a valve. The distribution device may include an actuator and a switching damper. The laundry treating apparatus A may include both the switching device 70 and the distribution device at the same time, may include only the switching device 70, or may include only the distribution device.

The hot air flowing into the first drum 13 through the first supply air duct 43 may dry the laundry placed in the first drum 13, and then may flow into the heat exchange channel 42 through the first exhaust air duct 41. The first drum 13 may include a front cover 131 disposed on a front side, and a rear cover 132 disposed on a rear side. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend downwardly from the first drum 13 to be connected to the heat exchange channel 42.

An inlet end 42A of the heat exchange channel 42 may have a first inlet port 421 connected to the first exhaust air duct 41. The first inlet port 421 may extend upwardly from the heat exchange channel 42. The first inlet port 421 may extend upwardly from the case 570 of the heating device 50.

The laundry treating apparatus A may include a first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first exhaust air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 and the second exhaust air duct 44 may be connected to the third rear panel 302 of the third cabinet 30.

The second exhaust air duct 44 may connect the third cabinet 30 and the heat exchange channel 42. The second exhaust air duct 44 may extend downwardly from an upper portion of the third cabinet 30 to be connected to the heat exchange channel 42.

The second exhaust air duct 44 may include a first exhaust air portion 441 disposed between the heating device 50 and the second cabinet 20. A first exhaust air portion 441 may be disposed between a base plate 575 (see FIG. 6) to be described later and the second upper panel 203 of the second cabinet 20. The first exhaust air portion 441 may extend forwardly and rearwardly in a separation space 55 (see FIG. 6) which will be described later.

The inlet end 42A of the heat exchange channel 42 may have a second inlet port 422 connected to the second exhaust air duct 44. The second inlet port 422 may extend downwardly from the heat exchange channel 42. The second inlet port 422 may extend downwardly from the case 570 of the heating device 50.

The laundry treating apparatus A may include a second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third drum 30 through the second exhaust air duct 45. The second opening and closing valve 44*a* may be disposed in the first exhaust air portion 441.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend upwardly from an upper portion of the tub 23 to be connected to the heat exchange channel 42.

A third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the second exhaust air duct 44. The third inlet port 424 may extend downwardly from the first exhaust air portion 441.

The third inlet port 424 may protrude downwardly from a lower surface of the second exhaust air duct 44. The third exhaust air duct 47 may connect the tub 23 and the third inlet port 424. The air in the third exhaust air duct 47 may join the air in the second exhaust air duct 44 to flow into the heat exchange channel 42.

The laundry treating apparatus A may include a third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The hot air flowing through the dehumidification duct 46 may be supplied to the outside of the laundry treating apparatus A through an outlet 462 that is opened forward. The hot air flowing through the dehumidification duct 46 may be supplied to an indoor space through the outlet 462.

The dehumidification duct may include a second duct section 461 disposed between the heating device 50 and the second cabinet 20. The second duct section 461 may be disposed between the base plate 575 (see FIG. 6) to be described later and the second upper panel 203 of the second cabinet 20. The second duct section 461 may extend forwardly and rearwardly in the separation space 55 (see FIG. 6) which will be described later.

An outside air inlet port 423 connected to the heat exchange channel 42 may be formed at the inlet end 42A of the heat exchange channel 42. The outside air inlet port 423 may extend forwardly from the heat exchange channel 42. The outside air inlet port 423 may extend forwardly from the second exhaust air duct 44.

The outside air inlet port 423 may protrude forwardly from one side of the second exhaust air duct 44. The outside air inlet port 423 may allow the indoor space and the second exhaust air duct 44 to communicate with each other. The air in the outside air inlet port 423 may join the air in the second exhaust air duct 44 to flow into the heat exchange channel 42. The outside air inlet port 423 may have an outside air inlet 49 that is opened forward. The air drawn in through the outside air inlet 49 may join the air in the second exhaust air duct 44 to flow into the heat exchange channel 42.

The laundry treating apparatus A may include a fourth opening and closing valve 49*a* disposed at the outside air inlet port 423. The fourth opening and closing valve 49*a* may control a flow rate of air in the outside air inlet port 423. The fourth opening and closing valve 49*a* may block an air flow in the outside air inlet port 423. The fourth opening and closing valve 49*a* may block the air flow in the outside air inlet port 423 when the hot air is not supplied to the dehumidification duct 46.

Hereinafter, the heating device 50 will be described with reference to FIGS. 5 to 7. The description of the heating device 50, which will be described below with reference to FIGS. 5 to 7, may be applied commonly to all embodiments of the laundry treating apparatus described with reference to FIGS. 1 to 20. Even in this case, however, depending on relative arrangement positions of the laundry treating machines included in the laundry treating apparatus, a shape of the case 570, a shape of the blowing duct 420, an opening direction of the discharge ports 425, 426, 427, and 428, an opening direction of the inlet ports 421, 422, 423, and 424, and the like may vary.

Referring to FIG. 5, the heating device 50 may include the case 570, the compressor 51, the condenser 52, the evaporator 53, and the expansion device 54.

The compressor 51, the condenser 52, the evaporator 53, and the expansion device 54 may be connected by a refrigerant passage. The heat pump device may include the compressor 51, the condenser 52, the evaporator 53, and the expansion device 54.

The drain pan 531 may be disposed under the evaporator 53.

The case 570 may provide a space in which the compressor 51, the condenser 52, the fan 60, and the evaporator 53 are disposed. The compressor 51, the condenser 52, the fan 60, the evaporator 53, and the switching device 70 may be disposed in the case 570.

The case 570 may include a cover 573, a base plate 575 spaced apart from a lower side of the cover 573, a front wall 574 disposed in front of the condenser 53, a first side wall 571 disposed on one side of the condenser 53, and a second side wall 572 disposed on the other side of the condenser 53.

The drum motor 133 rotating the first drum 13 of the dryer 1 may be disposed in the case 570 of the heating device 50. The drum motor 133 may be disposed on an upper side of the case 570. A motor mounting portion 133*s*, on which the drum motor 133 is mounted, is provided in the case 570.

The condenser 52, the fan 60, and the evaporator 53 may be disposed on an upper side of the base plate 575.

The heat exchange channel 42 may be a space surrounded by the base plate 575, the front wall 574, the first side wall 571, and the second side wall 572. The cover 573 may not be provided, in which case an upper portion of the heat exchange channel 42 may be open. The heat exchange channel 42 may communicate with the fan 60 disposed at a rear side of the heating device 50. Air in the heat exchange channel 42 may be blown by the fan 60. The heat exchange channel 42 may be referred to as a "heating passage." The condenser 52 and the evaporator 53 may be disposed in the heat exchange channel 42. The heat exchange channel 42 may refer to a partially open space.

The heat exchange channel 42 may be a space surrounded by the cover 573, the base plate 575, the front wall 574, the first side wall 571, and the second side wall 572. The cover 573 may cover the upper portion of the heat exchange channel 42. The heat exchange channel 42 may refer to a space between the cover 573 and the base plate 575. The cover 573, the base plate 575, the front wall 574, the first side wall 571, and the second side wall 572 may form a "heating duct" surrounding the heat exchange channel 42. The heating duct may communicate with the fan 60, and air in the heating duct may be blown by the fan 60. The condenser 52 and the evaporator 53 may be disposed in the heating duct. The heat exchange channel 42 may refer to a duct shielded in all directions.

The heat exchange channel 42 may be formed in the heating device 50. The heat exchange channel 42 may be a portion of the inner space of the heating device 50.

The first inlet port 421 may be disposed in front of the heat exchange channel 42. The first inlet port 421 may cover the front side of the heat exchange channel 42. The first inlet port 421 may be connected to the front wall 574. The first inlet port 421 may be formed in the case 570. The first exhaust air duct 41 may be inserted into the first inlet port 421 and may be fixed thereto.

The heating device 50 may be disposed in the machine room S. The controller 81 may control the operation of components disposed in the machine room S. The machine room S may have a space in which the PCB is disposed, and the controller 81 may be mounted in the PCB.

The heating device 50 may include a steam generator 502 for generating steam and a dehumidifier 504 for removing moisture from air flowing through the heat exchange channel 42.

The steam generator 502 may generate steam by heating water. The steam generator 502 may be disposed between the condenser 52 and the fan 60. The steam generated by the steam generator 502 may be pressurized by the fan 60 to be supplied to each of the dryer 1, the washing machine 2, and the refresher 3. The steam generated by the steam generator 502 may be supplied to each of the first drum 13, the second drum 24, and the inner space 33 of the refresher 3.

The dehumidifier 504 may dehumidify air under room temperature conditions (about 25 degrees Celsius). The dehumidifier 504 may dehumidify air by using desiccant cooling. The dehumidifier 504 may be filled with zeolite. The zeolite filled in the dehumidifier 504 may be replaced periodically.

The dehumidifier 504 may be disposed between the condenser 52 and the fan 60. The dehumidifier 504 may dehumidify the air flowing through the heat exchange channel 42 even when the compressor 51 is not in operation.

The switching device 70 may control the direction of air blown by the fan 60. The switching device 70 may be disposed in the machine room S.

Referring to FIG. 6, the switching device 70 may control the supply of hot air to the dryer 1, the washing machine 21, the refresher 3, or the dehumidification duct 46.

The switching device 70 may include the rotating body 71 rotatably mounted in the blowing duct 420. The switching device 70 may include the driving motor 711 that rotates the rotating body 71. The rotating body 71 may be rotated by the driving motor 711 in the blowing duct 420. The fan 60 may be disposed in the rotating body 71.

The driving motor 711 may rotate the rotating body 71. A driving gear 712 may be fixed to the rotating shaft of the driving motor 711. The driving gear 712 may be a pinion gear or a spur gear.

A driven gear 713 may be rotated in engagement with the driving gear 712. The driven gear 713 may be fixed to the rotating body 71 or may be integrally formed with the rotating body 71. The driven gear 713 may be a ring gear. The driven gear 713 may be a ring-shaped rack.

The driving gear 712 and the driven gear 713 may be geared with each other. By the rotation of the driving gear 712, the driven gear 713 may be moved in a circumferential direction with respect to the rotational axis of the fan 60. When the driven gear 713 is moved in a circumferential direction, the rotating body 71 having the driven gear 713 fixed thereto may also be moved in the circumferential direction with respect to the rotational axis of the fan 60.

The driving motor 711 may be disposed outside of the blowing duct 420. One surface (e.g., rear surface) of the blowing duct 420 that faces the rotating body 71 may have a cut-out portion 714. The cut-out portion 714 may be formed at a position corresponding to the driven gear 713. A portion of the driving gear 712 may be inserted into the cut-out portion 714. The driving gear 712 and the driven gear 713 may be geared with each other in the cut-out portion 714.

A rotating shaft of the driving motor 711 may be disposed side by side with the rear surface of the blowing duct 420. Accordingly, a volume occupied by the driving motor 711 and the driving gear 712 in the front-rear direction may be reduced.

The driving motor 711 may be a motor capable of controlling the position, angle, and direction of rotation. For example, the driving motor may be a Brushless Direct Current (BLDC) motor. Alternatively, the driving motor 711 may be a step motor. The driving motor 711 may be electrically connected to the control panel 8 and/or the controller 81. Rotation of the driving motor 711 may be controlled by an electrical signal transmitted from the control panel 8 and/or the controller 81 to the driving motor 711. The control panel 8 and/or the controller 81 may control a hot air supplying direction by controlling the rotation angle of the driving motor 711.

Meanwhile, the driving motor 711 may rotate the rotating body 71 by various known methods used by the motor for rotating the rotating body. For example, the driving motor 711 may rotate the rotating body 71 by using a belt-pulley method, or by using a plurality of gears that are geared with each other, or the rotating shaft of the motor may be rotated together with the rotating body.

The blowing duct 420 may be connected to the first supply air duct 43, the second supply air duct 45, the third supply air duct 48, and the dehumidification duct 46.

The blowing duct 420 may be connected to a motor mount 564, to which a fan motor rotating the fan 60 is fixed. The motor mount 64 may be disposed on a rear surface of the blowing duct 420. The driving motor 711, the driving gear 712, and the driven gear 713 may be disposed radially outwardly from the motor mount 64.

The blowing duct 420 may include the first discharge port 425, the second discharge port 427, the third discharge port 426, and the fourth discharge port 428.

The first supply air duct 43 may be connected to the first discharge port 425. The first supply air duct 43 may be inserted into the first discharge port 425. The first discharge port 425 may be disposed facing upward in the blowing duct 420. The first discharge port 425 may provide a supply air hole that is vertically open.

The second supply air duct 45 may be connected to the second discharge port 427. The second supply air duct 45 may be inserted into the second discharge port 427. The second discharge port 427 may be disposed facing toward the lateral side in the blowing duct 420. The second discharge port 427 may provide a supply air hole that is horizontally open.

The third supply air duct 48 may be connected to the third discharge port 426. The third supply air duct 48 may be inserted into the third discharge port 426. The third discharge port 426 may be disposed facing downwardly in the blowing duct 420. The third discharge port 426 may provide a supply air hole that is vertically open.

The dehumidification duct 46 may be connected to the fourth discharge port 428. The dehumidification duct 46 may be inserted into the fourth discharge port 428. The fourth discharge port 428 may be disposed facing a direction opposite to the second discharge port 427. The fourth discharge port 428 may be disposed facing toward the lateral side in the blowing duct 420. The fourth discharge port 428 may provide a supply air hole that is horizontally open.

The heating device 50 may be connected to each of the first exhaust air duct 41, the second exhaust air duct 44, the third exhaust air duct 47, and the outside air inlet port 423. The third exhaust air duct 47 and the outside air inlet port 423 may be connected to the heating device 50 via the second exhaust air duct 44.

The heating device 50 may include the first inlet port 421 connected to the first exhaust air duct 41, and the second inlet port 422 connected to the second exhaust air duct 44. The first inlet port 421 may extend upwardly, and the second inlet port 422 may extend downwardly. The first inlet port 421 and the second inlet port 422 may protrude from the case 570 of the heating device 50.

Air drawn into the heating device 50 through the first exhaust air duct 41, the second exhaust air duct 44, the third exhaust air duct 47, and the outside air inlet port 423 may pass through the heat exchange channel 42 and flow into the fan 60 by the suction force of the fan 60.

Referring to FIG. 7, the air flowing through the first exhaust air duct 41, the second exhaust air duct 44, the third exhaust air duct 47, and the outside air inlet port 423 may meet in the heat exchange channel 42 to flow into the fan 60.

The third inlet port 424 connected to the third exhaust air duct 47 may protrude downwardly from the second exhaust air duct 44. The air in the third exhaust air duct 47 may join the air in the second exhaust air duct 44 to flow into the heat exchange channel 42.

The outside air inlet port 423 communicating with the indoor space may protrude forward from the second exhaust air duct 44. The air flowing into the outside air inlet port 423 through the outside air inlet 49 may join the air in the second exhaust air duct 44 to flow into the heat exchange channel 42.

The air flowing into the heat exchange channel 42 through the second exhaust air duct 44 may join the air flowing into the heat exchange channel 42 through the first exhaust air duct 41 to flow to the fan 60.

The heating device 50 may include a first support plate 576 extending downwardly from the base plate 575, and a second support plate 577 extending downwardly from the base plate 575 and spaced apart from the first support plate 576.

A separation space 55 may be formed between the first support plate 576 and the second support plate 577.

The second exhaust air duct 44, the third exhaust air duct 47, and the dehumidification duct 46 may be disposed in the separation space 55. The second exhaust air duct 44, the third exhaust air duct 7 and the dehumidification duct 46 may be formed between the first support plate 576 and the second support plate 577. The second exhaust air duct 44, the third exhaust air duct 47, and the dehumidification duct 46 may be disposed under the base plate 575.

The dehumidification duct 42 may be disposed under the base plate 575 and may extend forwardly to discharge the air forwardly through a hot air outlet 462. When an opening member 463 (see FIG. 10) which will be described later opens a front portion of the separation space 55, the air discharged through the hot air outlet 462 may be discharged forwardly from the laundry treating apparatus A.

A portion of the second exhaust air duct 44 disposed under the base plate 575 may be defined as the first exhaust air portion 441.

A portion of the dehumidification duct 46 disposed under the base plate 575 may be defined as the second duct section 461.

Hereinafter, a method of controlling a blowing direction of air by the switching device 70 will be described with reference to FIG. 8. In FIG. 8, (a) is a diagram illustrating an example of operation when air is supplied to the first supply air duct 43 by the operation of the switching device 70, and (b) is a diagram illustrating an example of operation when air is supplied to the first supply air duct 43 and the second supply air duct 45 at the same time by the operation of the switching device 70. The description of the switching device 70, which will be described with reference to FIG. 8, may be applied commonly to all embodiments of the laundry treating apparatus described with reference to FIGS. 1 to 20. Even in this case, however, an opening direction of the discharge ports 425, 426, 427, and 428, an arrangement and connection structure of the exhaust air ducts 41, 44, and 47, and the like may vary depending on the relative arrangement of the laundry treating machines included in the laundry treating apparatus.

The fan 60 may be a Sirocco fan. The fan 60 may rotate to blow air in a direction perpendicular to the rotating shaft 61. The fan 60 may blow air in a direction coming into contact with the rotation direction. The air blown by the fan 60 may be concentrated in a predetermined range of angles relative to the rotating shaft 61.

The fan 60 may include the rotating shaft 61 coupled to the fan motor and rotated thereby, a plurality of blades 62 spaced apart in a radially outward direction of the rotating shaft 61, and an outer body 63 coupled to the blades 62 and extending in a rotation direction of the fan 60. The outer body 63 may have an annular shape. The rotating shaft 61 and the blades 62 may be connected by the outer body 63. When the rotating shaft 61 rotates, the outer body 63 and the blades 62 may also be rotated together with the rotating shaft 61.

The rotating body 71 may include a rotating plate 71*a* having the driven gear 713, a scroll 71*b* coupled to the rotating plate 71*a*, and a shaft through hole 71*c* formed in the rotating plate 71*a*.

The rotating plate 71*a* may have a disk shape and may be disposed behind the fan 60. The driven gear 713 may be formed in an annular shape on one side surface of the rotating plate 71*a*. The driven gear 713 may be formed integrally with the rotating plate 71*a*. When the driven gear 713 is rotated in engagement with the driving gear 712, the rotating plate 71*a* may be rotated in the same direction as the rotation direction of the fan 60. The rotating plate 71*a* may have the shaft through hole 71*c*, through which the rotating shaft 61 passes. The rotating shaft 61 may pass through the shaft through hole 71*c* to be coupled to the fan motor.

The fan 60 may be disposed between the heat exchange channel 42 and the rotating plate 71*a*. That is, the rotating plate 71*a* may be disposed behind the heat exchange channel 42 and the fan 60. The rotating plate 71*a* may be disposed behind the fan 60 in the blowing duct 420.

The scroll 71*b* may be integrally formed with the rotating plate 71*a*. When the rotating plate 71*a* is rotated, the scroll 71*b* may also be rotated together. The scroll 71*b* may extend in the rotation direction of the fan 60. The scroll 71*b* may be disposed to surround the fan 60. The fan 60 may be disposed in the scroll 71*b*.

The scroll 71*b* may include a blowing channel 72. The blowing channel 72 may be a cut-out portion of an outer circumferential surface of the scroll 71*b*. The scroll 71*b* may cover the outside of the fan 60, and the blowing channel 72 may be an outer region of the fan 60 which is not covered by the scroll 71*b*. The air blown by the fan 60 may be discharged to the outside of the blowing duct 420 through the blowing channel 72.

When the scroll 71*b* is rotated by the rotation of the rotating plate 71*a*, the blowing channel 72 may be changed in position. That is, by the rotation of the scroll 71*b*, the position of the blowing channel 72 may be changed relative to the rotating shaft 61. By rotating the scroll 71*b* to change the position of the blowing channel 72, the driving motor 711 may control the direction of air discharged from the blowing duct 420.

A longitudinal section of the blowing duct 420 may have a square shape. Accordingly, by the rotation of the scroll 71*b*, interference between the scroll 71*b* and the blowing duct may be avoided.

The blowing duct 420 may include a first wall 420*a* disposed on an upper side of the fan 60, a second wall 420*b* disposed on a lower side of the fan 60, a third wall 420*c* disposed on one side of the fan 60, and a fourth wall 420*d* disposed on the other side of the fan 60.

The first discharge port 425 may protrude upwardly from the first wall 420*a*. The second discharge port 427 may protrude toward the lateral side from the third wall 240*c*. The third discharge port 426 may protrude downwardly from the second wall 420*b*. The fourth discharge port 428 may protrude toward the lateral side from the fourth wall 420*d*.

Referring to (a) of FIG. 8, the driving motor 711 may rotate the rotating body 71 by a first angle, and when the rotating body 71 is rotated by the first angle, the air blown by the fan 60 may be supplied to the first supply air duct 43. In this case, the blowing channel 72 may communicate with only an inner space of the first discharge port 425. Accordingly, the air blown by the fan 60 may be supplied to only the dryer 1.

Referring to (b) of FIG. 8, the driving motor 711 may rotate the rotating body 71 by a second angle, and when the rotating body 71 is rotated by the second angle, the air blown by the fan 60 may be supplied to the first supply air duct 43 and the second supply air duct 45 at the same time. In this case, the blowing channel 72 may communicate with an inner space of the first discharge port 425 and an inner space of the second discharge port 427. Accordingly, the air blown by the fan 60 may be supplied to the dryer 1 and the refresher 3 at the same time. The blowing channel 72 may include a first blowing channel 72*a* communicating with the inner space of the first discharge port 425, and a second blowing channel 72*b* communicating with the inner space of the second discharge port 427. The air blown by the fan 60 may be supplied to the dryer 1 through the first blowing channel 72*a*. The air blown by the fan 60 may be supplied to the refresher 3 through the second blowing channel 72*b*.

A use may control the switching device 70 by inputting a signal to the control panel 8. Once the signal is input to the control panel 8, the signal may be transmitted to the driving motor 711, to control a rotation angle of the driving motor 711. For example, when the user inputs, to the control panel 8, a signal for supplying hot air to the dryer 1, the driving motor 711 may rotate the rotating body 71 so that the blowing channel 72 may be moved to a position as illustrated in (a) of FIG. 8. For example, when the user inputs, to the control panel 8, a signal for supplying hot air to the dryer 1 and the refresher 3 at the same time, the driving motor 711 may rotate the rotating body 71 so that the blowing channel 72 may be moved to a position as illustrated in (b) of FIG. 8.

Hereinafter, a structure for supplying hot air and steam by the heating device 50 to each of laundry treating machines 1, 2, and 3 will be described with reference to FIG. 9.

The heating device 50 may be disposed on an upper side of the second upper panel 203. The heating device 50 may be disposed in the cabinet 10 of the dryer 1.

The switching device 70 may be disposed on the upper side of the second panel 203. The switching device 70 may be disposed in the cabinet 10 of the dryer 1.

The blowing duct 420 may be connected to the first supply air duct 43, the second supply air duct 45, and the third supply air duct 48.

The first supply air duct 43 may extend upwardly from the blowing duct 420. The first supply air duct 43 may be connected to the first drum 13.

The second supply air duct 45 may extend from the blowing duct 420 to a lateral side. The second supply air duct 45 may be connected to the refresher 3.

The third supply air duct 48 may extend downwardly from the blowing duct 420. The third supply air duct 48 may pass through the separation space 55 to extend into the second cabinet 20.

The laundry treating apparatus A may include a first steam supply pipe 502*a* connecting the steam generator 502 and the first drum 13, a second steam supply pipe 502*b* connecting the steam generator 502 and the refresher 3, and a third steam supply pipe 502*c* connecting the steam generator 502 and the tub 23.

The steam generator 502 may be disposed in the heating device 50. The steam generated by the steam generator 502 may be sprayed into the first drum 13 through the first steam supply pipe 502*a*. The steam generated by the steam generator 502 may be sprayed into the inner space 33 of the refresher 3 through the second steam supply pipe 502*b*. The steam generated by the steam generator 502 may be sprayed into the second drum 24 through the third steam supply pipe 502*c*.

The first steam supply pipe 502*a* may extend upwardly from the steam generator 502 to be connected to the first drum 13.

The second steam supply pipe 502*b* may extend from the steam generator 502 to the lateral side, to be connected to the refresher 3.

The third steam supply pipe 502*c* may extend downwardly from the steam generator 502 to be connected to the tub 23.

The steam generated by the steam generator 502 may flow to each of the first drum 13, the second drum 24, and the inner space 33 of the refresher 3 by the blowing force of the fan 60. That is, by pressurizing the steam generated by the steam generator 502, the fan 60 may cause the steam to flow to the first drum 13, the second drum 24, and the inner space 33 of the refresher 3.

A valve for controlling an amount of steam flow may be provided for each of the first steam supply pipe 502*a*, the second steam supply pipe 502*b*, and the third steam supply pipe 502*c*. By adjusting an opening degree of the valve, the controller 81 may adjust the amount of steam supplied to each of the first drum 13, the second drum 24, and the inner space 33 of the refresher 3.

The washing machine 2 may be connected to a cold water supply pipe 278 for supplying cold water to the tub 23, and a hot water supply pipe 279 for supplying hot water to the tub 23.

The steam generator 502 may be connected to a third water supply pipe 277 branching off from the cold water supply pipe 278 or the hot water supply pipe 279. The steam generator 502 may be connected to the third water supply pipe 277 branching off from the hot water supply pipe 279.

The steam generator 502 may be supplied with hot water through the third water supply pipe 277. The steam generator 502 may generate steam by heating the water supplied through the third water supply pipe 277.

Water supply ports 273 and 274 may be disposed closer to the second upper panel 203 than to the second lower panel 204. The steam generator 502 may be disposed between the second upper panel 203 and the first drum 13. Accordingly, as a distance between the steam generator 502 and the water supply pipes 278 and 279 becomes shorter, the third water supply pipe 277 may be reduced in length.

Hereinafter, a connection structure of the first cabinet 10 and the second cabinet 20 will be described with reference to FIG. 10.

The base plate 575 of the heating device 50 may be spaced from the upper side of the second upper panel 203 of the washing machine 2. The separation space 55 may be formed between the base plate 575 and the second upper panel 203.

The first side panels 105 and 106 of the dryer 1 may protrude downwardly below the base plate 575. The first side panels 105 and 106 may be referred to as the "first side walls."

The first side walls 105 and 106 may include a first outer wall 105 forming one side surface of the laundry treating apparatus A, and a first inner wall 106 facing the third cabinet 30.

The heating device 50 may include the first support plate 576 extending downwardly from the base plate 575. The first support plate 576 may be disposed inside the first outer wall 105.

The heating device 50 may include the second support plate 577 extending downwardly from the base plate 575. The second support plate 577 may be disposed inside the first inner wall 106.

The base plate 575 and the support plates 576 and 577 may be integrally formed with each other. The first outer wall 105 and the first support plate 576 may be integrally formed with each other. The first inner wall 106 and the second support plate 577 may be integrally formed with each other.

The first side walls 105 and 105 may include first protrusions 105*a* and 106*a* protruding downwardly. The first outer wall 105 may include a first outer protrusion 105*a* protruding downwardly. The first inner wall 106 may include a first inner protrusion 106*a* protruding downwardly. The first protrusions 105*a* and 106*a* may protrude downwardly from a lower end of the first side walls 105 and 106.

The second cabinet 20 may include first recesses 203*a* into which the first protrusions 105*a* and 106*a* are inserted. The first recesses 203*a* may be formed in the second upper panel 203. The first recesses 203*a* may be formed at positions vertically corresponding to the first protrusions 105*a* and 106*a*.

The support plates 576 and 577 may include second protrusions 576*a* and 577*a* protruding downwardly. The first support plate 576 may include a second outer protrusion 576*a* protruding downwardly. The second support plate 577 may include a second inner protrusion 577*a* protruding downwardly. The second protrusions 576*a* and 577*a* may protrude downwardly from a lower end of the support plates 576 and 577.

The second cabinet 20 may include second recesses 203*b* into which the second protrusions 576*a* and 577*a* are inserted. The second recesses 203*b* may be formed in the second upper panel 203. The second recesses 203*b* may be formed at positions vertically corresponding to the second protrusions 576*a* and 577*a*.

The first protrusions 105*a* and 106*b* and the second protrusions 576*a* and 577*a* may be referred to as "protrusions." The first recesses 203*a* and the second recesses 203*b* may be referred to as "recesses."

The first cabinet 10 and the second cabinet 20 may be coupled to each other as the protrusions 105*a*, 106*b*, 576*a*, and 577*a* are inserted into the recesses 203*a* and 203*b*.

The machine room S may be formed on the upper side of the base plate 575. Accordingly, the machine room S may be spaced from the upper side of the second upper panel 203.

The separation space 55 may be formed between the first support plate 576 and the second support plate 577.

The second exhaust air duct 44, the dehumidification duct 46, and the third exhaust air duct 47 may be disposed in the separation space 55. The second exhaust air duct 44, the dehumidification duct 46, and the third exhaust air duct 47 may be disposed between the second upper panel 203 and the base plate 575.

The third exhaust air duct 47 may protrude downwardly toward the second upper panel 203. The third exhaust air duct 47 may include a first connection duct 48*a* extending downwardly from the blowing duct 230, and a second connection duct 48*b* connected to the tub 23.

The first connection duct 48*a* may be disposed in the separation space 55.

The second connection duct 48*b* may extend downwardly from the second upper panel 203 to be connected to the tub 23. The second connection duct 48*b* may have a first insertion hole 48*s*, which is formed on the inside thereof, and into which the first connection duct 48*a* is inserted.

The first connection duct 48*a* is inserted into the first insertion hole 48*s* to be fixed to the second connection duct 48*b*.

The third inlet port 424 may be connected to the second exhaust air duct 44, and may be disposed in the separation space 55.

The third inlet port 424 may be inserted into a second insertion hole 47*s*, formed on the inside of the third exhaust air duct 47, to be fixed to the third exhaust air duct 47.

When the first cabinet 10 and the second cabinet 20 are assembled, the first connection duct 48*a* and the third inlet port 424 are inserted into the first insertion hole 48*s* and the second insertion hole 47*s*, respectively, to be fixed thereto, thereby facilitating the assembly and alignment of the first cabinet 10 and the second cabinet 20.

The laundry treating apparatus A may include an auxiliary panel 58 disposed behind the separation space 55.

The auxiliary panel 58 may shield a rear side of the separation space 55. The auxiliary panel 58 may be connected to the first rear panel 102 and the second rear panel 202. The first rear panel 102 and the second rear panel 202 may be connected to each other by the auxiliary panel 58.

The auxiliary panel 58 may include a duct through hole 59, through which the second exhaust air duct 44 passes. The second exhaust duct 44 may extend into the separation space 55 by passing through the auxiliary panel 58.

The auxiliary panel 58 may be coupled to the first side panels 105 and 106 and the support plates 576 and 577.

The opening member 463 may shield the front side of the separation space 55. The opening member 463 may be disposed in front of the dehumidification duct 46 and the outside air inlet port 423.

The laundry treating apparatus A may include a hinge 463*a* connected to the opening member 463, and a motor 463*b* rotating the hinge 463*a*.

The hinge 463*a* may be rotatably connected to the first front panel 101. The hinge 46*a* may extend in a left-right direction. The opening member 46 may be rotated in a front-rear direction with the hinge 463*a* serving as a rotational axis. The opening member 463 may be integrally formed with the hinge 463*a*. When the motor 463*b* rotates the hinge 463*a*, the opening member 463 may be rotated together with the hinge 463*a*. The opening member 463 may rotate forward to open the front side of the separation space 55. Once the opening member 463 opens the front side of the separation space 55, outside air of the laundry treating apparatus A may flow into the heat exchange channel 44 through the outside air inlet port 423, and the air passing through the dehumidification duct 46 may be discharged to the outside of the laundry treating apparatus A.

The controller 81 may be electrically connected to the motor 463*b*. The controller 81 may control the operation of the motor 463*b*. The user may open the separation space 55 by manipulating the control panel 8.

Hereinafter, a longitudinal width of the laundry treating apparatus A will be described with reference to FIG. 11. The description of the widths of the laundry 1, the washing machine 2, and the refresher 3, which will be described with reference to FIG. 11, may be applied commonly to all embodiments of the laundry treating apparatus described with reference to FIGS. 1 to 20.

The longitudinal width W4 of the refresher 3 may be smaller than the longitudinal width W1 of the tower 9. When the front surface 31*a* of the refresher 3 is aligned with the front surface of the tower 9, a gap X may be formed between the rear surface 30*b* of the refresher 3 and the rear surfaces 10*b* and 20*b* of the tower 9. The rear surface 30*b* of the refresher 3 may be disposed in front of the rear surfaces 10*b* and 20*b* of the tower 9, and may be disposed in front of the rear surfaces 10*b* and 20*b* of the tower 9 by the gap X.

A portion of the first inner wall 106 of the dryer 1 and a portion of the second inner wall 206 of the washing machine 2 may be disposed behind the rear surface 30*b* of the refresher 3. The portion of the first inner wall 106 and the portion of the second inner wall 296 may be exposed at the rear side of the third cabinet 30.

The laundry treating apparatus A may include the rear case 310 disposed at the rear side of the inner space 33 of the refresher 3. The rear case 310 may be disposed at the rear side of the third cabinet 30.

The rear case 310 may be connected to each of the dryer 1, the washing machine 2, and the refresher 3.

The rear case 310 may provide a space for accommodating the second supply air duct 45 and the second exhaust air duct 44. The second supply air duct 45 and the second exhaust air duct 44 may be accommodated in the rear case 310.

The second supply air duct 45 and the second exhaust air duct 44 for circulating hot air to the refresher 3 may be disposed at the rear side of the third cabinet 30.

The second supply air duct 45 and the second exhaust air duct 44 may be disposed behind the third rear panel 302.

The second supply air duct 45 may extend downwardly from the heating device 50 to be connected to the inner panel 34.

The second supply air duct 45 may fact the second inner wall 206 of the washing machine 2. The second supply air duct 45 may be disposed side by side with the second inner wall 206.

The second supply air duct 45 may include the first hot air duct 451 and the second hot air duct 452. The first hot air duct 451 may include a first connection part 451*a* connected to the heating device 50, a first extension part 451*b* extending downwardly from the first connection part 451*a*, and a second connection part 451*c* connected to the second hot air duct 452.

The first connection part 451*a* may pass through the first inner wall 106 of the first cabinet 10. The first connection part 451*a* may be connected to the blowing duct 420, and the air blown by the fan 60 may be introduced through the first connection part 451*a*. The first connection part 451*a* may extend horizontally from the heating device 50.

The first extension part 451*b* may be bent downwardly from the first connection part 451*a*. The first extension part 451*b* may extend downwardly from one end of the first connection part 451*a*. The first extension part 451*b* may face the second inner wall 206 of the washing machine 2, and may be disposed side by side with the second inner wall 206.

The second connection part 451*c* may be connected to the third rear panel 302 of the third cabinet 30. The second connection part 451*c* may be connected to the second hot air duct 452. That is, the third rear panel 302 may be disposed between the second hot air duct 452 and the second connection part 451*c*. The second connection part 451*c* may extend from the first extension part 451*b* in the front-rear direction.

Water supply ports 273 and 274 may be connected to the water supply pipes 278 and 279 which are connected to the external water source. The tub 23 may be supplied with water from the external water source through the water supply pipes 278 and 279.

The tub 23 may be supplied with cold water through the cold water supply pipe 278, and may be supplied with hot water through the hot water supply pipe 279.

The laundry treating apparatus A may include a cooling pipe 275 branching off from the cold water supply pipe 289 or the hot water supply pipe 279. The cooling pipe 275 may branch off from the cold water supply pipe 278.

The cooling pipe 275 may branch off from the cold water supply pipe 278 to be heat exchanged with the second supply air duct 45. The cooling pipe 275 may extend side by side with the second supply air duct 45 or may come into contact with the second supply air duct 45. Hot air flowing in the second supply air duct 45 may be heat exchanged with water flowing in the cooling pipe 275, such that temperature of the hot air may be reduced. The cooling pipe 275 may be disposed to be heat exchanged with the first extension part 451*b* or may come into contact with the first extension part 451*b*.

The cooling pipe 275 may be connected to the drain pump 26. Water branched off from the cold water supply pipe 278 and flowing into the cooling pipe 275 may be heat exchanged with the hot air flowing in the second supply air duct 45, and then may flow into the drain pump 26. The drain pump 26 may discharge the water, introduced through the cooling pipe 275, to the outside of the laundry treating apparatus A.

Clothes treated by the refresher 3 may be susceptible to damage when dried at a high temperature. It may be required to supply hot air at a relatively lower temperature to the clothes dried by the refresher 3 than the clothes treated by the dryer 1 and the washing machine 2. The hot air at a high temperature generated by the heating device 50 may be supplied immediately to the dryer 1 or the washing machine 2. By contrast, the high temperature hot air generated by the heating device 50 is required to be cooled before being supplied to the refresher 3. Accordingly, in the laundry treating apparatus A according to the present disclosure, hot air at a lower temperature than the hot air supplied to the dryer 1 and the washing machine 2 may be supplied to the refresher 3 by using the water supply pipes 275, 278, and 279, thereby preventing damage to the clothes placed in the refresher 3. In addition, by discharging water, used for reducing the temperature of the hot air supplied to the refresher 3, to the outside through the drain pump 26, it is possible to effectively manage the water used for cooling the hot air.

The second exhaust air duct 44 may include a first exhaust air portion 441 connected to the refresher 3, a second exhaust air portion 442 extending downwardly from the first exhaust air portion 441, and a third exhaust air portion 443 connected to the heating device 50.

The first exhaust air portion 441 may be connected to the third rear panel 302 of the third cabinet 30. The first exhaust air portion 441 may communicate with the inner space 33 of the refresher 3, and air circulating in the refresher 3 may flow to the first exhaust air portion 441. The first exhaust air portion 441 may be connected to the exhaust air hole 309. The first exhaust air portion 441 may extend rearwardly from the third cabinet 30. A position where the first exhaust air portion 441 and the third cabinet 30 are connected may be between the third upper panel 303 and the hanger 36. The exhaust air hole 309 may be formed between the third upper panel 303 and the hanger 36.

The second exhaust air portion 442 may be bent downwardly from the first exhaust air portion 441. The second exhaust air portion 442 may extend downwardly from the first exhaust air portion 441. The second exhaust air portion 442 may extend downwardly from one end of the first exhaust air portion 441. The second connection part 442 may face the first inner wall 106 of the dryer 1, and may be disposed side by side with the first inner wall 106.

The third exhaust air portion 443 may extend into the separation space 55. The third exhaust air portion 443 may extend in the front-rear direction from the second exhaust air portion 442. The third exhaust air portion 443 may be connected to the heating device 50 in the separation device 55.

The rear case 310 may have a longitudinal width W6. The longitudinal width W6 of the rear case 310 may be smaller than the longitudinal width W1 of the tower 9. The longitudinal width W6 of the rear case 310 may be equal to the gap X.

The rear surface 310*b* of the rear case 310 may be aligned with the rear surfaces 10*b* and 20*b* of the tower 9. The rear surface 310*b* of the rear case 310 may be disposed on the same plane as the rear surfaces 10*b* and 20*b* of the tower 9.

A sum (W4+W6) of the longitudinal width W6 of the rear case 310 and the longitudinal width W4 of the refresher 3 may be equal to the longitudinal width W1 of the tower 9. However, it is also possible that the sum (W4+W6) of the longitudinal width W6 of the rear case 310 and the longitudinal width W4 of the refresher 3 may be similar to or greater than the longitudinal width W1 of the tower 9.

In the laundry treating apparatus A according to an aspect of the present disclosure, the rear case 310 is disposed at a rear side of the refresher 3, such that a constant longitudinal width may be formed. That is, by providing the rear case 310 on the rear side of the refresher 3, not only the front surface 31*a* of the refresher 3 may be aligned with the front surface of the tower 9, but also the rear surface 310*b* of the rear case 310 may be aligned with the rear surfaces 10*b* and 20*b* of the tower 9.

The rear case 310 may have a vertical height 310H. The vertical height 310H may be equal to the height 3H of the refresher 3 and the height 9H of the tower 9. However, it is also possible that the height 310H of the rear case 310 may be similar to or greater than the height 3 of the refresher 3 and the height 9H of the tower 9.

The rear case 310 may be fixed to the refresher 3 by a fastening member 316 passing through a fastening plate 317 extending in the front-rear direction. There may be a plurality of fastening plates 317 which are vertically spaced apart from each other. The fastening plates 317 mat extend in the front-rear direction to be connected to respective side walls of the rear case 310 and the third cabinet 30. The fastening member 316 may pass through the respective side walls of the rear case 310 and the third cabinet 30 and the fastening plate 317.

Hereinafter, a laundry treating apparatus A' according to another embodiment of the present disclosure will be described with reference to FIGS. 12 and 13. The above description with reference to FIGS. 1 to 11 may also be applied to the description of the dryer 1, the washing machine 2, the refresher 3, and the heating device 50 in the following description of the laundry treating apparatus A' which will be described with reference to FIGS. 12 and 13.

Referring to FIG. 12, the second supply air duct 450 may be connected to the upper portion of the refresher 3, and the second exhaust air duct 440 may be connected to the lower portion of the refresher 3.

The supply air hole 308 connected to the second supply air duct 450 may be formed at the upper portion of the cabinet 30. The supply air hole 308 may be formed above the hanger 36. The supply air hole 308 may be formed below an inner surface 303*a* of the third upper panel 303. The supply air hole 308 may be formed between the third upper panel 303 and the hanger 36.

The third upper panel 303 may include the inner surface 303*a* directed toward the inner space 33 of the cabinet 30, an outer surface 303*b* directed toward the outside of the cabinet 30, and an inclined surface 303*c* extending at an incline downwardly from the inner surface 330*a*. The inner surface 303*a* may be referred to as a "first surface." The inclined surface 303*c* may be referred to as a "second surface." The third upper panel 303 may be referred to as an "upper wall."

The first surface 303*a* may be separated from an upper side of the hanger 36. A space may be formed between the first surface 303*a* and the hanger 36.

The second surface 303*c* may extend at an incline downwardly from a rear end of the first surface 303*a*. The second surface 303*c* may extend rearwardly from the first surface 303*a*. The second surface 303*c* may be disposed above the hanger 36. The second surface 303*c* may have an inclination angle θ with respect to a horizontal direction.

The supply air hole 308 may be formed on the second surface 303*c*. The supply air hole 308 may be open obliquely downwardly on the second surface 303*c*.

The supply air hole 308 may be formed above the hanger 36. A first virtual line diagram H1 extending in a horizontal direction from the supply air hole 308 and a second virtual line diagram H2 extending in the horizontal direction from the hanger 36 are defined as follows. The first line diagram H1 may be disposed above the second line diagram H2. The first line diagram H1 and the second line diagram H2 may have a height difference D. The supply air hole 308 may be spaced apart from the hanger 36 by the height difference D.

The supply air duct 450 may be connected to the supply air hole 308. The supply air duct 450 may be coupled to the upper wall 303. The supply air duct 450 may be connected to the second surface 303*c*. The supply air duct 450 may pass through the third rear panel 302. The third rear panel 302 may be referred to as a "rear panel."

The rear panel 302 may have the inner surface 302*a* directed toward the inner space 33 of the cabinet 30 and the outer surface 302*b* directed toward the outside of the cabinet 30. The supply air hole 308 may be disposed in front of the inner surface 302*a* of the rear panel 302.

The supply air duct 450 may include a first hot air duct 453 connected to the heating device 50, and a second hot air duct 454 connecting the first hot air duct 453 and the supply air hole 308.

The first hot air duct 453 may extend upwardly. The second hot air duct 454 may be integrally formed with the first hot air duct 453. The second hot air duct 454 may extend upwardly and convexly. The second hot air duct 454 may extend upwardly and convexly from the first hot air duct 453, to be connected to the supply air hole 308.

The first hot air duct 453 may be disposed behind the rear panel 302. The first hot air duct 453 may extend upwardly from the rear side of the rear panel 302. The second hot air duct 454 may pass through the rear panel 302 to be connected to the supply air hole 308.

The exhaust air hole 309 connected to the exhaust air duct 440 may be disposed at the lower portion of the cabinet 30. The exhaust air hole 309 may be disposed below the supply air hole 308.

The exhaust air hole 309 which is open may be formed in the rear panel 302. The exhaust air hole 309 may be open from the inner surface 302*a* of the rear panel to the outer surface 302*b* of the rear panel 302. The exhaust air hole 309 may refer to an open portion of the lower side of the rear panel 302.

The exhaust air duct 440 may be connected to the exhaust air hole 309. The exhaust air duct 440 may be coupled to the rear panel 302. The exhaust air duct 440 may be connected to the outer surface 302*b* of the rear panel 302. The exhaust air duct 440 may pass through the rear panel 302.

The exhaust air duct 440 may include a first exhaust air portion 444 connected to the rear panel 302, and a second exhaust air portion 445 extending upwardly from the first exhaust air portion 444.

The first exhaust air portion 444 may extend rearwardly from the rear panel 302. The second exhaust air portion 445 may be integrally formed with the first exhaust air portion 444. The second exhaust air portion 445 may extend upwardly from the first exhaust air portion 444.

The exhaust air duct 440 may be disposed behind the rear panel 302. The second exhaust air portion 445 may extend upwardly from the rear side of the rear panel 302.

The filter 37 may be disposed in the exhaust air hole 309. The filter 37 may be disposed on the rear panel 302. The filter 37 may be disposed between the inner surface 302*a* of the rear panel 302 and the outer panel 302*b* of the rear panel 302. The filter 37 may be disposed at the lower portion of the cabinet 30. As the filter 37 is disposed at the lower portion of the cabinet 30, a user may easily remove and clean the filter 37.

The filter 37 may have the filter insertion hole 371 which is open toward the inner space 33 of the cabinet 30, and the filter net 372 disposed at a rear portion of the filter insertion hole 371.

The filter insertion hole 371 may be disposed behind the inner surface 302*a* of the rear panel 302. The filter net 372 may be disposed in front of the outer surface 302*b* of the rear panel 302.

A plate 34' may be disposed at the lower portion of the cabinet 30. The plate 34' may include a first plate 344 having a dust hole 346 formed therein which is vertically open, and a second plate 345 disposed under the first plate 344.

The first plate 344 may be disposed at the lower portion of the inner space 33. The first plate 344 may extend at a downward incline in a forward direction. The dust hole 346 may be vertically open in the first plate 344. Dust in the inner space 33 may pass through the dust hole 346 to be accumulated on the top of the second plate 345.

The second plate 345 may extend horizontally from the lower side of the first plate 344. The second plate 345 may be withdrawn to the outside of the cabinet 30. By opening the door 31, a user may take the second plate 345 out of the cabinet 30.

The exhaust air hole 309 may be disposed above the first plate 344. The exhaust air hole 309 may be disposed above a lower end of the first plate 344.

As the supply air hole 308 is disposed at the upper portion of the refresher 3, and the exhaust air hole 309 is disposed at the lower portion of the refresher 3, the hot air supplied into the inner space 33 through the supply air hole 308 may sufficiently circulate in the inner space 33. The hot air supplied to the upper portion of the inner space 33 through the supply air hole 308 may flow downwardly to return to the heating device 50 through the exhaust air hole 309 formed at the lower portion. The positions of the supply air hole 308 and the exhaust air hole 309 may promote the diffusion of hot air, supplied through the supply air hole 308, into the inner space 33.

Referring to FIG. 13, the supply air duct 450 may connect the upper portion of the refresher 3 and the heating device 50, and the exhaust air duct 440 may connect the lower portion of the refresher 3 and the heating device 50.

The heating device 50 may be disposed at a position corresponding to a middle height of the refresher 3. The heating device 50 may be positioned at a height between the supply air hole 308 and the exhaust air hole 309. The supply air hole 308 may be disposed above the heating device 50, and the exhaust air hole 309 may be disposed below the heating device 50.

The supply air duct 450 may connect the heating device 50 and the supply air duct 308. The supply air hole 308 may be disposed above the hanger 36, and the supply air duct 450 may be connected to the supply air hole 308 at a position above the hanger 36. The supply air duct 450 may be coupled to the rear panel 302 and may pass through the rear panel 302.

The supply air duct 450 may face the first inner wall 106 of the dryer 1.

The supply air duct 450 may include the first hot air duct 453 connected to the heating device 50, and the second hot air duct 454 connecting the first hot air duct 453 and the supply air hole 308.

The first hot air duct 453 may extend from the heating device 50 to a lateral side. After extending from the heating device 50 to the lateral side, the first hot air duct 453 may be bent upwardly from the rear side of the rear panel 302.

The second hot air duct 454 may extend upwardly and convexly from an upper end of the first hot air duct 453. The second hot air duct 454 may be disposed above the hanger 36.

The exhaust air duct 440 may connect the heating device 50 and the exhaust air hole 309. The exhaust air duct 440 may be coupled to the rear panel 302 and may pass through the rear panel 302.

The exhaust air duct 440 may face the second inner wall 206 of the washing machine 2.

The exhaust air duct 440 may include the first exhaust air portion 444 connected to the exhaust air hole 309 and the second exhaust air portion 445 extending upwardly from the first exhaust air portion 444.

The first exhaust air portion 444 may extend rearwardly from the exhaust air hole 309.

The second exhaust air portion 445 may extend upwardly from a rear end of the first exhaust air portion 444. The second exhaust air portion 445 may extend upwardly from the rear side of the rear panel 302. After extending upwardly from the rear side of the rear panel 302, the second exhaust air portion 445 may be bent to the lateral side to be connected to the heating device 50.

Hereinafter, laundry treating apparatuses B and B' according to other embodiments of the present disclosure will be described with reference to FIGS. 14 to 20.

The description of the dryer 1, the washing machine 2, the refresher 3, and the heating device 50, which are described above with reference to FIGS. 1 to 13, may also be applied to laundry treating apparatuses according to the embodiments of the present disclosure described with reference to FIGS. 14 to 20.

Further, the description of components illustrated in FIGS. 1 to 13 may also be applied to FIGS. 14 to 20, even when the corresponding components are not illustrated in the description of the laundry treating apparatuses with reference to FIGS. 14 to 20. For example, even when the rear case 310 is not illustrated in FIGS. 14 to 20, the description of the rear case 310 described with reference to FIGS. 1 to 13 may also be applied to the description of the rear case 310 given with reference to FIGS. 14 to 20.

Referring to FIG. 14, in the laundry treating apparatus B, the dryer 1 may be disposed under the washing machine 2, and the heating device 50 may be disposed at a lower portion of the dryer 1.

The second upper panel 203 of the washing machine 2 and the third upper panel 303 of the refresher 3 may be disposed on the same horizontal plane.

The first lower panel 104 of the dryer 1 and the third lower panel 304 of the refresher 3 may be disposed on the same horizontal plane.

The heating device 50 may be disposed in the dryer 1. The heating device 50 may be disposed in the first cabinet 10. The heating device 50 may be disposed at a lower portion of the first cabinet 10.

Referring to FIG. 15, the heating device 50 may be disposed under the first drum 13.

The heating device 50 may be disposed at the lower portion of the first cabinet 10, and the machine room S, in which the heating device 50 is disposed, may be formed at the lower portion of the first cabinet 10.

The first supply air duct 43 may extend upwardly from the heating device 50 to be connected to the first drum 13.

The first exhaust air duct 41 may extend downwardly from the first drum 13 to be connected to the heating device 50.

Referring to FIG. 16, the supply air hole 308 and the exhaust air hole 309 of the refresher 3 may be disposed at the lower portion of the refresher 3.

The second supply air duct 45 may be connected to the lower portion of the third cabinet 30.

The supply air hole 308 connected to the second supply air duct 45 may be disposed at the lower portion of the cabinet 3. The supply air hole 308, which is open toward the inner space 33, may be formed in the inner panel 34. The supply air hole 308 may be formed in the second inner panel 342.

The supply air duct 45 may be connected to the supply air portion 308. The supply air duct 45 may be coupled to the third rear panel 302. The supply air duct 45 may pass through the third rear panel 302.

The rear panel 302 may include the inner surface 302*a* directed toward the inner space 33 of the cabinet 30 and the outer surface 302*b* directed toward the outside of the cabinet 30. The supply air hole 308 may be disposed in front of the inner surface 302*a* of the rear panel 302.

The supply air duct 45 may include a first hot air duct 451 connected to the heating device 50, and a second hot air duct 452 connecting the first hot air duct 451 and the supply air hole 308.

The first hot air duct 451 may extend to the lateral side. The second hot air duct 452 may be integrally formed with the first hot air duct 451. The second hot air duct 452 may extend upwardly. The second hot air duct 452 may extend upwardly from the first hot air duct 451, to be connected to the supply air hole 308.

The first hot air duct 451 may be disposed behind the rear panel 302. The first hot air duct 451 may extend to the lateral side from the rear side of the rear panel 302. The second hot air duct 452 may pass through the rear panel 302 to be connected to the supply air hole 308.

The supply air duct 45 may extend horizontally from the rear side of the rear panel 302. The supply air duct 45 may extend horizontally from the rear side of the rear panel 302 to be connected to the heating device 50. The first hot air duct 451 may extend horizontally from the rear side of the rear panel 302.

The second exhaust air duct 44 may be disposed at the lower portion of the third cabinet 30.

The exhaust air hole 309 connected to the exhaust air duct 44 may be disposed at the lower portion of the cabinet 30. The exhaust air hole 309 may be disposed below the supply air hole 308.

The exhaust air hole 309 may be open in the inner panel 34. The exhaust air hole 309 may be open in the first inner panel 341. The exhaust air hole 309 may be disposed at a front portion of the first inner panel 341. The exhaust air hole 309 may be separated from the front side of the supply air hole 308.

The exhaust air duct 44 may be connected to the exhaust air hole 309. The exhaust air duct 44 may be coupled to the inner panel 34. The exhaust air duct 44 may be connected to the lower side of the inner panel 34.

The exhaust air duct 44 may extend horizontally from the lower side of the inner panel 34. The exhaust air duct 44 may extend horizontally from the lower side of the inner panel 34 to be connected to the heating device 50.

The filter 37 may be disposed in the exhaust air hole 309. The filter 37 may be disposed on the inner panel 34.

Referring to FIG. 17, the laundry treating apparatus B may include a duct system connecting the dryer 1, the washing machine 2, the refresher 3, and the heating device 50.

The blowing duct 420 may include a first discharge port 425 connected to the first supply air duct 43. The blowing duct 420 may include a second discharge port 427 connected to the second supply air duct 45. The blowing duct 420 may include a fourth discharge port 428 connected to the dehumidification duct 46. The third supply air duct 48 may branch off from the second supply air duct 45, and a third discharge port 426 may be formed at a portion where the third supply air duct 48 branches off from the second supply air duct 45.

The first discharge port 425 may protrude upwardly from the blowing duct 420. The first supply air duct 43 may connect the first drum 13 and the first discharge port 425.

The second discharge port 427 may protrude from the flowing duct 420 to the lateral side. The second supply air duct 45 may connect the refresher 3 and the second discharge port 427. The second supply air duct 45 may connect the supply air hole 308 and the second discharge port 427.

The third discharge port 426 may protrude upwardly from the second supply air duct 45. The third supply air duct 48 may connect the tub 23 and the third discharge port 426. The third supply air duct 48 may connect the tub 23 and the second supply air duct 45.

The fourth discharge port 428 may protrude from the blowing duct 420 to the lateral side. The fourth discharge port 428 may protrude in a direction opposite to the second discharge port 427. The dehumidification duct 45 may be connected to the fourth discharge port 428.

The hot air flowing into the first drum 13 through the first supply air duct 43 may dry the laundry placed in the first drum 13, and then may flow into the heat exchange channel 42 through the first exhaust air duct 41. The first drum 13 may include the front cover 131 disposed on a front side, and the rear cover 132 disposed on a rear side. The first supply air duct 43 may be connected to the rear cover 132, and the first exhaust air duct 41 may be connected to the front cover 131.

The first exhaust air duct 41 may connect the first drum 13 and the heat exchange channel 42. The first exhaust air duct 41 may extend downwardly from the first drum 13 to be connected to the heat exchange channel 42.

The first inlet port 421 connected to the first exhaust air duct 41 may be formed at the inlet end 42A of the heat exchange channel 42. The first inlet port 421 may extend upwardly from the heat exchange channel 42. The first inlet port 421 may extend upwardly from the case 570 of the heating device 50.

The laundry treating apparatus B may include the first opening and closing valve 41*a* disposed in the first exhaust air duct 41. The first opening and closing valve 41*a* may control a flow rate of air in the first exhaust air duct 41. The first opening and closing valve 41*a* may block an air flow in the first exhaust air duct 41. The first opening and closing valve 41*a* may block the air flow in the first exhaust air duct 41 when the hot air is not supplied into the first drum 13 through the first exhaust air duct 43.

The hot air flowing into third cabinet 30 through the second supply air duct 45 may dry the laundry placed in the third cabinet 30, and then may flow into the heat exchange channel 42 through the second exhaust air duct 44. The second supply air duct 45 may be connected to the third rear panel 302 of the third cabinet 30. The second exhaust air duct 44 may be connected to the heat exchange channel 42 by passing through the third inner wall 306.

The second exhaust air duct 44 may connect the exhaust air hole 309 and the heat exchange channel 42. The second exhaust air duct 44 may extend from the lower side of the third cabinet 30 to the lateral side, to be connected to the heat exchange channel 42.

The second inlet port 422 connected to the second exhaust air duct 44 may be formed at the inlet end 42A of the heat exchange channel 42. The second inlet port 422 may extend from the heat exchange channel 42 to the lateral side. The second inlet port 422 may extend from the third exhaust air duct 47 to the lateral side. The second inlet port 422 may extend from a first duct section 471 to the lateral side. Based on FIG. 17, it is illustrated that the second inlet port 422 extends downwardly from the first duct section 471, but this is merely for convenience of explanation. That is, rather than extending downwardly from the first duct section 471, the second inlet port 422 may extend to the lateral side from the first duct section 471.

The second inlet port 422 may protrude from one side surface of the third exhaust air duct 47 to the lateral side. The second exhaust air duct 44 may connect the inner space 33 of the refresher 3 and the second inlet port 422. The second exhaust air duct 44 may connect the inner space 33 of the refresher 3 and the third exhaust air duct 47. The air in the second exhaust air duct 44 may join the air in the third exhaust air duct 47, to flow into the heat exchange channel 42.

The laundry treating apparatus B may include the second opening and closing valve 44*a* disposed in the second exhaust air duct 44. The second opening and closing valve 44*a* may control a flow rate of air in the second exhaust air duct 44. The second opening and closing valve 44*a* may block an air flow in the second exhaust air duct 44. The second opening and closing valve 44*a* may block the air flow in the second exhaust air duct 44 when the hot air is not supplied into the third cabinet 30 through the second supply air duct 45.

The hot air flowing into the tub 23 through the third supply air duct 48 may dry the laundry placed in the tub 23, and then may flow into the heat exchange channel 42 through the third exhaust air duct 47.

The third exhaust air duct 47 may connect the tub 23 and the heat exchange channel 42. The third exhaust air duct 47 may extend from an upper side of the tub 23, to be connected to the heat exchange channel 42.

The third exhaust air duct 47 may include the first duct section 471 located between the base plate 575 of the heating device 50 and the first lower panel 104. The first duct section 471 may be disposed in the separation space 55 of the heating device 50. The first duct section 471 may extend forward or backward in the separation space 55.

The third inlet port 424 connected to the third exhaust air duct 47 may be formed at the inlet end 42A of the heat exchange channel 42. The third inlet port 424 may extend downwardly from the heat exchange channel 42. The third inlet port 424 may extend downwardly from the case 570 of the heating device 50.

The laundry treating apparatus B may include the third opening and closing valve 47*a* disposed in the third exhaust air duct 47. The third opening and closing valve 47*a* may control a flow rate of air in the third exhaust air duct 47. The third opening and closing valve 47*a* may block an air flow in the third exhaust air duct 47. The third opening and closing valve 47*a* may block the air flow in the third exhaust air duct 47 when the hot air is not supplied into the tub 23 through the third supply air duct 48.

The outside air inlet port 423 may protrude forwardly from one side of the third exhaust air duct 47. The outside air inlet port 423 may allow the indoor space and the third exhaust air duct 47 to communicate with each other. The air in the outside air inlet port 423 may join the air in the third exhaust air duct 47 to flow into the heat exchange channel 42. The outside air inlet port 423 may have the outside air inlet 49 that is opened forward. The air drawn in through the outside air inlet 49 may join the air in the third exhaust air duct 47 to flow into the heat exchange channel 42.

Referring to FIG. 18, the heating device 50 may be disposed at the lower portion of the dryer 1, and may supply hot air to each of the dryer 1, the washing machine 2, and the refresher 3.

The second supply air duct 45 for supplying hot air to the refresher 3 may be disposed at the rear side of the third cabinet 30. The second exhaust air duct 44 may be disposed under the inner panel 34.

The second supply air duct 45 may be disposed behind the third rear panel 302.

The second supply air duct 45 may extend from the heating device 50 in a lateral direction, to be connected to the inner panel 34.

The second supply air duct 45 may pass through the first inner wall 106 of the dryer 1. The second supply air duct 45 may extend into the rear case 310 by passing through the first inner wall 106.

The first hot air duct 451 may be connected to the first inner wall 106. The first hot air duct 451 may be connected to the blowing duct 420, and air blown by the fan 60 may flow into the first hot air duct 451. The first hot air duct 451 may extend horizontally from the heating device 50.

The second hot air duct 452 may be bent upwardly from the first hot air duct 451. The second hot air duct 452 may extend upwardly from one end of the first hot air duct 451.

The supply air hole 308 of the refresher 3 may be disposed at the lower portion of the refresher 3. As the heating device 50 and the supply air hole 308 are disposed at the lower portion of the laundry treating apparatus B, the second supply air duct 45 connecting the heating device 50 and the supply air hole 308 may be reduced in length, thereby minimizing heat loss occurring when the air heated by the heating device 50 flows toward the supply air hole 308. In addition, the hot air supplied by the heating device 50 may be discharged to the inner space 33 through the supply air hole 308 disposed at the lower portion of the refresher 3, such that the hot air may be distributed uniformly over the upper side of the refresher 3.

The second exhaust air duct 44 may be disposed under the inner panel 34. The second exhaust air duct 44 may be connected to the exhaust air hole 309 formed in the inner panel 34.

The second exhaust air duct 44 may extend in the left-right direction, to be connected to the heating device 50. The second exhaust air duct 44 may be connected to the third exhaust air duct 47. The second exhaust air duct 44 may be connected to the third exhaust air duct 47 by passing through the support plate 577.

The third supply air duct 48 may branch off from the second supply air duct 45. The third supply air duct 48 may branch off from the first hot air duct 451. The third supply air duct 48 may branch off from the first hot air duct 451 at the rear side of the third cabinet 30.

The laundry treating apparatus B may include a control valve disposed at a position where the third supply air duct 48 branches off from the second supply air duct 45.

The control valve may control a flow direction of air flowing in the second supply air duct 45. The control valve may control a flow direction of air flowing in the first hot air duct 451. The control valve may open and close the second hot air duct 452 and the third supply air duct 48. The control valve may open only either the second hot air duct 452 or the third supply air duct 48. The control valve may open both the second hot air duct 452 and the third supply air duct 48. The control valve may control a flow amount of air supplied to the second hot air duct 452 or the third supply air duct 48. The control valve may distribute the air, blown by the fan 60 to the second supply air duct 45, to the second hot air duct 452 and the third supply air duct 48.

The controller 81 may control the control valve. By controlling the control valve, the controller 81 may supply the hot air, supplied from the fan 60 to the second supply air duct 450, into the inner space 33 of the refresher 3. By controlling the control valve, the controller 81 may supply the hot air, supplied from the fan 60 to the second supply air duct 45, into the tub 23.

The third supply air duct 48 may extend upwardly from the second supply air duct 45. The third supply air duct 48 may face the first inner wall 106. By extending upwardly from the second supply air duct 45, the third supply air duct 48 may pass through the second inner wall 206, to be connected to the tub 23. The second drum 24 may be supplied with hot air, heated by the heating device 50, through the third supply air duct 48.

The third exhaust air duct 47 may extend from the tub 23 to pass through the second inner wall 206.

The third exhaust air duct 47 may include a first connection part 47*b* passing through the second inner wall 206 to be connected to the tub 23, an extension part 47*c* extending downwardly from the first connection part 47*b*, and a second connection part 47*d* bent from the extension part 47*c* to be connected to the heating device 50.

The second exhaust air duct 44 may pass through the support plate 577. The second supply air duct 45 may pass through the first inner wall 106.

The fan 60 may be disposed closer to the first inner wall 106 than to the first outer wall 105. The fan 60 may be disposed adjacent to the refresher 3. The fan 60 may be disposed closer to the first rear panel 102 than to the first front panel 101. The fan 60 may be disposed behind the third rear panel 302 of the refresher 3. The fan 60 may be disposed between the first drum 13 and the first lower panel 104. The fan 60 may be disposed between the base plate 575 and the first drum 13.

The switching device 70 for controlling the supply of air to the first supply air duct 43 and the second supply air duct 45 may be disposed at a height corresponding to the lower portion of the refresher 3. The switching device 70 may be disposed under the first drum 13. The switching device 70 may be disposed between the first drum 13 and the first lower panel 104. The switching device 70 may be disposed between the first drum 13 and the base plate 575.

In the above arrangement structure, the length of the first supply air duct 43 and the second supply air duct 45 may be minimized. That is, the fan 60 and the switching device 70 are all disposed adjacent to the first drum 13 and the refresher 3, such that the length of the first supply air duct 43 and the second supply air duct 45 may be minimized, thereby reducing heat loss occurring when the air heated by the heating device 50 flows through the first supply air duct 43 and the second supply air duct 45.

The laundry treating apparatus B may include the steam generator 502. The steam generator 502 may generate steam by heating water. The steam generator 502 may be disposed in the heating device 50.

The steam generator 502 may be connected to the first drum 13 by the first steam supply pipe 502*a*. The steam generator 502 may be connected to the refresher 3 by the second steam supply pipe 502*a*. The steam generated by the steam generator 502 may be supplied into the first drum 13 through the first steam supply pipe 502*a*. The steam generated by the steam generator 502 may be supplied into the inner space 33 of the refresher 3 through the second steam supply pipe 502*b*.

Referring to FIG. 19, the heating device 50 may be disposed at the lower portion of the laundry treating apparatus B, and the duct system may be connected to the lower portion of the laundry treating apparatus B.

The base plate 575 of the heating device 50 may be disposed above the first lower panel 104. The separation space 55 may be formed under the base plate 575.

The separation space 55 may be disposed between the first support plate 576 and the second support plate 577.

The laundry treating apparatus B may include the auxiliary panel 58 and the first lower panel 104.

The auxiliary panel 58 may shield a rear side of the separation space 55. The auxiliary panel 58 may be connected to the first rear panel 102 and the first side panels 105 and 106.

The first lower panel 104 may shield a lower side of the separation space 55. The first lower panel 104 may be coupled to the support plates 576 and 577 and the auxiliary panel 58.

The first support plate 576 may include a first protrusion 576*a* protruding downwardly. The second support plate 577 may include a second protrusion 577*a* protruding downwardly. The first protrusion 576*a* and the second protrusion 577*a* may be referred to as "protrusions."

The first lower panel 104 may include recesses 104*a*, into which the protrusions 576*a* and 577*a* are inserted. The recesses 104*a* may be recessed downwardly from the upper surface of the first lower panel 104.

As the protrusions 576*a* and 577*a* are inserted into the recesses 104*a*, the first lower panel 104 may be coupled to the heating device 50.

The dehumidification duct 46 and the third exhaust air duct 47 may be disposed in the separation space 55. The third exhaust air duct 47 disposed in the separation space 55 may be defined as the first duct section 471, and the dehumidification duct 46 disposed in the separation space 55 may be defined as the second duct section 461.

The dehumidification duct 46 may extend forwardly and rearwardly. The hot air outlet 462 may be formed on a front side of the dehumidification duct 46. The air heated by the heating device 50 may be blown by the fan 60 to be supplied to the indoor space through the dehumidification duct 46.

The second exhaust air duct 44 may extend horizontally and may extend into the separation space 55. The second exhaust air duct 44 may pass through the third inner wall 306 and the second support plate 577. The second exhaust air duct 44 may be connected to the third exhaust air duct 47 in the separation space 55. The air in the second exhaust air duct 44 may join the air in the third exhaust air duct 47 to flow into the heat exchange channel 42.

Referring to FIG. 20, without branching off from the second supply air duct 450, the third supply air duct 480 may directly connect the heating device 50 and the washing machine 2.

The third supply air duct 480 and the third exhaust air duct 470 may be directly connected to the heating device 50. Without branching off from the second supply air duct 450, the third supply air duct 480 may be directly connected to the heating device 50. The third supply air duct 480 may be connected to the blowing duct 420.

The third discharge port 426 may protrude downwardly from the blowing duct 420. The third discharge port 426 may protrude downwardly from the second wall 420*b* of the blowing duct 420.

The third discharge port 426 may be connected to the third supply air duct 480. The air blown by the fan 60 may be supplied into the third supply air duct 480 connected to the third discharge port 426.

The third supply air duct 480 may include a first supply air portion 480*a* connected to the third discharge port 426, a second supply air portion 480*b* extending rearwardly from the first supply air portion 480*a*, and a third supply air portion 480*c* extending upwardly from the second supply air portion 480*b*.

The first supply air portion 480*a* may extend downwardly from the third discharge port 426. The first supply air portion 480*a* may extend vertically in the separation space 55.

The second supply air portion 480*b* may extend rearwardly in the separation space 55. A part of the second supply air portion 480*b* may be disposed in the separation space 55, and the other part of the second supply air portion 480*b* may be disposed outside of the separation space 55. A lower end of the second supply air portion 480*b* may be disposed behind the first rear panel 102.

The third supply air portion 480*c* may extend upwardly from the second supply air portion 480*b*, to be connected to the washing machine 2. An end of the third supply air portion 480*c* may be connected to the tub 23. The third supply air portion 480*c* may be disposed behind the first rear panel 102 and the second rear panel 202. The third supply air portion 480*c* may face the first rear panel 102 and the second rear panel 202.

The third exhaust air duct 470 may pass through the rear side of the washing machine 2 and the dryer 1, to be connected to the heating device 50. That is, without extending in the rear case 310, the third exhaust air duct 470 may extend vertically behind the first and second rear panels 102 and 202.

The third exhaust air duct 470 may include the first duct section 471 disposed in the separation space 55, and a duct extension part 472 connected to the first duct section 471.

The first duct section 471 may extend forwardly in the separation space 55. The first duct section 471 may be connected to the inlet end 42A of the heat exchange channel 42. The second exhaust air duct 440 may extend in the left-right direction under the inner panel 34, and may be connected to the first duct section 471 in the separation space 55. The air in the second exhaust air duct 440 may join the air in the first duct section 471 to flow into the heat exchange channel 42.

The first duct section 471 may include a communication hole 471*a* communicating with the duct extension part 472. The communication hole 471*a* may open rearwardly. The duct extension part 472 may be inserted into the communication hole 471*a* to be fixed to the first duct section 471.

The duct extension part 472 may include a first duct extension part 472*a* connected to the first duct section 471, and a second duct extension part 472*b* extending upwardly from the first duct extension part 472*a*.

The first duct extension part 472*a* may extend rearwardly from the first duct section 471, and may be disposed outside of the separation space 55. The first duct extension part 472*a* may be disposed behind the first rear panel 102.

The second duct extension part 472*b* may be bent upwardly from the first duct extension part 472*a*. The second duct extension part 472*b* may be connected to the tub 23. An end of the second duct extension part 472*b* may be connected to the tub 23. The second duct extension part 472*a* may be disposed behind the first rear panel 120 and the second rear panel 202. The second duct extension part 472*a* may face the first rear panel 102 and the second rear panel 202.

However, a structure of the supply air duct and the exhaust air duct which are connected to the washing machine 2 and the refresher 3 of the laundry treating apparatus B is not limited thereto. For example, it is also possible that the supply air duct is installed in the structure as illustrated in FIG. 18, and the exhaust air duct may be installed in the structure as illustrated in FIG. 20. In addition, it is also possible that the supply air duct is installed in the structure as illustrated in FIG. 20, and the exhaust air duct is installed in the structure as illustrated in FIG. 18.

While the present disclosure has been particularly shown and described with reference to preferred embodiments thereof, it will be understood by those skilled in the art that the present disclosure is not limited to those exemplary embodiments and various changes in form and details may be made therein without departing from the scope and spirit of the invention as defined by the appended claims and should not be individually understood from the technical spirit or prospect of the present disclosure.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

Certain embodiments or other embodiments of the disclosure described above are not mutually exclusive or distinct from each other. Any or all elements of the embodiments of the disclosure described above may be combined with another or combined with each other in configuration or function.

For example, a configuration "A" described in one embodiment of the disclosure and the drawings and a configuration "B" described in another embodiment of the disclosure and the drawings may be combined with each other. Namely, although the combination between the configurations is not directly described, the combination is possible except in the case where it is described that the combination is impossible.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

A laundry treating apparatus may include a dryer including a first cabinet, and a drum rotatably mounted in the first cabinet; a refresher including a second cabinet disposed on one side of the first cabinet and having an inner space for receiving laundry; a first supply air duct for supplying air into the drum; a second supply air duct for supplying air into the inner space of the second cabinet; and a heating device heating air flowing into the first supply air duct and the second supply air duct, and disposed in the first cabinet and disposed under the drum.

The laundry treating apparatus may be configured as above, wherein the heating device comprises a heat exchange unit for heating air; and a heat exchange channel in which the heat exchange unit is disposed, wherein the first supply air duct and the second supply air duct are connected to the heat exchange channel.

The laundry treating apparatus may be configured as above, further comprising a washing machine including a third cabinet disposed under the first cabinet, a tub disposed in the third cabinet, and a second drum rotatably mounted in the tub, wherein the heating device is disposed between the drum and the third cabinet.

The laundry treating apparatus may be configured as above, further comprising a third supply air duct for supplying air into the second drum, wherein the first supply air duct extends upwardly from the heating device to be connected to the drum, the second supply air duct extends to a lateral side from the heating device to be connected to the refresher, and the third supply air duct extends downwardly from the heating device to be connected to the tub.

The laundry treating apparatus may be configured as above, further comprising a first exhaust air duct supplying air in the drum to the heating device and extending downwardly from the drum to be connected to the heating device; a second exhaust air duct supplying air in the inner space of the second cabinet to the heating device and extending to the lateral side from the refresher to be connected to the heating device; and a third exhaust air duct supplying air in the second drum to the heating device and extending upwardly from the tub to be connected to the heating device.

The laundry treating apparatus may be configured as above, further comprising a second exhaust air duct connecting the refresher and the heating device, wherein the second supply air duct extends to the lateral side from the heating device and is connected to a supply air hole formed at a lower portion of the refresher; and the second exhaust air duct extends to the lateral side from the heating device and is connected to an exhaust air hole formed at an upper portion of the refresher.

The laundry treating apparatus may be configured as above, further comprising a second exhaust air duct connecting the refresher and the heating device, wherein the second supply air duct extends to the lateral side from the heating device and is connected to a supply air hole formed at an upper portion of the refresher; and the second exhaust air duct extends to the lateral side from the heating device and is connected to an exhaust air hole formed at a lower portion of the refresher.

The laundry treating apparatus may be configured as above, wherein the supply air hole is open obliquely downwardly toward the inner space of the second cabinet.

The laundry treating apparatus may be configured as above, wherein the refresher further comprises a hanger on which the laundry received in the inner space of the second cabinet is hung, and which is disposed below the supply air hole.

The laundry treating apparatus may be configured as above, wherein the refresher further comprises a first plate disposed below the second exhaust air duct and having a dust hole formed therein which is vertically open; and a second plate disposed under the first plate.

The laundry treating apparatus may be configured as above, wherein the dryer further comprises a motor rotating the drum and disposed in the first cabinet, wherein the motor is disposed in the heating device.

The laundry treating apparatus may be configured as above, further comprising a dehumidification duct disposed between the drum and the third cabinet and discharging air, heated by the heating device, outside of the laundry treating apparatus.

The laundry treating apparatus may be configured as above, further comprising a steam generator disposed in the heating device; a first steam supply pipe connecting the steam generator and the drum; a second steam supply pipe connecting the steam generator and the refresher; and a third steam supply pipe connecting the steam generator and the tub.

The laundry treating apparatus may be configured as above, wherein the dryer comprises protrusions protruding downwardly from the first cabinet, wherein the washing machine has recesses which are vertically open on an upper surface of the third cabinet, and into which the protrusions are inserted.

The laundry treating apparatus may be configured as above, further comprising a washing machine including a third cabinet disposed over the first cabinet, a tub disposed in the third cabinet, and a second drum rotatably mounted in the tub.

The laundry treating apparatus may be configured as above, wherein the first supply air duct extends upwardly from the heating device to be connected to the drum; and the second supply air duct extends to the lateral side from the heating device to be connected to the supply air hole disposed at the lower portion of the refresher.

The laundry treating apparatus may be configured as above, further comprising a second exhaust air duct connecting the heating device and the refresher, wherein the refresher further comprises a supply air hole connected to the second supply air duct and being open obliquely upwardly toward the inner space of the second cabinet; and an exhaust air hole connected to the second exhaust air duct and being open toward the inner space of the second cabinet at a position spaced apart from the supply air hole.

The laundry treating apparatus may be configured as above, further comprising a third supply air duct connecting the tub and the heating device.

A laundry treating apparatus may include a dryer including a first cabinet and a first drum rotatably mounted in the first cabinet; a washing machine including a second cabinet disposed under the first cabinet, a tub disposed in the second cabinet, and a second drum rotatably mounted in the tub; a refresher including a third cabinet disposed on one side of the first cabinet and the second cabinet and having an inner space for receiving laundry; a duct system including a first supply air duct connected to the first drum, a second supply air duct connected to the refresher, and a third supply air duct connected to the tub; and a heating device disposed between the first drum and the second drum and including a heat exchange channel connected to the first supply air duct, the second supply air duct, and the third supply air duct.

A laundry treating apparatus may include a dryer including a first cabinet and a first drum rotatably mounted in the first cabinet; a washing machine including a second cabinet disposed over the first cabinet, a tub disposed in the second cabinet, and a second drum rotatably mounted in the tub; a refresher including a third cabinet disposed on one side of the first cabinet and the second cabinet and having an inner space for receiving laundry; a heating device disposed under the first drum, and heating air supplied into the first drum; and a supply air duct supplying the air, heated by the heating device, into the inner space of the third cabinet and connecting a supply air hole, disposed at a lower portion of the refresher, and the heating device.

A laundry treating apparatus may include an integrated frame having a first laundry loading opening and a second laundry loading opening which are vertically spaced apart from each other, and having a horizontal partition wall formed at a middle portion; a first door for opening and closing the first laundry loading opening; a second door for opening and closing the second laundry loading opening; a refresher having a drying room in which a first drum is rotatably disposed between an upper panel and the horizontal partition wall of the integrated frame, a washing room having a tub, which is disposed between a lower panel and the horizontal partition wall of the integrated frame, and having a second drum which is rotatably mounted in the tub, a side frame disposed on one side of the integrated frame and having an opening and an inner space for receiving laundry, and a third door for opening and closing the opening; a duct system including a first supply air duct for supplying air into the first drum, a second supply air duct for supplying air into the side frame, and a heat exchange channel connected to the first supply air duct and the second supply air duct; and a heating device for heating air passing through the heat exchange channel.

The laundry treating apparatus may be configured as above, wherein the heating device is disposed in the drying room or in the side frame.

The laundry treating apparatus may be configured as above, wherein the heating device is disposed between the horizontal partition wall and the first drum.

A laundry treating apparatus may include a single frame which has a vertical partition wall formed therein, and a horizontal partition wall disposed between the vertical partition wall and one side panel, and in which a washing room and a drying room are vertically separated by the horizontal partition wall between the one side panel and the vertical partition wall, and a refreshing room is disposed between the vertical partition wall and an opposite side panel; a first drum for receiving laundry is rotatably mounted in the drying room, a tub is disposed in the washing machine, a second drum for receiving the laundry is rotatably mounted in the tub, and the single frame has a first laundry loading opening through which the laundry is loaded into the first drum, a second laundry loading opening through which the laundry is loaded into the second drum, an opening through which the laundry is introduced into the refreshing room, and first, second, and third doors coupled to the single frame, and opening and closing the first and second laundry loading openings and the opening, respectively; a duct system including a first supply air duct for supplying air to the first drum, a second supply air duct for supplying air to the refreshing room, and a heat exchange channel connected to the first supply duct and the second supply air duct; and a heating device for heating air passing through the heat exchange channel.

The laundry treating apparatus of may be configured as above, wherein the heating device is disposed in the drying room or the refreshing room.

The laundry treating apparatus of may be configured as above, wherein the drying room is disposed over the washing room, and the heating device is disposed between the horizontal partition wall and the first drum.

A laundry treating apparatus may include a first laundry treating machine including a cabinet having a laundry loading opening, a door for opening and closing the laundry loading opening, and a drum rotatably mounted in the cabinet and receiving laundry; a second laundry treating machine including a cabinet having a laundry loading opening, a door for opening and closing the laundry loading opening, and having an inner space for receiving laundry; a duct system including a first supply air duct for supplying air into the drum of the first laundry treating machine, a second supply air duct for supplying air into the inner space of the second laundry treating machine, and a heat exchange channel having an inlet end where air is introduced, and a discharge end where the air is discharged, with the first and second supply air ducts being connected to the discharge end; and a heating device for heating air passing through the heat exchange channel.

The laundry treating apparatus may be configured as above, wherein the heating device is disposed in the cabinet of the first laundry treating machine.

The laundry treating apparatus may be configured as above, wherein the heating device is disposed under the drum.

The laundry treating apparatus may be configured as above, wherein the duct system comprises a first inlet port which is formed at the inlet end of the heat exchange channel, and through which the air flows into the heat exchange channel; and a second inlet port which is formed at the inlet end of the heat exchange channel, through which the air flows into the heat exchange channel, and which is spaced apart from the first inlet port.

The laundry treating apparatus may be configured as above, wherein the duct system comprises a first exhaust air duct connected to the first inlet port and discharging the air in the drum; a second exhaust air duct connected to the second inlet port and discharging the air in the inner space of the second laundry treating machine.

The laundry treating apparatus may be configured as above, comprising a first opening and closing valve disposed in the first exhaust air duct and opening and closing the first exhaust air duct; and a second opening and closing valve disposed in the second exhaust air duct and opening and closing the second exhaust air duct.

The laundry treating apparatus may be configured as above, further comprising a switching device for selectively opening the first supply air duct and the second supply air duct.

The laundry treating apparatus may be configured as above, wherein the heating device is a heat pump device including a compressor, an evaporator, and a condenser which are connected by a refrigerant passage.

The laundry treating apparatus may be configured as above, wherein the evaporator and the condenser are disposed in the heat exchange channel.

The laundry treating apparatus may be configured as above, wherein the heating device comprises a heater for heating the air passing through the heat exchange channel, wherein the heater is disposed in the heat exchange channel.

The laundry treating apparatus may be configured as above, further comprising a cooler disposed in the heat exchange channel, wherein the cooler is disposed on an upstream side of the heater.

The laundry treating apparatus may be configured as above, further comprising a fan disposed in the heat exchange channel.

A laundry treating apparatus may include a dryer including a first cabinet having a first laundry loading opening, a first door for opening and closing the first laundry loading opening, and a first drum rotatably mounted in the first cabinet and receiving laundry; a washing machine including a second cabinet disposed vertically with respect to the first cabinet and having a second laundry loading opening, a second door opening and closing the second laundry loading opening, a tub disposed in the second cabinet, and a second drum rotatably mounted in the tub and receiving laundry; a refresher including a third cabinet disposed on one side of the washing machine and the dryer and having an opening, a third door for opening and closing the opening, and having an inner space for receiving laundry; a duct system including a first supply air duct for supplying air into the first drum, a second supply air duct for supplying air into the inner space of the refresher, and a heat exchange channel connected to the first supply air duct and the second supply air duct; and a heating device for heating air passing through the heat exchange channel.

The laundry treating apparatus may be configured as above, wherein the heating device is disposed in any one of the dryer and the refresher.

The laundry treating apparatus may be configured as above, wherein the heating device is disposed in the first cabinet.

The laundry treating apparatus may be configured as above, wherein the first cabinet is disposed over the second cabinet, and the heating device is disposed between the first drum and the second cabinet.

The laundry treating apparatus may be configured as above, wherein the heating device is disposed over an upper panel of the second cabinet.

The laundry treating apparatus may be configured as above, wherein the first cabinet comprises a machine room, which is a space formed under the first drum, and the heating device is disposed in the machine room.

The laundry treating apparatus may be configured as above, further comprising a driving motor for rotating the first drum, wherein the driving motor is disposed in the machine room.

The laundry treating apparatus may be configured as above, wherein the heating device is a heat pump device comprising a compressor, a condenser, and an evaporator which are connected by a refrigerant passage.

The laundry treating apparatus may be configured as above, wherein the evaporator and the condenser are disposed in the heat exchange channel and are configured to heat exchange the air, passing through the heat exchange channel, with a refrigerant.

The laundry treating apparatus may be configured as above, wherein the heating device comprises a base plate, on which the condenser and the evaporator are disposed; both side walls connected to the base plate and standing on both sides of the condenser and the evaporator; and a cover disposed on an upper side of the condenser and the evaporator, wherein the heat exchange channel are surrounded by the base plate and the both side walls.

The laundry treating apparatus may be configured as above, wherein the heating device comprises a base plate, on which the condenser and the evaporator are disposed; a first support plate protruding downwardly from the base plate; and a second support plate protruding downwardly from the base plate and facing the first support plate, wherein a space, in which a portion of the duct system is disposed, is formed between the first support plate and the second support plate.

The laundry treating apparatus may be configured as above, wherein the first support plate and the second support plate are disposed over the second cabinet.

The laundry treating apparatus may be configured as above, wherein the first support plate and the second support plate have protrusions protruding downwardly toward the second cabinet, wherein the second cabinet comprises a second upper panel disposed under the first support plate and the second support plate; and recesses which are formed in the second upper panel, and into which the protrusions are inserted.

The laundry treating apparatus may be configured as above, wherein the heat exchange channel comprises an inlet end through which the air in the first drum and the air in the inner space of the refresher are introduced; and a discharge end through which the air, having passed through the heat exchange channel, is supplied to the first supply air duct or the second supply air duct, wherein the duct system comprises a first inlet port which is formed at the inlet end and through which the air in the first drum is introduced; a second inlet port which is formed a the inlet end and through which the air in the inner space of the refresher is introduced; a first discharge port formed at the discharge end and connected to the first supply air duct; and a second discharge port formed at the discharge end and connected to the second supply air duct.

The laundry treating apparatus may be configured as above, wherein the duct system comprises a first exhaust air duct connecting the first drum and the first inlet port; and a second exhaust air duct connecting the inner space of the refresher and the second inlet port.

The laundry treating apparatus may be configured as above, wherein the refresher comprises a supply air hole connected to the second supply air duct; and an exhaust air hole connected to the second exhaust air duct, wherein the supply air hole is formed at a lower portion of the refresher, and the exhaust air hole is formed at an upper portion of the refresher.

The laundry treating apparatus may be configured as above, wherein the supply air hole is disposed below a height of the heating device, and the exhaust air hole is disposed above the height of the heating device.

The laundry treating apparatus may be configured as above, further comprising a fan disposed in the duct system.

The laundry treating apparatus may be configured as above, wherein the fan is disposed in the heat exchange channel.

The laundry treating apparatus may be configured as above, wherein the duct system further comprises a blowing duct disposed on the discharge side of the heat exchange channel, and having a fan disposed therein, wherein the blowing duct comprises a first discharge port connected to the first supply air duct; and a second discharge port connected to the second supply air duct.

The laundry treating apparatus may be configured as above, wherein the blowing duct has a square-shaped cross-section with upper, lower, left, and right walls, wherein the first discharge port and the second discharge port are formed in different walls among the upper, lower, left, and right walls.

The laundry treating apparatus may be configured as above, further comprising a switching device disposed in the blowing duct, and controlling a flow direction of air blown by the fan.

The laundry treating apparatus may be configured as above, wherein the switching device comprises a rotating body rotatably disposed in the blowing duct, and selectively communicating with the first discharge port or the second discharge port; and a driving motor for rotating the rotating body.

The laundry treating apparatus may be configured as above, wherein the rotating body comprises a rotating plate coupled to the driving motor; and a scroll coupled to the rotating plate and having the blowing channel formed therein.

The laundry treating apparatus may be configured as above, wherein the duct system comprises a third supply air duct connected to the heat exchange channel and supplying air into the tub; a third exhaust air duct through which the air in the tub is introduced into the heat exchange channel; a third discharge port connecting the heat exchange channel and the third supply air duct; and a third inlet port connecting the heat exchange channel and the third exhaust air duct.

The laundry treating apparatus may be configured as above, wherein the duct system further comprises a second exhaust air duct connecting the inner space of the refresher and the heat exchange channel, wherein the third inlet port is formed in the second exhaust air duct.

The laundry treating apparatus may be configured as above, wherein the duct system further comprises an outside air inlet port through which outside air is introduced, and which is connected to the heat exchange channel; and a dehumidification duct discharging air, heat exchanged in the heat exchange channel, to the outside of the laundry treating apparatus.

The laundry treating apparatus may be configured as above, wherein the duct system further comprises a second exhaust air duct connecting the inner space of the refresher and the heat exchange channel, wherein the outside air inlet port is formed in the second exhaust air duct.

The laundry treating apparatus may be configured as above, wherein the duct system further comprises a fourth discharge port connecting the heat exchange channel and the dehumidification duct, wherein the dehumidification duct is disposed under the heating device and extends forwardly from the fourth discharge port, and has an outlet through which the heat-exchanged air is discharged to the outside.

The laundry treating apparatus may be configured as above, wherein the duct system further comprises a second exhaust air duct connecting the inner space of the refresher and the heat exchange channel, wherein the second exhaust air duct has a duct section disposed in a space formed under the heat exchange channel, and extending forwardly and backwardly in the space.

The laundry treating apparatus may be configured as above, wherein the heat exchange channel comprises a discharge end through which the air, having passed through the heat exchange channel, is supplied to the first supply air duct and the second supply air duct, wherein the duct system comprises a first discharge port connected to the first supply air duct and formed on an upper side the discharge end; and a second discharge port connected to the second supply air duct and formed on a lateral side of the discharge end.

The laundry treating apparatus may be configured as above, wherein the heat exchange channel comprises a inlet end through which the air in the first drum or the air in the inner space of the refresher is introduced, wherein the duct system comprises a first inlet port formed on an upper side of the inlet end; and a second inlet end formed on a lower side of the inlet end.

A laundry treating apparatus may include a dryer having a drum for receiving laundry; a washing machine disposed on one side of the dryer in a direction horizontal to the dryer; a refresher disposed over the dryer and the washing machine, and having an inner space for receiving laundry; a duct system including a first supply air duct supplying air into the drum, a second supply air duct supplying air into the inner space of the refresher, an inlet end through which air is introduced, a discharge end through which the air is discharged, the first supply air duct and the second supply air duct being connected to the discharge end; and a heating device for heating air passing through the heat exchange channel.

A laundry treating apparatus may include a dryer having a cabinet and a drum rotatably mounted in the cabinet; a refresher disposed on one side of the dryer and having an inner space for receiving laundry; a heating device disposed under the drum and heating air supplied into the drum; and a supply air duct connecting the heating device and the refresher, and supplying the air, heated by the heating device, into the inner space of the refresher.

The laundry treating apparatus may be configured as above, wherein the heating device is disposed in the cabinet, and the supply air duct extends from the heating device to a lateral side to be connected to the refresher.

The laundry treating apparatus may be configured as above, wherein the refresher has a supply air hole formed at a lower portion of the inner space thereof, where the supply air duct communicates with the supply air hole and is connected to the lower portion of the refresher.

The laundry treating apparatus may be configured as above, wherein the refresher comprises an inner panel disposed on a lower side of the inner space and having the supply air hole formed therein, wherein the inner panel comprises a first inner panel disposed horizontal to the lower side of the inner space; and the second inner panel bent upwardly from the first inner panel, wherein the supply air hole is formed in the second inner panel.

The laundry treating apparatus may be configured as above, wherein the refresher comprises a third cabinet having the inner space, wherein the supply air duct comprises a first hot air duct connected to the heating device and disposed at a rear side of the third cabinet; and a second hot air duct connecting the first hot air duct and the inner panel and disposed in the third cabinet.

The laundry treating apparatus may be configured as above, further comprising a fan pressurizing air heated by the heating device, wherein the fan is disposed on one side of the refresher and is disposed under the drum.

The laundry treating apparatus may be configured as above, wherein the cabinet comprises a first side panel disposed adjacent to the refresher; and a second side panel disposed farther from the refresher than the first side panel, wherein the fan is disposed in the cabinet and is disposed closer to the first side panel than to the second side panel.

The laundry treating apparatus may be configured as above, wherein the supply air duct comprises a first supply air duct connecting the heating device and the drum and extending upwardly from the heating device; and a second supply air duct connecting the heating device and the refresher and extending from the heating device to a lateral side.

The laundry treating apparatus may be configured as above, further comprising a blowing duct which is connected to the first supply air duct and the second supply air duct, and in which the fan is received; and a switching device disposed in the blowing duct and controlling a flow direction of air blown by the fan, wherein the blowing duct is disposed under the drum and disposed at a height corresponding to a lower portion of the refresher.

The laundry treating apparatus may be configured as above, further comprising a first exhaust air duct connecting the drum and the heating device; and a second exhaust air duct connecting the inner space of the refresher and the heating device, wherein the second exhaust air duct is disposed at the lower portion of the refresher.

The laundry treating apparatus may be configured as above, further comprising an inner panel disposed on a lower side of the inner space; and an exhaust air hole formed in the inner panel and connected to the second exhaust air duct, wherein the second exhaust air duct extends from the lower side of the inner panel to the lateral side toward the heating device.

A laundry treating apparatus may include a dryer including a first cabinet and a first drum rotatably mounted in the first cabinet; a washing machine disposed over the dryer and including a second cabinet, a tub disposed in the second cabinet, and a second drum rotatably mounted in the tub; a refresher disposed on one side of the washing machine and the dryer and including a third cabinet having an inner space for receiving laundry; and a heating device heating air supplied into the inner space of the refresher, wherein the heating device is disposed under the first drum.

The laundry treating apparatus may be configured as above, wherein the refresher has a supply air hole disposed at a lower portion of the inner space, wherein the supply air duct communicates with the supply air hole and is connected to a lower portion of the refresher.

The laundry treating apparatus may be configured as above, wherein the refresher comprises an inner panel disposed on a lower side of the inner space, extending to be bent upwards, and having the supply air hole.

The laundry treating apparatus may be configured as above, further comprising a first supply air duct connecting the heating device and the first drum, and extending upwardly from the heating device; a second supply air duct connecting the heating device and the refresher, and extending from the heating device to the lateral side; and a third supply air duct branching off from the second supply air duct and connected to the tub.

The laundry treating apparatus may be configured as above, wherein the third supply air duct branches off from the second supply air duct outside of the first cabinet.

The laundry treating apparatus may be configured as above, further comprising a first exhaust air duct connecting the first drum and the heating device; a second exhaust air duct connecting the inner space of the refresher and the heating device; and a third exhaust air duct connecting the tub and the heating device, wherein the second exhaust air duct is connected to the third exhaust air duct.

The laundry treating apparatus may be configured as above, wherein the heating device comprises a heat exchange unit heating air introduced through the first, second, and third exhaust air ducts; and a base plate on which the heat exchange unit is mounted, wherein a separation space is formed between the base plate and the first cabinet, and a portion of the third exhaust air duct is disposed in the separation space.

The laundry treating apparatus may be configured as above, further comprising an outside air inlet port communicating with the outside of the laundry treating apparatus and disposed in the separation space; and a dehumidification duct, to which air heated by the heat exchange unit is supplied, and which extends forwardly in the separation space.

A laundry treating apparatus may include a dryer having a first cabinet and a first drum rotatably mounted in the first cabinet; a washing machine disposed over the dryer and including a second cabinet, a tub disposed in the second cabinet, and a second drum rotatably mounted in the tub; a refresher disposed on one side of the washing machine and the dryer, and including a third cabinet having an inner space for receiving laundry; a heating device disposed under the first drum and heating air supplied into the first drum; and a supply air duct connecting the heating device and the third cabinet, and supplying air heated by the heating device into the inner space of the third cabinet.

A laundry treating apparatus may include a cabinet having an opening formed on a front side thereof and an inner space for receiving laundry; a hanger on which the laundry received in the inner space of the cabinet is hung, and which is disposed at an upper portion of the inner space of the cabinet; a door coupled to a front side of the cabinet and opening and closing the opening; a heating device heating air supplied into the inner space of the cabinet; and a supply air duct connecting the heating device and the cabinet, wherein the supply air duct is connected to a supply air hole that opens toward the inner space of the cabinet, and is disposed above the hanger.

The laundry treating apparatus may be configured as above, wherein the cabinet comprises an upper wall having a first surface separated from an upper side of the hanger, wherein the supply air hole is positioned at a height between the first surface and the hanger.

The laundry treating apparatus may be configured as above, wherein the upper wall has a second surface extending at an incline downwardly toward a lower side from the first surface, wherein the supply air hole is open in the second surface.

The laundry treating apparatus may be configured as above, wherein the supply air duct extends upwardly and convexly from the supply air hole.

The laundry treating apparatus may be configured as above, further comprising an exhaust air duct connecting the heating device and the cabinet, wherein the exhaust air duct is connected to an exhaust air hole that opens toward the inner space of the cabinet and is disposed at a lower portion of the cabinet.

The laundry treating apparatus may be configured as above, further comprising a filter disposed in the exhaust air hole.

The laundry treating apparatus may be configured as above, further comprising a first plate disposed under the inner space of the cabinet, and having a dust hole formed therein which is vertically open; and a second plate disposed under the first plate.

The laundry treating apparatus may be configured as above, wherein the first plate is disposed below the exhaust air hole.

The laundry treating apparatus may be configured as above, further comprising an exhaust air duct connecting the heating device and the cabinet, wherein the exhaust air duct is connected to the exhaust air hole that opens toward the inner space of the cabinet and is disposed at an upper portion of the cabinet.

The laundry treating apparatus may be configured as above, wherein the exhaust air hole is disposed below the hanger.

The laundry treating apparatus may be configured as above, wherein the exhaust air hole is disposed below the supply air hole.

The laundry treating apparatus may be configured as above, wherein the exhaust air hole is disposed further away from the heating device than the supply air hole.

A laundry treating apparatus may include a cabinet having an opening formed on a front side thereof and an inner space for receiving laundry; a door coupled to the front side of the cabinet and opening and closing the opening; a heating device heating air supplied into the inner space of the cabinet; and a supply air duct connecting the heating device and the cabinet, wherein the heating device is disposed on one side of the cabinet, and the supply air duct extends from the heating device to be connected to an upper portion of the cabinet.

The laundry treating apparatus may be configured as above, wherein the heating device is disposed at a position corresponding to a middle height of the cabinet, wherein the supply air duct comprises a first supply air portion extending from the heating device to a lateral side and bent upwardly; and a second supply air portion extending upwardly and convexly from the first supply air portion and connected to the upper portion of the cabinet.

The laundry treating apparatus may be configured as above, further comprising an exhaust air duct extending from the heating device to be connected to the lower portion of the cabinet, wherein the heating device is disposed at a position corresponding to the middle height of the cabinet, wherein the exhaust air duct comprises a first exhaust air portion extending rearwardly from the lower portion of the cabinet; and a second exhaust air portion extending upwardly from the first exhaust air portion and bent toward the lateral side to be connected to the heating device.

The laundry treating apparatus may be configured as above, wherein the heating device is disposed at a position corresponding to the upper portion of the cabinet, wherein the supply air duct extends from the heating device to the lateral side to be connected to the upper portion of the cabinet.

The laundry treating apparatus may be configured as above, further comprising an exhaust air duct extending from the heating device to be connected to the upper portion of the cabinet, wherein the heating device is disposed at a position corresponding to the upper portion of the cabinet, and the exhaust air duct extends from the heating device to the lateral side to be connected to the upper portion of the cabinet.

The laundry treating apparatus may be configured as above, further comprising a dryer disposed on one side of the cabinet, and having a first drum rotatably mounted therein; and a washing machine disposed on one side of the cabinet, and having a second drum rotatably mounted therein, wherein the dryer, the washing machine, and the heating device are vertically arranged on one side of the cabinet.

The laundry treating apparatus may be configured as above, wherein the supply air duct extends from the heating device to the lateral side and is connected to the cabinet at a rear side of the cabinet.

A laundry treating apparatus may include a cabinet having an opening formed on a front side thereof and an inner space for receiving laundry; a door coupled to the front side of the cabinet and opening and closing the opening; a heating device heating air supplied into the inner space of the cabinet; and a supply air duct connecting the heating device and the cabinet, wherein the supply air duct is connected to the upper side of the cabinet.

A laundry treating apparatus may include a cabinet having an opening formed on a front side thereof and an inner space for receiving laundry; a door coupled to the front side of the cabinet and opening and closing the opening; a heating device heating air supplied into the inner space of the cabinet and disposed on one side of the cabinet; and a supply air duct extending from the heating device to a lateral side and connected to a supply air hole disposed at a lower portion of the cabinet.

The laundry treating apparatus may be configured as above, wherein the heating device is disposed at a position corresponding to a middle height of the cabinet, and the supply air duct extends by being bent downwardly from the heating device.

The laundry treating apparatus may be configured as above, wherein the cabinet comprises a rear panel separated from a rear side of the door and forming the inner space of the cabinet with the door, wherein the supply air duct comprises a first hot air duct having a first supply air portion extending from the heating device to a lateral side; a second supply air portion extending downwardly from the first supply air portion, and a third supply air portion extending from the second supply air portion toward the rear panel; and a second hot air duct disposed in front of the rear panel, and connecting the first hot air duct and the supply air hole.

The laundry treating apparatus may be configured as above, further comprising an exhaust air duct extending by being bent upwardly from the heating device, and connected to an exhaust air hole formed at an upper portion of the cabinet.

The laundry treating apparatus may be configured as above, wherein the exhaust air duct comprises a first exhaust air portion extending from the exhaust air hole toward a rear side of the cabinet; a second exhaust air portion extending downwardly from the first exhaust air portion; and a third exhaust air portion extending from the second exhaust air portion to the lateral side to be connected to the heating device.

The laundry treating apparatus may be configured as above, further comprising a dryer disposed on one side of the cabinet, and having a first drum rotatably mounted therein; and a washing machine disposed under the dryer, and having a second drum rotatably mounted therein, wherein the heating device is disposed between the first drum and the second drum.

The laundry treating apparatus may be configured as above, wherein the heating device is disposed at a position corresponding to the lower portion of the cabinet, and the supply air duct extends from the heating device to the lateral side.

The laundry treating apparatus may be configured as above, further comprising an exhaust air duct connected to the exhaust air hole formed at the lower portion of the cabinet, and extending to the lateral side toward the heating device.

The laundry treating apparatus may be configured as above, further comprising a dryer disposed on one side of the cabinet, and having a first drum rotatably mounted therein; and a washing machine disposed over the dryer, and having a second drum rotatably mounted therein, wherein the heating device is disposed under the first drum and the second drum.

The laundry treating apparatus may be configured as above, wherein the heating device comprises a heat exchange channel for heating air supplied into the first drum and the cabinet, wherein the supply air duct comprises a first supply air duct connecting the heat exchange channel and the first drum; and a second supply air duct connecting the heat exchange channel and the cabinet.

A laundry treating apparatus may include a cabinet having an opening formed on a front side thereof and an inner space for receiving laundry; a door coupled to the front side of the cabinet and opening and closing the opening; a heating device heating air supplied into the inner space of the cabinet; and a supply air duct connecting the heating device and the cabinet, wherein the supply air duct is connected to a supply air hole that opens toward the inner space of the cabinet and is disposed at a lower portion of the cabinet.

The laundry treating apparatus may be configured as above, wherein the cabinet comprises a rear panel separated from a rear side of the door and forming the inner space of the cabinet with the door, wherein the supply air duct comprises a first hot air duct disposed behind the rear panel and connected to the heating device; and a second hot air duct connecting the first hot air duct and the supply air hole.

The laundry treating apparatus may be configured as above, further comprising an inner panel disposed on a lower side of the inner space of the cabinet, wherein the supply air hole is open upwardly in the inner panel.

The laundry treating apparatus may be configured as above, wherein the cabinet comprises a rear panel separated from a rear side of the door and forming the inner space of the cabinet with the door, wherein the inner panel comprises a first inner panel horizontally extending from the lower side of the inner space of the cabinet toward the rear panel; and a second inner panel extending at an incline upwardly from the first inner panel toward the rear panel, wherein the supply air hole is formed in the second inner panel.

The laundry treating apparatus may be configured as above, further comprising an exhaust air duct that opens toward the inner space of the cabinet and is connected to the exhaust air hole formed at the upper portion of the cabinet.

The laundry treating apparatus may be configured as above, further comprising a hanger on which the laundry received in the inner space of the cabinet is hung, and which is disposed at an upper portion of the inner space of the cabinet, wherein the exhaust air hole is disposed below the hanger.

The laundry treating apparatus may be configured as above, wherein the cabinet comprises a rear panel separated from a rear side of the door and forming the inner space of the cabinet with the door, wherein the exhaust air hole is open in the rear panel, and the exhaust air duct is bent downwardly from a rear side of the rear panel.

The laundry treating apparatus may be configured as above, further comprising an exhaust air duct connected to an exhaust air hole that is open toward the inner space of the cabinet and is disposed at a lower portion of the cabinet.

The laundry treating apparatus may be configured as above, further comprising an inner panel disposed on a lower side of the inner space of the cabinet, wherein the exhaust air hole is open upwardly in the inner panel.

The laundry treating apparatus may be configured as above, wherein the cabinet comprises a rear panel separated from a rear side of the door and forming the inner space of the cabinet with the door, wherein the inner panel comprises a first inner panel horizontally extending from the lower side of the inner space of the cabinet toward the rear panel; and a second inner panel extending at an incline upwardly from the first inner panel toward the rear panel, wherein the exhaust air hole is open upwardly in the first inner panel, and the supply air hole is open obliquely upwardly in the second inner panel.

Various embodiments described herein may be implemented in a computer-readable medium using, for example, software, hardware, or some combination thereof. For example, the embodiments described herein may be implemented within one or more of Application Specific Integrated Circuits (ASICs), Digital Signal Processors (DSPs), Digital Signal Processing Devices (DSPDs), Programmable Logic Devices (PLDs), Field Programmable Gate Arrays (FPGAs), processors, controllers, micro-controllers, microprocessors, other electronic units designed to perform the functions described herein, or a selective combination thereof. In some cases, such embodiments are implemented by the controller. That is, the controller is a hardware-embedded processor executing the appropriate algorithms (e.g., flowcharts) for performing the described functions and thus has sufficient structure. Also, the embodiments such as procedures and functions may be implemented together with separate software modules each of which performs at least one of functions and operations. The software codes can be implemented with a software application written in any suitable programming language. Also, the software codes can be stored in the memory and executed by the controller, thus making the controller a type of special purpose controller specifically configured to carry out the described functions and algorithms. Thus, the components shown in the drawings have sufficient structure to implement the appropriate algorithms for performing the described functions.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A laundry treating apparatus comprising:

a dryer including:

a first cabinet; and a first drum rotatably disposed in the first cabinet;

a washing machine including:

a second cabinet disposed under the first cabinet;

a tub disposed in the second cabinet; and a second drum rotatably disposed in the tub, a refresher including a third cabinet disposed at a lateral side of the first cabinet, the third cabinet having an inner space for receiving laundry;

a first supply air duct for supplying air into the first drum;

a second supply air duct for supplying air into an inner space of the second cabinet;

a heating device for heating air flowing into the first supply air duct and the second supply air duct, the heating device being disposed in the first cabinet and under the first drum; and a third supply air duct for supplying air into the second drum, wherein the dryer, the refresher and the washing machine are adjacently disposed, wherein the washing machine and the dryer are vertically adjacently disposed, wherein the refresher is adjacently disposed on one side of the washing machine and the dryer, wherein the heating device is disposed between the first drum and the second cabinet, wherein the first supply air duct extends upwardly from the heating device and is connected to the first drum, wherein the second supply air duct extends laterally from the heating device and is connected to the refresher, and wherein the third supply air duct extends downwardly from the heating device and is connected to the tub.

2. The laundry treating apparatus of claim 1, wherein the heating device includes:

a heat exchange unit for heating air; and a heat exchange channel in which the heat exchange unit is disposed, and wherein the first supply air duct and the second supply air duct are connected to the heat exchange channel.

3. The laundry treating apparatus of claim 1, further comprising:

a first exhaust air duct supplying air in the first drum to the heating device, the first exhaust air duct extending downwardly from the first drum and connected to the heating device;

a second exhaust air duct supplying air in the inner space of the third cabinet to the heating device, the second exhaust air duct being connected to the heating device; and a third exhaust air duct supplying air in the second drum to the heating device, the third exhaust air duct extending upwardly from the tub and connected to the heating device.

4. The laundry treating apparatus of claim 1, further comprising a second exhaust air duct connecting the refresher and the heating device, wherein the second supply air duct is connected to a supply air hole formed at an upper portion of the refresher, and wherein the second exhaust air duct is connected to an exhaust air hole formed at a lower portion of the refresher.

5. The laundry treating apparatus of claim 4, wherein the supply air hole is open obliquely downwardly toward the inner space of the second cabinet.

6. The laundry treating apparatus of claim 4, wherein the refresher further includes a hanger for hanging the laundry received in the inner space of the second cabinet, the hanger being positioned below the supply air hole.

7. The laundry treating apparatus of claim 4, wherein the refresher further includes:

a first plate disposed below the second exhaust air duct, the first plate having a dust hole formed therein; and a second plate disposed under the first plate, and wherein the first plate is inclined relative to the second plate.

8. The laundry treating apparatus of claim 1, further comprising a dehumidification duct disposed between the first drum and the second cabinet, the dehumidification duct for discharging air heated by the heating device to outside of the laundry treating apparatus.

9. The laundry treating apparatus of claim 1 further comprising:

a steam generator disposed in the heating device;

a first steam supply pipe connecting the steam generator and the first drum;

a second steam supply pipe connecting the steam generator and the refresher; and a third steam supply pipe connecting the steam generator and the tub.

10. The laundry treating apparatus of claim 1, wherein the dryer has a protrusion protruding downwardly from the first cabinet, and wherein the washing machine has a recess on an upper surface of the second cabinet, the protrusion being inserted into the recess.

11. The laundry treating apparatus of claim 1, wherein the dryer further includes a motor for rotating the first drum, the motor being disposed in the heating device.

12. The laundry treating apparatus of claim 1, wherein the heating device includes:

a heat exchange channel for dehumidifying the air supplied into the inner space of the second cabinet;

an evaporator disposed in the heat exchange channel; and a drain pan disposed under the evaporator.

13. The laundry treating apparatus of claim 1, wherein the second supply air duct extends laterally from the heating device, the second supply air duct being connected to a supply air hole formed at an upper portion of the refresher, wherein the supply air hole is open obliquely downwardly toward the inner space of the second cabinet, and wherein a second exhaust air duct is connected to an exhaust air hole formed at a lower portion of the refresher.

* * * * *